US008741104B2

(12) United States Patent
Edwards et al.

(10) Patent No.: US 8,741,104 B2
(45) Date of Patent: Jun. 3, 2014

(54) TISSUE PRODUCTS INCORPORATING NANOPOROUS CELLULOSE FIBER

(76) Inventors: Steven L. Edwards, Fremont, WI (US); Rajai H. Atalla, Verona, WI (US)

( * ) Notice: Subject to any disclaimer, the term of this patent is extended or adjusted under 35 U.S.C. 154(b) by 9 days.

(21) Appl. No.: 13/457,801

(22) Filed: Apr. 27, 2012

(65) Prior Publication Data

US 2012/0273147 A1 Nov. 1, 2012

Related U.S. Application Data

(60) Provisional application No. 61/628,698, filed on Nov. 4, 2011, provisional application No. 61/518,047, filed on Apr. 29, 2011.

(51) Int. Cl.
*D21H 11/18* (2006.01)

(52) U.S. Cl.
USPC ..... 162/149; 162/141; 162/146; 428/311.91

(58) Field of Classification Search
CPC ..... D21H 11/00; D21H 11/18; D21H 27/002; D21H 5/12; D21H 5/14; D21H 5/141; D21H 11/16; D21H 27/004; D21H 27/005; D21H 27/007
USPC ..... 162/141, 157.1, 157.6, 146, 149; 428/311.71, 311.91; 536/56
See application file for complete search history.

(56) References Cited

U.S. PATENT DOCUMENTS 5,858,021 A * 1/1999 Sun et al. ..... 8/125
2005/0145348 A1 7/2005 Lee ..... 162/4

FOREIGN PATENT DOCUMENTS

WO WO 2009/124240 10/2009
WO WO 2012/037250 3/2012 ..... C08L 1/02

OTHER PUBLICATIONS

Wiley et al., Band Assignments in the Raman Spectra of Celluloses, The Institute of Paper Chemistry, Appleton, Wisconsin 54912 (U.S. A.), Carbohydrate Research, 160 (1987), pp. 113-129.

Appendix H of TAPPI Standard T 401 om-08, Fiber Analysis of Paper and Paperboard, (2008).

A Color Atlas for Fiber Identification, John H. Graff, published by the Institute of Paper Chemistry, Appleton, Wisconsin, 1940.

* cited by examiner

*Primary Examiner* — Eric Hug
(74) *Attorney, Agent, or Firm* — Robert S. Alexander

(57) ABSTRACT

Fibrous cellulosic products incorporating both conventional cellulosic fibers and laterally expanded cellulose fibers exhibit exceptional porosity, bulk, absorbency and resiliency properties. Typical products include absorbent tissue products, absorbent fluff products and flat papers. The laterally expanded cellulose fibers exhibit: (i) a broadened X-Ray diffraction peak for the most prominent reflection having a width at half-height, $(W_{1/2h})_A$, of at least about 3.0° 2Θ, (ii) broad overlapping maxima in their Raman spectrum between 285 and 500 $cm^{-1}$, the height of the two tallest of said maxima in said spectrum between 285 and 500 $cm^{-1}$ being between 35 and 50% of the height of the peak near 1098 $cm^{-1}$ and (iii) a blue stain when treated with Graff C-stain, the stain exhibiting less red than the stains exhibited with bleached hardwood kraft fibers and bleached softwood kraft fibers.

35 Claims, 54 Drawing Sheets

X-RAY DIFFRACTOGRAMS OF BLEACHED KRAFT PULP BEFORE AND AFTER DECRYSTALLIZATION TREATMENT.

ADDITION EFFECTS OF LEC FIBER
WITH NO REFINING

NSWK POROSITY COMPARISON

FREENESS RESPONSE WITH BEATING TIME

OPACITY BULK RELATIONSHIP

CALIPER TENSILE RELATIONSHIP

UNREFINED BLEND PROPERTY RESPONSES

POROSITY RESPONSE TO CSI FIBERS

EFFECT OF REFINING ON POROSITY

RAMAN SPECTRUM OF TREATED SOUTHERN PINE PULP ($cm^{-1}$)

RAMAN SPECTRUM OF TREATED NORTHERN HARDWOOD KRAFT ($cm^{-1}$)

RAMAN SPECTRUM OF TREATED AVICEL CELLULOSE ($cm^{-1}$)

RAMAN SPECTRUM OF TREATED NORTHERN BLEACHED SOFTWOOD KRAFT ($cm^{-1}$)

RAMAN SPECTRUM OF TREATED CORN STOVER ($cm^{-1}$)

SOUTHERN PINE

NORTHERN SOFT-WOOD KRAFT

HYBRID POPLAR CHIPS (BUTANOL-PULPED)

NEKOOSA HW CHIPS (BUTANOL-PULPED)

NORTHERN BLEACHED SOFTWOOD (KRAFT-PULPED)

DERR CORN STOVER (SODA-PULPED)

TISSUE PRODUCTS INCORPORATING NANOPOROUS CELLULOSE FIBER

CLAIM FOR PRIORITY

This application is based on U.S. Provisional Application Ser. No. 61/518,047, entitled "Tissue Products with Nanoporous Fiber", filed Apr. 29, 2011 and U.S. Provisional Application Ser. No. 61/628,698, entitled "Tissue Products Incorporating Nanoporous Cellulose Fiber", filed Nov. 4, 2011. The priorities of U.S. Provisional Application Ser. Nos. 61/518,047 and 61/628,698 are hereby claimed and the disclosures are incorporated herein by reference in their entireties.

INTRODUCTION

Even though cellulose is by far the most common naturally-occurring polymer, its extremely useful chains are often almost locked up by lignin, hemicelluloses and, particularly, adjacent chains of cellulose. Accordingly, even though there are numerous known methods of freeing cellulose molecules from their surroundings, these methods are typically rather expensive, involving high temperatures, long residence times and a variety of more or less troublesome chemicals. Recently, a method of increasing the accessibility of chains of cellulose has been developed as set forth in International Publication No. WO 2009/124240 A1 (International Application No. PCT/US2009/039445), entitled "Highly Disordered Cellulose", published Oct. 8, 2009 (hereinafter referred to as "Atalla I" and incorporated herein by reference) in which a novel form of cellulose is formed by treating conventional sources of cellulose with an alkali in an alcohol/water co-solvent system, including water and a second solvent that is polar and fully water-miscible, typically a lower alcohol or a polyol, to form a less ordered cellulose, and stabilizing that less ordered cellulose by washing out the alkali to yield a highly disordered cellulose in an aqueous medium. As discussed in Atalla I, this process makes the cellulose more accessible for enzymatic or chemical reaction by opening up the tightly aggregated domains.

In this novel form of cellulose, substantial crystallinity is retained by the cellulosic structure with the molecular chains remaining organized in a specific pattern, apparently maintaining the spatial relationship of the chain molecules aligned parallel to each other; but with significant internal disorder of the anhydroglucose units within individual chains. Thus after transformation to the novel form of cellulose, the internal organization of individual chains is less ordered than it is in the cellulosic source material but the molecular chains seem to retain their organization parallel to each other in a manner not unlike that prevailing in the source celluloses. Thus, as more fully described in U.S. Provisional Application No. 61/382,604, filed Sep. 14, 2010 and entitled "Nanoporous Cellulose" (hereinafter referred to as "Atalla II" and incorporated herein by reference), while the previously known crystalline cellulosic substances retain substantial organization at both the macroscopic and microscopic levels, organization in the novel cellulose is altered at the nanoscale level with the result being such that the space between adjacent molecular chains is significantly increased. However, it appears that the degree of displacement or increased spacing between adjacent chains is of a rather small order, nano-scale, so it is not yet known whether an actual increase in fiber diameter will be easily measurable; but we consider the evidence quite strong that there is increased lateral separation between the chains of cellulose molecules leading to what we term a "nanoporous structure" based upon: (i) the X-ray diffraction patterns presented herein; (ii) the surprisingly high opacity of the fibers; (iii) the presence of spherular fines in high magnification micrographs of the treated fibers; (iv) the smooth surfaces of the fibers observable in high magnification micrographs; and (v) the increased accessibility of the cellulose molecules to reactants, especially large molecule enzymatic reactant. See also PCT Application PCT/US2011/051592, entitled "NANO-DEAGGREGATED CELLULOSE", published Mar. 22, 2012 and incorporated herein by reference. Accordingly, these novel celluloses can also be aptly referred to as "Highly Disordered Cellulose", as "nanoporous cellulose" or as "laterally expanded cellulose", but, as we consider the most significant differences between this novel cellulose and previously known celluloses, it has become apparent that these celluloses may be aptly described as "Laterally Expanded Cellulose" as the individual chains appear to remain more or less coherent but spaced apart so that they are far more accessible than in conventional crystalline celluloses; but, whether previously referred to as "highly disordered cellulose" or as "nanoporous cellulose", the novel celluloses described in these applications are neither amorphous, nor mercerized nor completely disordered. For convenience, these novel celluloses as described in Atalla I and II are hereinafter referred to either as nanoporous cellulose or as laterally expanded cellulose or "LEC fiber" as, for purposes of this application; we believe this better describes the most significant differences between these fibers and previously known forms of cellulose. In this application, we are far more interested in the changes in mechanical properties thought to result from the hypothesized disruption of the bonds between cellulose molecules in laterally adjacent chains, while the increased chemical accessibility resulting from the nanoporous structure is only of secondary interest. Conversely, in biochemical conversion of cellulose, the improved accessibility resulting from the nanoporous structure is more significant than changes in mechanical properties.

However, Atalla I and II are almost exclusively concerned with the chemical aspects of this rearrangement, being primarily directed in increasing the chemical accessibility of individual cellulose molecules for chemical reaction to facilitate production of ethanol from cellulose and other chemical reactions. What was previously unrecognized is that laterally expanded cellulose fibers are ideally suited for use in manufacture of towel and tissue products as relatively small amounts of LEC fiber can produce significant improvements in sheet properties, especially for soft tissue products—bath and facial tissue.

Laterally expanded cellulose fibers can make significant contributions to tissue properties in three areas that are of major concern to tissue makers: they can significantly increase bulk, reduce tensile and improve sheet porosity. Further, these fibers increase the freeness of the sheet making it possible to remove more water from the sheet mechanically. Tissue makers can use this advantage by increasing the speed of their machines as well as by savings in the amount of energy required for drying per ton of tissue dried. LEC fiber also integrates well into existing tissue making operations as the beneficial properties of LEC fiber are relatively insensitive to refining. In many tissue making operations, the strength of the tissue being manufactured is controlled by varying the amount of refining applied to the furnish. Since the effect of refining on LEC fiber is not extremely pronounced, the benefits obtained by including LEC fiber in the furnish are not necessarily excessively attenuated by the typical variations in refining used by the tissue maker to control strength and thereby control softness.

Laterally expanded cellulose fibers are also highly advantageous in fluff-pulp applications including diapers, catamenial devices and other absorptive applications, particularly because webs incorporating LEC fibers exhibit substantial recovery in bulk after pressing, do not require as much debonder to achieve good bulk and can be formed with less intensive defiberizing operations such as hammermilling. The ability to reduce or eliminate debonder is particularly significant as debonders are not only expensive, they inherently conflict with the absorptive web's raison d'être—absorption.

In Attala I, the laterally expanded cellulose is treated with enzymes converting the saccharides in the cellulose chains into glucose far more rapidly than previously known procedures for converting cellulose to ethanol. It appears that the treatment both opens up the fiber and decreases the crystallinity of the cellulose. As discussed herein, the presence of laterally expanded cellulose can be verified by staining with Graff's C-Stain, X-ray diffraction, Raman spectroscopy, high magnification microscopy and solid state NMR techniques. Even though laterally expanded cellulose is converted to glucose far more rapidly than previously known forms of cellulose, the process is not instantaneous. Laterally expanded cellulose fibers can be used after the alkalinity has been washed out; or, if desired, the residual fibers can be used after part of the cellulose has been enzymatically converted to glucose. In one example, approximately 60% of the cellulose was converted to glucose after 13 or so hours; but, after 28 more hours for a total of about 41 hours, only another 20% was converted. Accordingly, it may be more economically attractive in some cases to convert about 50% to 60% of the cellulose to glucose and use the remaining portion of the cellulosic fibers for papermaking, than to tie up equipment for an additional 28 hours to convert only an additional 20% of the cellulose to glucose. It can be appreciated that, as the enzymatic step will most likely be the bottleneck in any plant for conversion of cellulose to glucose, a plant converting approximately 50 to 60% of the cellulose to glucose and forwarding the remainder of the fibers to papermaking might produce more than twice as much glucose in a given period of time as a plant allowing the enzymatic reaction to proceed to the point at which over 80% of the cellulose had been converted.

LEC fibers can be distinguished from conventional cellulosic fibers by several methods even if the history of their manufacture is unknown:

Raman spectra for LEC fibers typically exhibit broad overlapping maxima in the range between 285 and 500 $cm^{-1}$, often taking the form of two pairs of peaks, one centered near 367 ($cm^{-1}$) and the other near 441 ($cm^{-1}$) with the Raman intensity of the pair at 367 ($cm^{-1}$) exceeding that of the pair at 441 ($cm^{-1}$). In the region of Raman shifts between about 250 and 650 $cm^{-1}$ which are often considered particularly useful in characterization of celluloses, the peaks are broadened and less distinct than the peaks in the same region for Cellulose I and Cellulose II. The discernible peaks near 489 and 578 $cm^{-1}$, perhaps more properly called apiculi, can provide important points of differentiation between LEC and Celluloses I and II with the apiculus at 489 $cm^{-1}$ being shifted about 5 $cm^{-1}$ more than the corresponding apiculus of cellulose II which occurs at 484 $cm^{-1}$ while the apiculus at 578 $cm^{-1}$ is shifted about 12 $cm^{-1}$ more than its counterpart in cellulose I. FIGS. 2, 3 and 4 illustrate Raman spectra obtained with Cellulose I (derived from kraft pulp), Cellulose II (mercerized cellulose) and the novel cellulose of the present invention respectively, the uppermost line indicating the Raman spectrum of LEC. All Raman spectra included herein use a CCD detector and either a 785 nm laser or a 532 nm laser; so the peaks represent counts and accordingly reflect the relative numbers of the photons experiencing each specified Raman shift. Where data is taken in the range of 2600 $cm^{-1}$ to 4000 $cm^{-1}$, the 532 nm laser is preferably used to avoid issues with fluorescence. In particular, 785 nm red laser was used for FIGS. 2-4 and FIG. 32 while the 532 nm green laser was used for FIGS. 28-31 and FIGS. 33-36. Throughout this specification and claims, wave numbers presented for Raman spectra should generally be considered ±2 $cm^{-1}$ relative to the nearest characteristic peak although it is believed that the wave numbers presented for the second set of Avicel derived samples are more accurate. However, it will be appreciated by those having familiarity with Raman spectra of celluloses that these spectra characteristic exhibit peaks which fall at about 355, 380, 437; 458; 521; 897 and 1098; 1120; 1330, 1340, 1380 and 2900 $cm^{-1}$ so numerical values given are more useful in determining where peaks are located relative to the nearby characteristic peaks than in indicating the absolute location. For example, in Tables 1A and 1B set forth below, if it is wished to determine the absolute locations of the peak nominally located at 1113 for NSWK, it is located 21.8 $cm^{-1}$ above the peak nominally located at 1091 $cm^{-1}$, so its absolute location would be understood to be 1098+21.8 or 1119.8 $cm^{-1}$. Throughout this application where we are comparing the height ratios of various peaks in the Raman spectra, those ratios should be understood to be those obtained with the 532 nm green laser in the absence of any indication to the contrary.

Tables 1A and 1B set forth the Raman spectra obtained for both treated and untreated cellulose fibers obtained from a variety of cellulose sources.

TABLE 1A

Raman peaks of Treated Fiber up to 1100 $cm^{-1}$

| | | | | | | | | | | | | | | |
|---|---|---|---|---|---|---|---|---|---|---|---|---|---|---|
| NSWK | 348.3 | 372.8 | 416.4 | 432.7 | 454.5 | 487.1 | 514.3 | 574.2 | | | 895.3 | 963.3 | | 1091.2 |
| Tr. Ht. | 51.1 | 55.2 | 34.4 | 40.0 | 36.5 | 35.8 | 30.1 | 13.9 | | | 31.7 | 12.1 | | 100 |
| UnTr. Ht. | 25.2 | 64.9 | | 45.5 | 34.5 | 23.3 | 28.2 | 10.4 | | | 19.1 | 12.1 | | 100 |
| HWK | 352.8 | 377.0 | 422.8 | 433.6 | 457.8 | 492.8 | | 579.0 | 614.9 | 821.3 | 899.4 | 974.8 | 991.4 | 1093.3 |
| Tr. | 29.8 | 32.2 | 23.7 | 23.7 | 25.8 | 32.2 | | 12.8 | 7.60 | 7.00 | 29.8 | 12.5 | 12.5 | 100 |
| UnTr. Ht. | 15.5 | 31.55 | | 22.1 | 25.5 | 9.45 | 9.45 | 5.43 | 5.43 | 0 | 12.1 | | 13.1 | 100 |
| Avicel 2 | 354.3 | 376.2 | 420.2 | | 458.6 | 491.6 | 519.1 | 579.5 | | | 898.0 | 966.7 | | 1095.8 |
| Tr | 51.2 | 46.1 | 37.4 | | 39.0 | 25.9 | 19.5 | 16.2 | | | 32.3 | 8.08 | | 100 |
| Mer | 56.7 | 33.8 | 39.0 | | 36.2 | 22.3 | 19.5 | 21.4 | | | 36.5 | 8.06 | | 100 |
| UnTr | 32.3 | 72.7 | | | 39.5 | 18.1 | 29.3 | 8.75 | | | 13.0 | 10.3 | | 100 |
| So. Pine | 353.5 | 375.6 | 422.6 | | 455.7 | 488.9 | | 577.3 | | | 900.4 | 969.5 | | 1093.8 |
| So. Pine treated height | 35.0 | 35.0 | 28.1 | 28.1 | 30.5 | 27.07.0 | | 13.7 | | | 30.1 | | | 100 |

TABLE 1A-continued

| Raman peaks of Treated Fiber up to 1100 $cm^{-1}$ | | | | | | | | | |
|---|---|---|---|---|---|---|---|---|---|
| So. Pine untreated height | 22.4 | 49.3 | 34.0 | 28.3 | 30.9 | 8.2 | 14.7 | 100 | |
| stover | | 381.3 | 444.1 | | 495.7 | | 902.9 | 1098.5 | |

TABLE 1B

| Raman peaks of Treated Fiber over 1100 $cm^{-1}$ | | | | | | | | | | | |
|---|---|---|---|---|---|---|---|---|---|---|---|
| NSWK | 1113.0 | 1260.0 | | 1333.4 | 1374.3 | | | 1458.6 | | | 2893.6 | 3400.0 |
| Tr. Ht. | 83.1 | 20.61 | | 33.9 | 58.0 | | | 27.4 | | | | |
| UnTr. Ht. | 77.8 | | | 30.5 | 49.7 | | | 19.1 | | | | |
| HWK | 1120.3 | 1263.0 | 1314.2 | 1338.4 | 1376.1 | 1411.1 | 1432.6 | 1459.6 | 1653.5 | 2727.9 | 2892.2 | 3393.1 |
| Tr. Ht. | | 16.1 | 25.8 | 25.8 | 41.3 | 26.4 | 26.4 | 25.5 | 10.33 | | | |
| UnTr. Ht | | | | 27.94 | 27.5 | 20.1 | | 9.85 | 1.81 | | | |
| Avicel | | 1266.0 | | 1340.2 | 1375.9 | | | 1461.0 | | 2726.3 | 2888.5 | 3433.8 |
| Tr. Ht. | | 21.2 | | 28.6 | 40.7 | | | 18.52 | | | | |
| Merc. | | 31.6 | | 36.9 | 50.5 | | | 25.7 | | | | |
| UnTr. Ht | | | | 25.7 | 37.1 | | | 12.1 | | | | |
| So. Pine | 1118.7 | 1262.3 | | 1336.9 | 1375.5 | 1417.0 | | 1461.1 | | 2742.7 | 2897.4 | 3444.3 |
| So. Pine treated height | | 19.8 | | 27.8 | 44.1 | | | 20.1 | | | | |
| So. Pine untreated height | | | | 28.9 | 38.2 | | | 15.9 | | | | |
| stover | 1117 | 1268.2 | | | | | | | 1633.6 | | | |

Table 1C sets forth those peaks which show up most distinctly in and reliably in Raman spectra of treated fibers obtained from these fiber sources:

TABLE 1C

| Characteristic Raman peaks of Treated Fiber | | | | | | | | | | | |
|---|---|---|---|---|---|---|---|---|---|---|---|
| NSWK | 348.3 | 372.8 | 416.4 | 454.5 | 487.1 | 574.2 | 895.3 | 1091.2 | 1260.0 | 1374.3 | 1458.6 |
| HWK | 352.8 | 377.0 | 422.8 | 457.8 | 492.8 | 579.0 | 899.4 | 1093.3 | 1263.0 | 1376.1 | 1459.6 |
| Avicel 2 | 354.3 | 376.2 | 420.2 | 458.6 | 491.6 | 579.5 | 898.0 | 1095.8 | 1266.0 | 1375.9 | 1461.0 |
| So. Pine | 353.5 | 375.6 | 422.6 | 455.7 | 488.9 | 577.3 | 900.4 | 1093.8 | 1262.3 | 1375.5 | 1461.1 |

Table 1D sets forth the heights of the Raman peaks by which Nanoporous cellulose (laterally expanded cellulose) may be most readily distinguished from conventional cellulose.

TABLE 1D

| Heights of Characteristic Peaks Relative to Peak Near 1100 $cm^{-1}$ | | | | | |
|---|---|---|---|---|---|
| | Band Region | | | | |
| | 348-355 | 416-423 | 487-493 | 895-901 | 1260-1267 |
| Peak Height relative to 1100 $cm^{-1}$ | 34+ | 20+ | 25+ | 25+ | 10+ |

Similarly the two peaks observed in the X-ray diffractogram for Cellulose I are broadened and merged relative to the X-ray diffractogram for Cellulose I prepared by the kraft process as shown in FIG. 1 as well as the X-ray diffractogram for Cellulose II as illustrated in FIG. 1A. In particular, the X-Ray diffractogram for laterally expanded cellulose exhibits a broad shouldered peak centered about 20.6° 2Θ in which traces of the almost merged peak at about 12° 2Θ manifest in the shoulder most apparent between around 16° and 12° 2Θ. Mathematical techniques for deconvolving the net peak into the underlying two peaks are known to those having skill in the art and are described in the open literature. In the sample of LEC represented in FIG. 1, the peak at 20.6° 2Θ is properly considered as two peaks with the dominant peak having a width at half height of about 4.5° after the baseline indicated by the dotted line is subtracted off. In this case, the width at half height is determined by fairing in a baseline between the shoulders of the peak, determining the height of the peak above the baseline, then measuring the lateral distance between the peak and the portion of the peak away from the merging peak at a distance half way down from the peak and doubling that figure to get the width at half height which in the case of LEC typically exceeds 3.0° 2Θ, more commonly exceeds about 3.50° 2Θ, more commonly is between 3.5 and 7° 2Θ, and most commonly between 4 and 5.0° 2Θ. FIGS. 37-40 present comparisons of the X-ray diffractograms for Poplar chips, Nekoosa HW chips, Northern Bleached Softwood chips and Den corn stover before and after treatment. It can be appreciated that in the case of the Northern Bleached Softwood Kraft chips, in contrast to other fibers, the width at half-height obtained by doubling the width of the left hand half of the peak only slightly exceeds 3.0° 2Θ.

LEC fibers in a formed web comprising conventional fibers can be identified by their ability to accept a deep blue stain similar to the Bright Blue Stain indicated for 20% on Plate IV at Bright Stain of Graff's Color Atlas when stained with Graff C-stain. Lignin containing fibers will stain in various hues of red, yellow and orange. Highly bleached sulfate pulps will accept more of a purple to dusky blue. See tiles in row 7 under S. W. Unblch. & Blch, Soda, Sodite & Kraft as well as tiles in rows 7 and 8 of H. W. Unblch. & Blch, Soda, Sodite & Kraft in plate III of "A Color Atlas for Fiber Identification" by John H. Graff, published by the Institute of Paper Chemistry, Appleton, Wis. 1940, incorporated herein by reference. See also Appendix H of TAPPI Standard T 401 om-08, Fiber Analysis of Paper and Paperboard. Upon microscopic inspection of a stained sheet, the LEC fibers stand out both because of their deep blue stain and their anfractuous nature. In cases of doubt about whether stain is the proper shade of deep blue, those doubts can be resolved by checking the morphology of the fibers as the LEC fibers will normally be anfractuous exhibiting more kinks, curls and turns than conventional cellulosic papermaking fibers. In many cases, LEC fibers derived from cotton fibers will exhibit behavior upon dyeing that will differ from both Cellulose I or Cellulose II fibers typically found in conventional cotton fibers.

LEC fibers formed into handsheets will exhibit a bulk at least about 50% greater than that of a handsheet made from untreated fiber; a tensile strength which is greatly reduced from that of a comparable handsheet, no more than about 70% of the tensile strength of comparable handsheet; and if made from unbeaten fibers, a porosity exceeding that of the comparable sheet by at least a factor of three; a caliper, void volume and liquid retention which is at least fifty percent greater than that of the cellulose I hand sheet, typically at least double. It appears that many of these benefits are at least in large part attributable to the anfractuous nature of the LEC fibers. Typically LEC fibers will exhibit a length weighted curl index of at least about 0.15 and often of at least about 0.2 as determined using known procedures set forth in Lee; Method of Providing Paper-Making Fibers with Durable Curl and Absorbent Products Incorporating Same, US Patent Application Publication 2005/0145348 A1, published Jul. 7, 2005.

The Raman spectra of LEC fibers will typically exhibit either:

- a peak in the band between 250 $cm^{-1}$-400 $cm^{-1}$ having a peak width at half height of at least about 30 $cm^{-1}$, often over 35, 40, or 45 $cm^{-1}$; or
- a peak in the band between 400 $cm^{-1}$-600 $cm^{-1}$ having a peak width at half height of at least about 55 $cm^{-1}$, often over 60, 65, 70 or 90 $cm^{-1}$; or
- a combination of these two.

The Raman spectra of more preferred LEC fibers will typically exhibit:

- a peak in the band between 250 $cm^{-1}$-400 $cm^{-1}$ having a peak width at half height of at least about 30 $cm^{-1}$, often over 35, 40, or 45 $cm^{-1}$; and
- a peak in the band between 400 $cm^{-1}$-600 $cm^{-1}$ having a peak width at half height of at least about 55 $cm^{-1}$, often over 60, 65, 70 or 90 $cm^{-1}$; and
- a peak in the band near 1100 $cm^{-1}$ having a peak width at half height of at least about 45 $cm^{-1}$.

As compared to the fiber sources from which they are prepared, LEC fibers will exhibit three broad peaks, one being a series of overlapping peaks between about 250 $cm^{-1}$ and about 400 $cm^{-1}$; another being a series of overlapping peaks between about 400 $cm^{-1}$ and about 600 $cm^{-1}$ and the third being a peak centered near 1100 $cm^{-1}$, at least two of said peaks being at least 10%, 15% or 20% broader at half height than the corresponding peak in the pulp from which it was prepared. Often at least one of said peaks is at least 100% broader at half height than the corresponding peak in the cellulosic from which it was prepared.

SUMMARY OF THE INVENTION

A preferred embodiment of the fibrous cellulosic product of the present invention will comprise nanoporous cellulose fibers exhibiting a broadened X-Ray diffraction peak for the most prominent reflection having a width at half-height, $(W_{1/2h})_A$, of at least about 3.0° 2Θ, preferably at least about 3.25° 2Θ, still more preferably from at least about 3.5° to about 7° 2Θ, most preferably from at least about 3.0° to about 7° 2Θ, the Raman spectrum of said nanoporous cellulose fibers in the region between 285 and 500 $cm^{-1}$ exhibiting increased overlap and lowered maxima as compared to cellulose I and cellulose II.

An especially advantageous embodiment of the present invention is an absorbent pad for a diaper, catamenial device or panty liner comprising laterally expanded cellulosic fibers.

Another especially advantageous embodiment of the present invention is an absorbent cellulosic sheet comprising laterally expanded cellulosic fibers and conventional papermaking fibers, said conventional papermaking fibers being selected from the group consisting of bleached and unbleached Kraft wood pulp fibers, bleached and unbleached mechanically pulped fibers, chemically pulped hardwood and softwood fibers, recycled fibers, TMP, CTMP, BCTMP and mercerized fibers.

Another preferred embodiment of the fibrous cellulosic product of the present invention will comprise nanoporous cellulose fibers accepting a blue stain when treated with Graff C-stain, the stain exhibiting less red than the stains exhibited with bleached hardwood kraft fibers and bleached softwood kraft fibers; and exhibit broad overlapping maxima in their Raman spectrum between 285 and 500 $cm^{-1}$, said broad overlapping maxima defining at least one doublet between 300 $cm^{-1}$ and 500 $cm^{-1}$.

Another preferred embodiment of the fibrous cellulosic product of the present invention will comprise nanoporous cellulose fibers exhibiting an X-Ray diffraction peak at 2Θ=20.6° having a width at half-height, $(W_{1/2h})_A$, of at least about 3.0° 2Θ, preferably at least about 3.5°, for the most prominent reflection and exhibiting broad overlapping maxima in their Raman spectrum between 285 and 500 $cm^{-1}$, the width of the tallest of said maxima in said spectrum between 285 and 400 $cm^{-1}$ being at least about 30 $cm^{-1}$, preferably at least about 35, 40 or 45 $cm^{-1}$, and the width of the tallest of said maxima in said spectrum between 400 and 500 $cm^{-1}$ being at least about 55 $cm^{-1}$, preferably at least about 60, 65, 70 or 90 $cm^{-1}$.

Yet another preferred embodiment of the fibrous cellulosic product of the present invention will comprise nanoporous cellulose fibers, wherein the Raman Spectrum of the fibers exhibits two broad peaks, one centered near 367 $cm^{-1}$ and another lower peak centered near 441 $cm^{-1}$, the peak centered near 367 $cm^{-1}$ having a width at half height of at least about 30 $cm^{-1}$, the peak centered near 441 $cm^{-1}$ having a width at half height of at least about 55 $cm^{-1}$.

Yet another preferred embodiment of the fibrous cellulosic product of the present invention will comprise nanoporous cellulose fiber exhibiting a peak in its Raman spectrum between: 355 and 360 $cm^{-1}$, the height of the peak between 355 and 360 $cm^{-1}$ being at least 20%, preferably at least 25%, more preferably at least 30% and most preferably at least 34%, of the height of the peak between 1094 and 1098 $cm^{-1}$.

Another preferred embodiment of the fibrous cellulosic product of the present invention will comprise nanoporous cellulose fiber exhibiting a peak in its Raman spectrum between: 416 and 423 $cm^{-1}$, the height of the peak between 416 and 423 $cm^{-1}$ being of the height of the peak between 1094 and 1098 $cm^{-1}$.

Another preferred embodiment of the fibrous cellulosic product of the present invention will comprise nanoporous cellulose fiber exhibiting a peak in its Raman spectrum between: 487-493 $cm^{-1}$, the height of the peak between 487 and 493 $cm^{-1}$ being at least 25% of the height of the peak between 1094 and 1098 $cm^{-1}$.

Yet another preferred embodiment of the fibrous cellulosic product of the present invention will comprise nanoporous cellulose fiber exhibiting a peak in its Raman spectrum between 895 and 901 $cm^{-1}$, the height of the peak between 895 and 901 $cm^{-1}$ being at least 25% of the height of the peak between 1094 and 1098 $cm^{-1}$.

Still another preferred embodiment of the fibrous cellulosic product of the present invention will comprise nanoporous cellulose fiber exhibiting a peak in its Raman spectrum between 1260 and 1267 $cm^{-1}$, the height of the peak between 1260 and 1267 $cm^{-1}$ being at least 10% of the height of the peak between 1094 and 1098 $cm^{-1}$.

A greatly preferred embodiment of the fibrous cellulosic product of the present invention will comprise nanoporous cellulose fiber exhibiting peaks in its Raman spectrum between:

about 355 and 360 $cm^{-1}$,
about 416 and 424 $cm^{-1}$,
about 487 and 493 $cm^{-1}$,
about 895 and 901 $cm^{-1}$,
about 1094 and 1098 $cm^{-1}$, and
about 1260 and 1267 $cm^{-1}$;

the height of the peak between about 355 and 360 $cm^{-1}$ being at least 34% of the height of the peak between 1094 and 1098 $cm^{-1}$;

the height of the peak between about 416 and 424 $cm^{-1}$ being at least 20% of the height of the peak between 1094 and 1098 $cm^{-1}$;

the height of the peak between about 487 and 493 $cm^{-1}$ being at least 25% of the height of the peak between 1094 and 1098 $cm^{-1}$;

the height of the peak between about 895 and 901 $cm^{-1}$ being at least 25% of the height of the peak between 1094 and 1098 $cm^{-1}$; and the height of the peak between about 1260 and 1267 $cm^{-1}$ being at least 10% of the height of the peak between 1094 and 1098 $cm^{-1}$.

Another highly preferred embodiment of the fibrous cellulosic product of the present invention will comprise nanoporous cellulose fiber exhibiting at least a first and a second peak in its Raman spectrum, said first peak falling into a band between: about 348 and 360 $cm^{-1}$, about 416 and 424 $cm^{-1}$, about 487 and 493 $cm^{-1}$, about 895 and 901 $cm^{-1}$, about 1094 and 1098 $cm^{-1}$, or about 1260 and 1267 $cm^{-1}$; said second peak falling into one of said bands other than the band into which said first peak falls; wherein the height of said first peak relative to the height of the peak between 1094 and 1098 $cm^{-1}$ is:

at least 34%—in the case in which said first peak falls into the band between about 348 and 360 $cm^{-1}$;

at least 20%—in the case in which said first peak falls into the band between about 416 and 424 $cm^{-1}$;

at least 25%—in the case in which said first peak falls into the band between about 487 and 493 $cm^{-1}$;

at least 25%—in the case in which said first peak falls into the band between about 895 and 901 $cm^{-1}$; or at least 10%—in the case in which said first peak falls into the band between about 1260 and 1267 $cm^{-1}$;

while the height of said second peak relative to the height of the peak between about 1094 and 1098 $cm^{-1}$ is:

at least 34%—in the case in which said second peak falls into the band between about 348 and 360 $cm^{-1}$;

at least 20%—in the case in which said second peak falls into the band between about 416 and 424 $cm^{-1}$;

at least 25%—in the case in which said second peak falls into the band between about 487 and 493 $cm^{-1}$;

at least 25%—in the case in which said second peak falls into the band between about 895 and 901 $cm^{-1}$; or at least 10%—in the case in which said second peak falls into the band between about 1260 and 1267 $cm^{-1}$.

Another advantageous fibrous cellulosic product of the present invention comprises nanoporous cellulose fiber exhibiting a multiplicity of peaks falling into defined bands in its Raman spectrum including at least one peak between falling between 1094 $cm^{-1}$ and 1098 $cm^{-1}$, the height of each said peak relative to the height of said peak between 1094 $cm^{-1}$ and 1098 $cm^{-1}$ exceeding the minimum relative peak height for that band as set forth in the following table:

| | Defined Band $cm^{-1}$ | | | | |
|---|---|---|---|---|---|
| | 348-360 | 416-423 | 487-493 | 895-901 | 1260-1267 |
| Minimum Relative Peak Height | 34% | 20% | 25% | 25% | 10% |

at least three peaks are present in the Raman spectrum, other than said one peak between falling 1094 $cm^{-1}$ and 1098 $cm^{-1}$; falling into one of said defined bands and exceeding the Minimum Relative Peak Height specified for that defined band; preferably at least four, more preferably at least 5, of the peaks in the Raman spectrum of said cellulosic tissue product both fall into one of said defined bands and exceed the minimum relative peak height for the band into which it falls.

Often preferred embodiments of the present invention will be identifiable by doublets in their Raman spectrum. Often such doublets will be found at the following locations:

between 350 $cm^{-1}$ and 385 $cm^{-1}$ in their Raman spectrum, or between 417 $cm^{-1}$ and 445 $cm^{-1}$ in their Raman spectrum.

Many preferred embodiments of the present invention will be identifiable by the presence of multiple doublets in their Raman spectrum as follows:

one centered between 350 $cm^{-1}$ and 385 $cm^{-1}$ and the other between 417 $cm^{-1}$ and 445 $cm^{-1}$; or one centered between 350 $cm^{-1}$ and 385 $cm^{-1}$ as well as another between 417 $cm^{-1}$ and 445 $cm^{-1}$.

In a particularly preferred fibrous cellulosic product comprising nanoporous cellulose fibers, the nanoporous cellulose fibers exhibit at least two broad overlapping maxima in their Raman spectrum between 285 and 500 $cm^{-1}$, the height of the two tallest of said maxima in said spectrum between 285 and 500 $cm^{-1}$ being between 35 and 55% of the height of the peak near 1098 $cm^{-1}$.

In a particularly preferred fibrous cellulosic product comprising nanoporous cellulose fibers, the nanoporous cellulose fibers exhibit at least three broad peaks in their Raman spectrum, one being a series of overlapping peaks between about 250 $cm^{-1}$ and about 400 $cm^{-1}$; another being a series of overlapping peaks between about 400 $cm^{-1}$ and about 600 $cm^{-1}$ and the third being a peak centered near 1098 $cm^{-1}$, at least two of said peaks being at least 10% broader at half height than the corresponding peak in the pulp from which it was prepared, preferably at least two of said peaks are at least 15%, more preferably at least 20%, broader at half height than the corresponding peak in the pulp from which it was prepared. Often it will be observed that at least one of said peaks is at least 100% broader at half height than the corresponding peak in the pulp from which it was prepared.

In almost all cases, the peak widths of the nano-porous cellulosic fibers of the present invention will be considerably broader than the corresponding peaks of the fibers from which they were prepared. In many cases, the Raman Spectrum of the nanoporous fibers exhibit two broad peaks, one being a series of overlapping peaks between about 250 $cm^{-1}$ to about 400 $cm^{-1}$; and the other being a series of overlapping peaks between about 400 $cm^{-1}$ to about 600 $cm^{-1}$, each said peak being at least 10%, preferably at least 15%, more preferably at least 20%, broader at half height than the corresponding peak in the cellulosic fiber from which it was prepared. Ideally at least one of said peaks is at least 100% broader at half height than the corresponding peak in the pulp from which it was prepared.

A particularly preferred fibrous cellulosic product comprises nanoporous cellulose fibers prepared from wood pulp fibers, the Raman Spectrum of said nanoporous fibers exhibiting three broad peaks, one being a series of overlapping peaks between about 250 $cm^{-1}$ and about 400 $cm^{-1}$ exhibiting a width at half height of at least about 30 $cm^{-1}$, preferably at least about 35 $cm^{-1}$; another being a series of overlapping peaks between about 400 $cm^{-1}$ and about 600 $cm^{-1}$ exhibiting a width at half height of at least about 55 $cm^{-1}$ and the third being a peak centered near 1098 $cm^{-1}$ exhibiting a width at half height of at least about 46 $cm^{-1}$, preferably at least about 55 $cm^{-1}$.

Another particularly preferred fibrous cellulosic product comprises nanoporous cellulose fibers prepared from wood pulp fibers exhibiting a series of overlapping peaks between about 250 $cm^{-1}$ and about 400 $cm^{-1}$ having a width at half height of at least about 40 $cm^{-1}$; along with a series of overlapping peaks between about 400 $cm^{-1}$ and about 600 $cm^{-1}$ exhibiting a width at half height of at least about 60 $cm^{-1}$, preferably at least about 70 $cm^{-1}$, and a peak centered near 1098 $cm^{-1}$ exhibits a width at half height of at least about 50 $cm^{-1}$.

Another particularly preferred fibrous cellulosic product comprises nanoporous cellulose fibers prepared from wood pulp fibers exhibiting a Raman Spectrum having two broad peaks, one being a series of overlapping peaks between about 250 $cm^{-1}$ and about 400 $cm^{-1}$ exhibiting a width at half height of at least about 30 $cm^{-1}$, preferably at least about 35 $cm^{-1}$, more preferably at least about 40 $cm^{-1}$, still more preferably at least about 45 $cm^{-1}$, most preferably at least about 50 $cm^{-1}$, and the other being a series of overlapping peaks between about 400 $cm^{-1}$ and about 600 $cm^{-1}$ exhibiting a width at half height of at least about 55 $cm^{-1}$, preferably at least about 60 $cm^{-1}$, more preferably at least about 75 $cm^{-1}$ and most preferably at least about 90 $cm^{-1}$.

Yet another particularly preferred fibrous cellulosic product comprises nanoporous cellulose fibers prepared from wood pulp fibers exhibiting a Raman Spectrum having peaks near 380, 496, 897, 1098, 1590 and 1609 $cm^{-1}$ with:

- a broad band of overlapping peaks in the neighborhood of 400 to 500 $cm^{-1}$ having a width measured at half height of at least about 150 $cm^{-1}$ and a maximum height of at least about 60% of the height of the peak near 1098 $cm^{-1}$;
- a band of overlapping peaks near 1600 $cm^{-1}$ with a width measured at half height of at least about 40 $cm^{-1}$ and a maximum height of at least about the height of the peak near 1098 $cm^{-1}$; and
- a band of peaks near 1100 $cm^{-1}$ having a width at half height of at least about 35 $cm^{-1}$.

Still another particularly preferred fibrous cellulosic product comprises nanoporous cellulose fibers prepared from wood pulp fibers exhibiting a Raman Spectrum having peaks near 380, 496, 897, 1098, 1590 and 1609 $cm^{-1}$, with:

- the height of the peak near 381 $cm^{-1}$ being at least 60% of the height of the peak near 1098 $cm^{-1}$,
- the height of the peak near 496 $cm^{-1}$ being at least about 50% of the height of the peak near 1098 $cm^{-1}$;
- the height of the peak near 903 $cm^{-1}$ being at least about 35% of the height of the peak near 1098 $cm^{-1}$;
- the height of the peak near 1590 $cm^{-1}$ being at least about 95% of the height of the peak near 1098 $cm^{-1}$; and
- the height of the peak near 1609 $cm^{-1}$ being at least about the height of the peak near 1098 $cm^{-1}$.

Many particularly preferred fibrous cellulosic products comprise nanoporous cellulose fibers prepared from wood pulp fibers exhibiting a Raman Spectrum having peaks near 458, 1098, and 1600 $cm^{-1}$, with:

- the height of the peak near 458 $cm^{-1}$ being at least 60% of the height of the peak near 1098 $cm^{-1}$, and
- the height of the peak near 1600 $cm^{-1}$ being at least about 110% of the height of the peak near 1098 $cm^{-1}$.

A particularly preferred fibrous cellulosic product comprises nanoporous cellulose fibers prepared from wood pulp fibers exhibiting a Raman Spectrum having peaks near 380, 496, 897, 1098, 1590 and 1609 $cm^{-1}$ and exhibiting:

- a broad band of overlapping peaks in the neighborhood of 400 to 500 $cm^{-1}$ with a width measured at half height of at least about 150 $cm^{-1}$ and a maximum height of at least about 65% of the height of the peak near 1098 $cm^{-1}$;
- a band of overlapping peaks near 1600 $cm^{-1}$ with a width measured at half height of at least about 40 $cm^{-1}$ and a maximum height of at least about 115% of the height of the peak near 1098 $cm^{-1}$; and
- a band of peaks near 1098 $cm^{-1}$ having a width at half height of at least about 40 $cm^{-1}$.

When examined at high magnification using ESEM (Environmental Scanning Electron Microscopy), the nanoporous fibers used in the present invention may be identified by large numbers of dark regions on the fibers having diameters between about 0.1 and 10 microns, preferably between about 0.5 and 7 microns and most preferably between about 1 and 5 microns. Preferably, these dark regions are present in a range of at least about $10^8$ regions per square meter, preferably between about $5\times10^8$ to about $10^{13}$ regions per square meter, more preferably between about $10^9$ to $10^{12}$, and most preferably between about $10^{10}$ to $10^{11}$ regions per square meter of fiber. It is not known at this time whether these are only darkened regions or if they are pits penetrating into the fiber. However, it is known that these darkened regions are not apparent on untreated or conventional fibers but may be readily observed on the treated fibers having the desirable properties described herein. Despite the use of the term "diameter", it can be observed that these regions are not perfect circles but are only roughly circular in shape.

BRIEF DESCRIPTION OF THE DRAWINGS

In FIG. 13, the NSWK had been refined for 15 minutes thus illustrating the improvements in bulk that might be expected in a towel formulation.

In FIG. 43D, several of the pits have been circled for identification.

In FIGS. 44C & D several of the pits have been circled for ready identification.

In FIGS. 45C & D several of the pits have been circled for ready identification. In FIG. 45F, the approximate sizes of several of the pits are indicated.

BACKGROUND

Figure 42A:
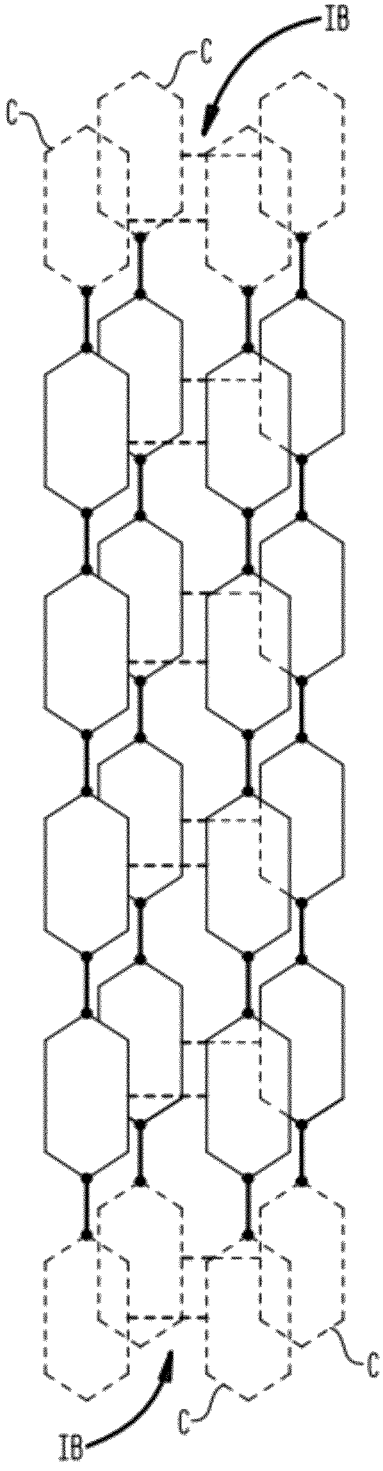
FIGS. 42A & 42B are schematic illustrations of the hypothesized difference between the structure of treated and untreated cellulose fiber wherein bonds between adjacent chains of cellulose molecules have been disrupted opening the structure.
Figure 42B:
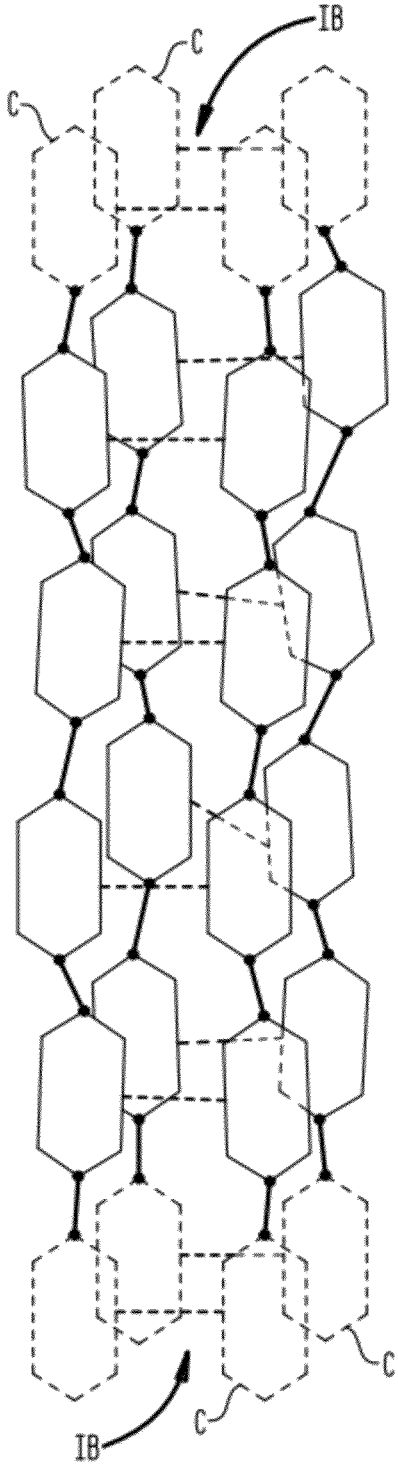
Figure 43A:
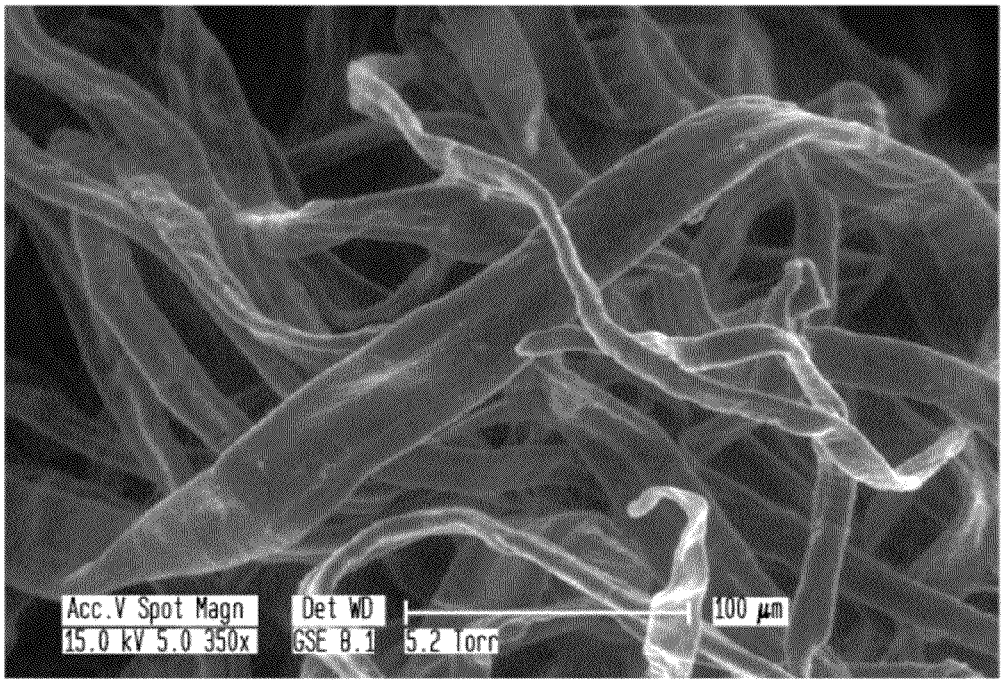
FIGS. 43A & 43B are native (as recieved) ESEM (Environmental Scanning Electron Microscope) images of before and after samples of Northern Softwood fibers treated in accordance with the Present Invention.
Figure 43B:
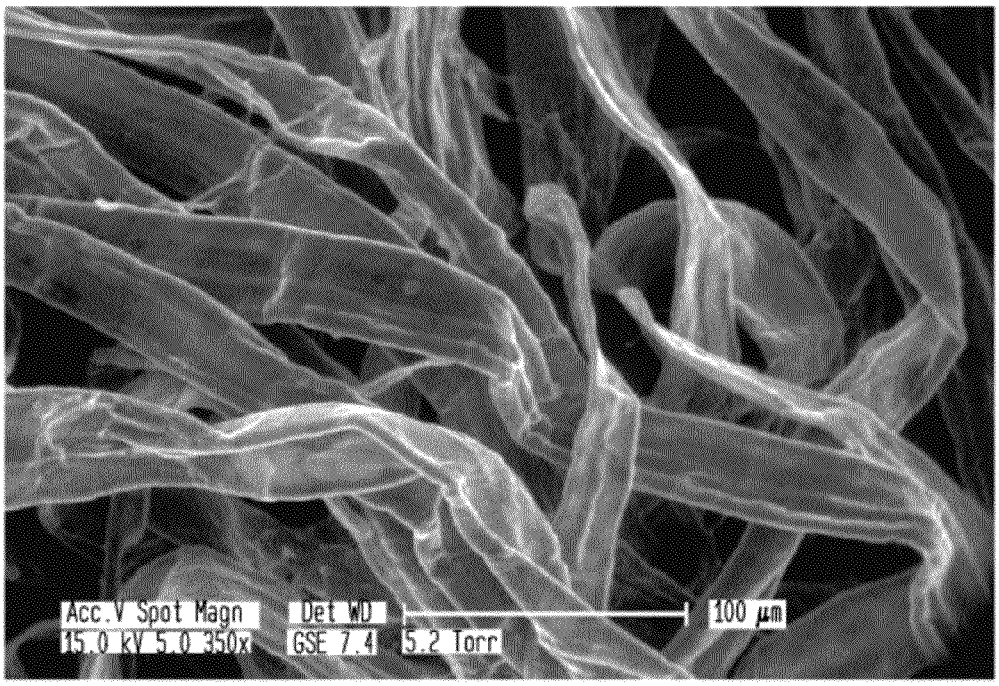
Figure 43C:
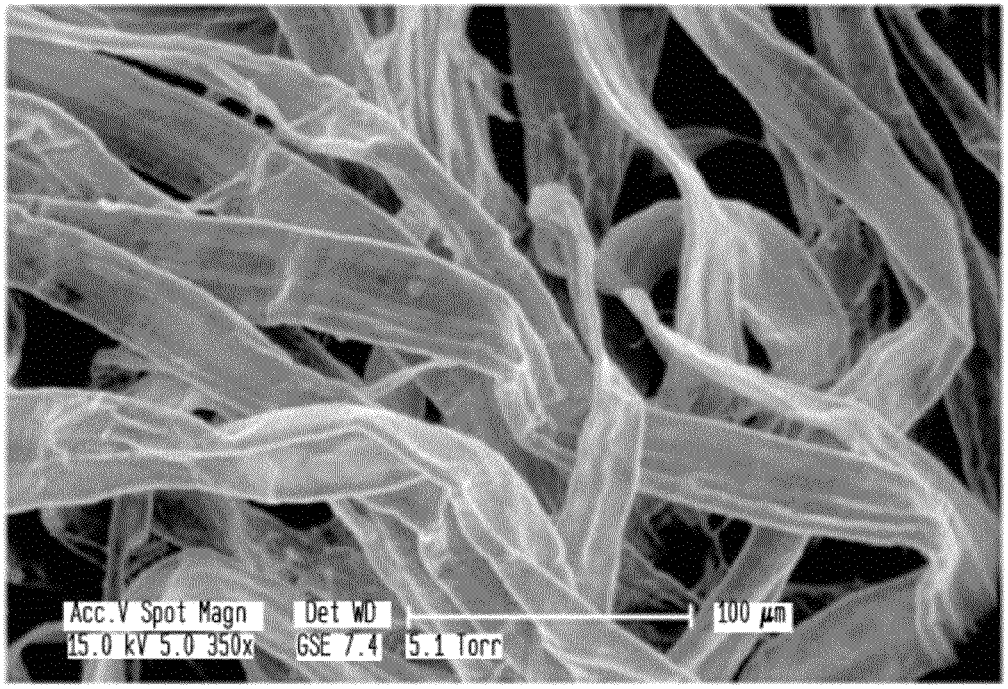
FIGS. 43C-E are versions of FIG. 43B in which the densities of the native image have been modified to make the "pits" observable in FIG. 43B stand out more clearly.
Figure 43D:
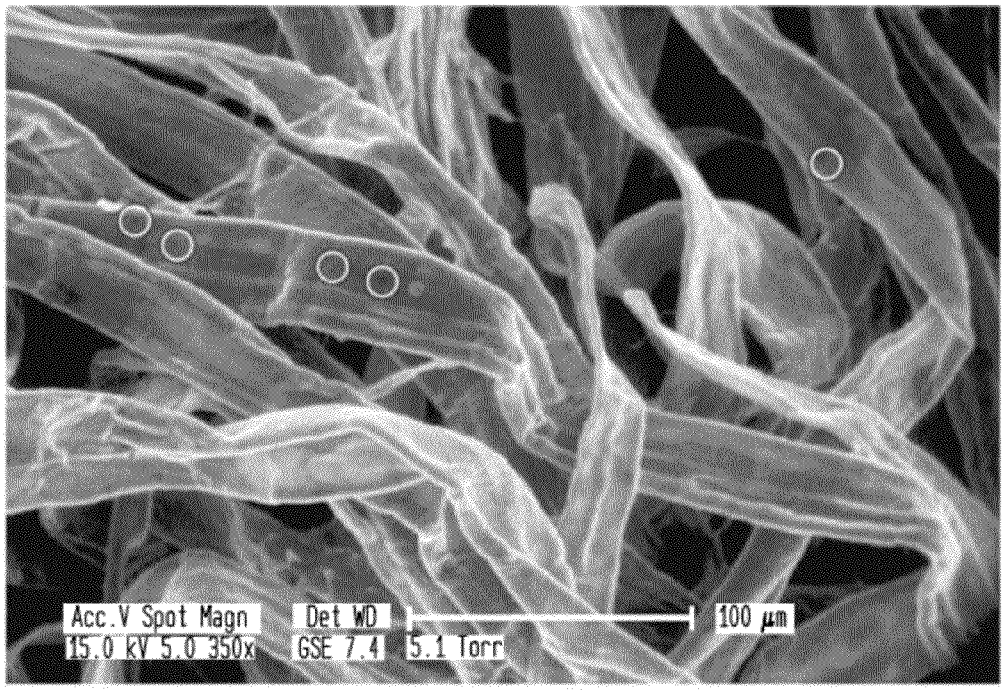
Figure 43E:
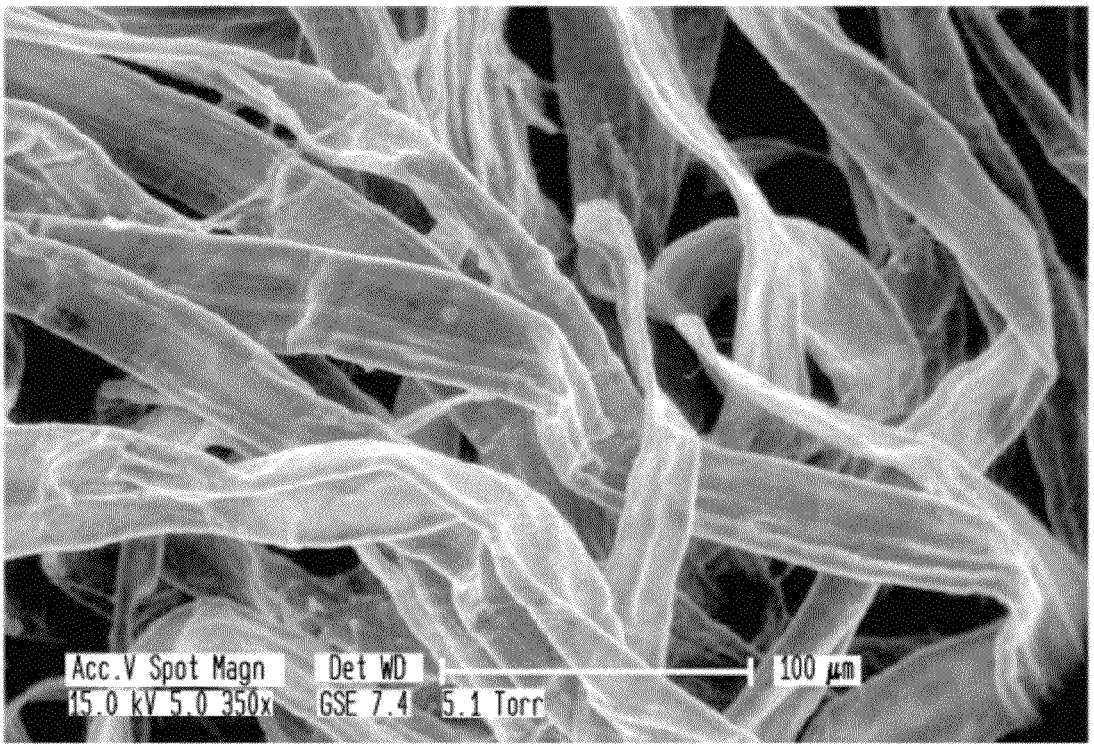
Figure 44A:
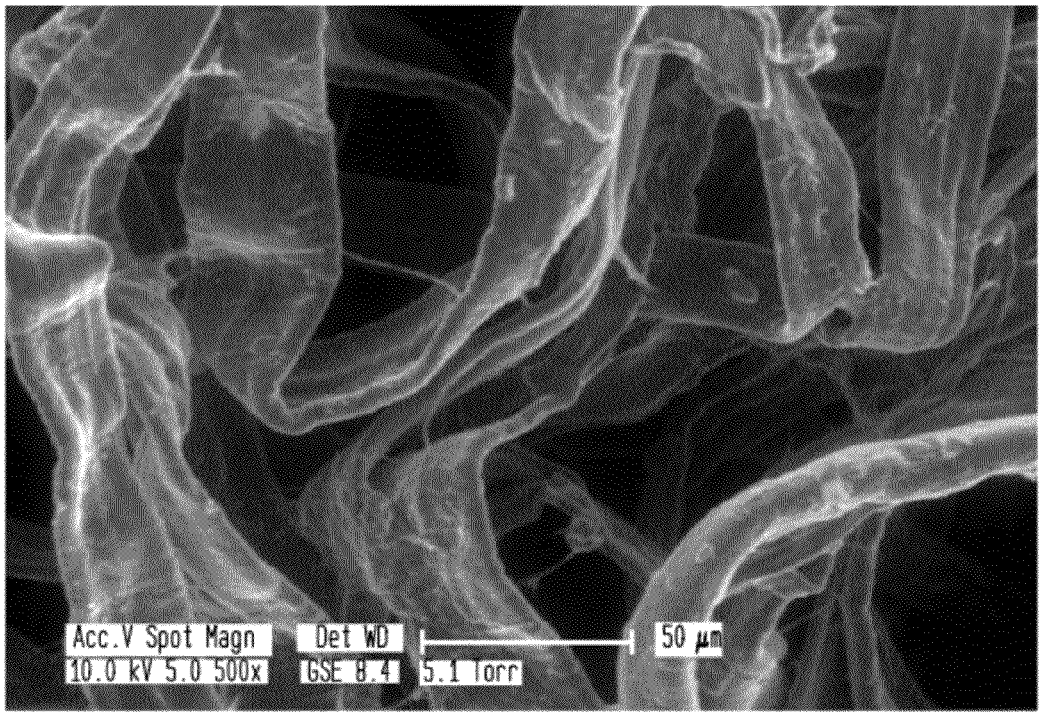
FIGS. 44A & 44B are native (as recieved) ESEM (Environmental Scanning Electron Microscope) images of another pair of before and after samples of Northern Softwood fibers treated in accordance with the Present Invention.
Figure 44B:
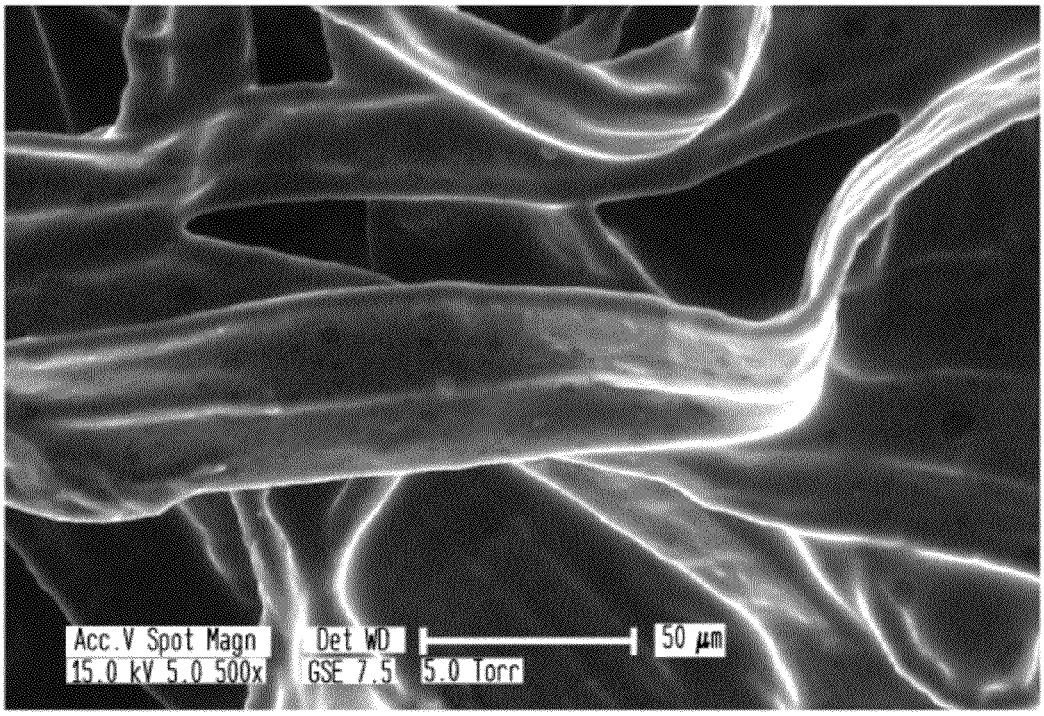
Figure 44C:
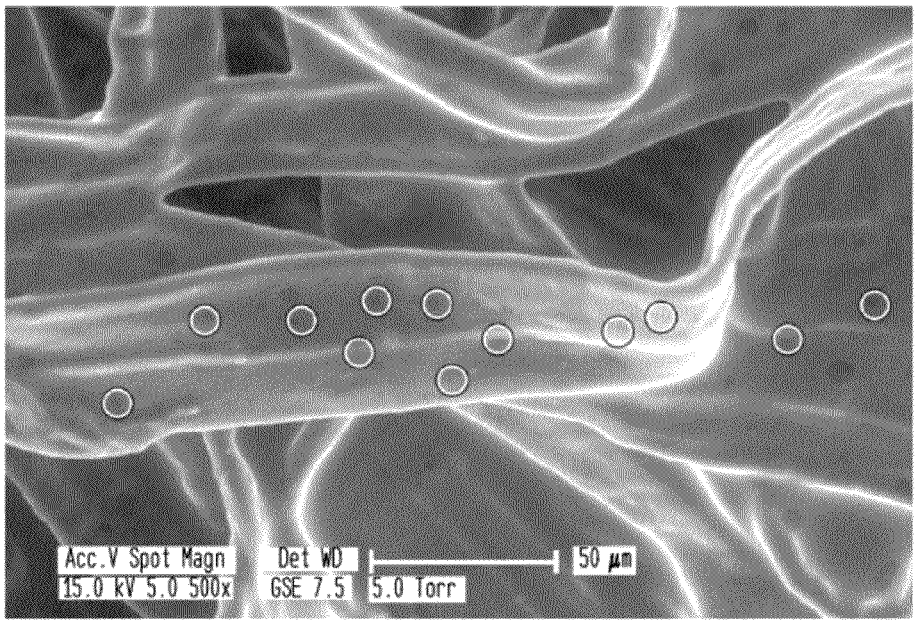
FIGS. 44C-E are versions of FIG. 44B in which the densities of the native image have been modified to make the "pits" observable in FIG. 44B stand out more clearly.
Figure 44D:
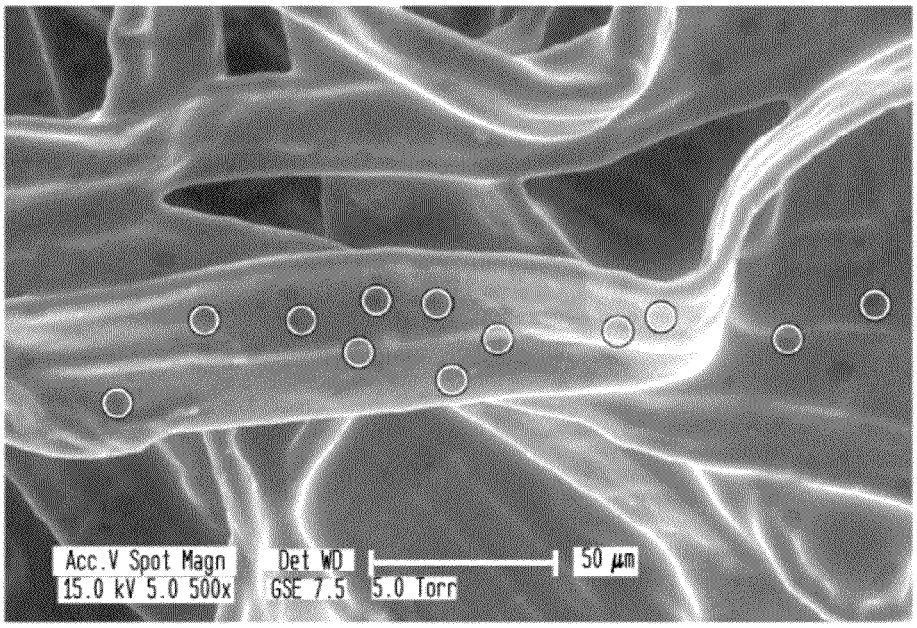
Figure 44E:
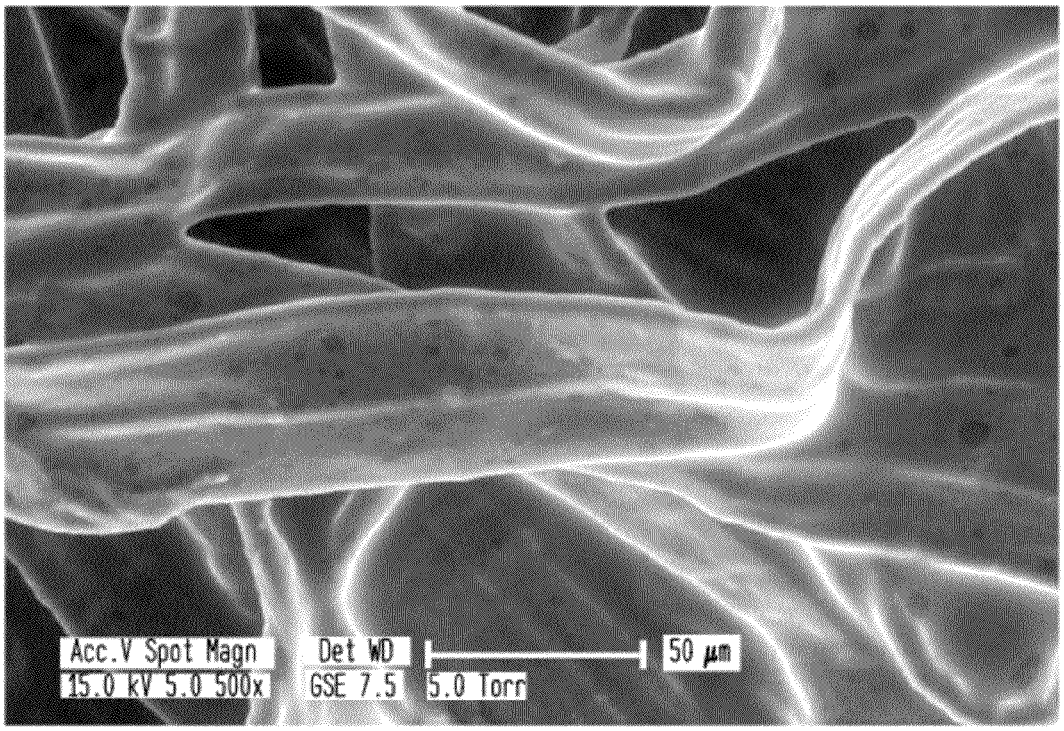
Figure 45A:
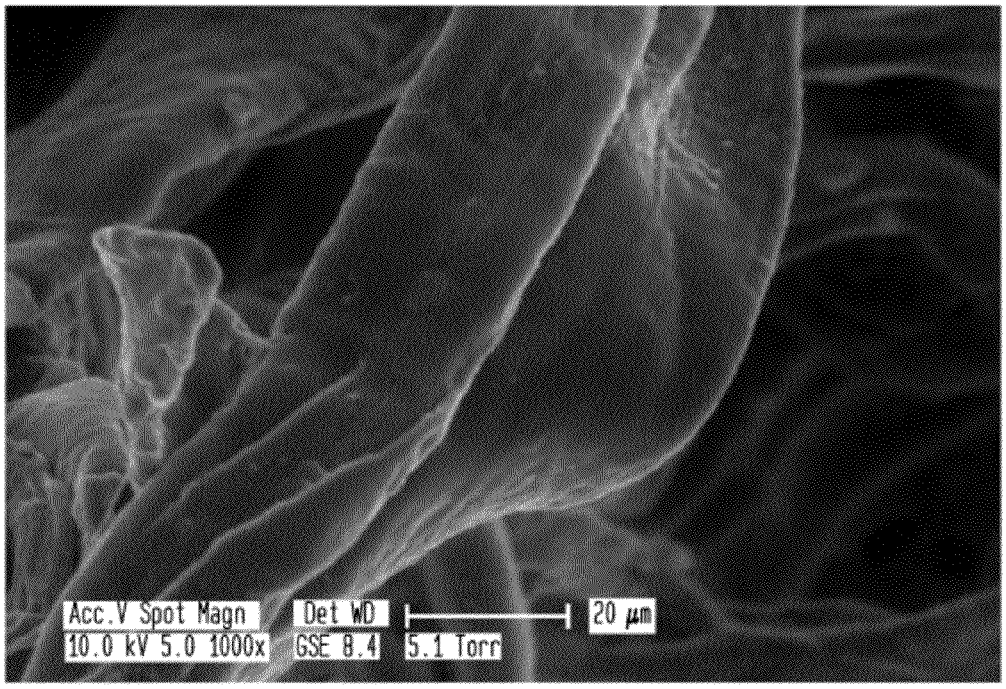
FIGS. 45A & 45B are native (as recieved) ESEM (Environmental Scanning Electron Microscope) images of still another pair of before and after samples of Northern Softwood fibers treated in accordance with the Present Invention.
Figure 45B:
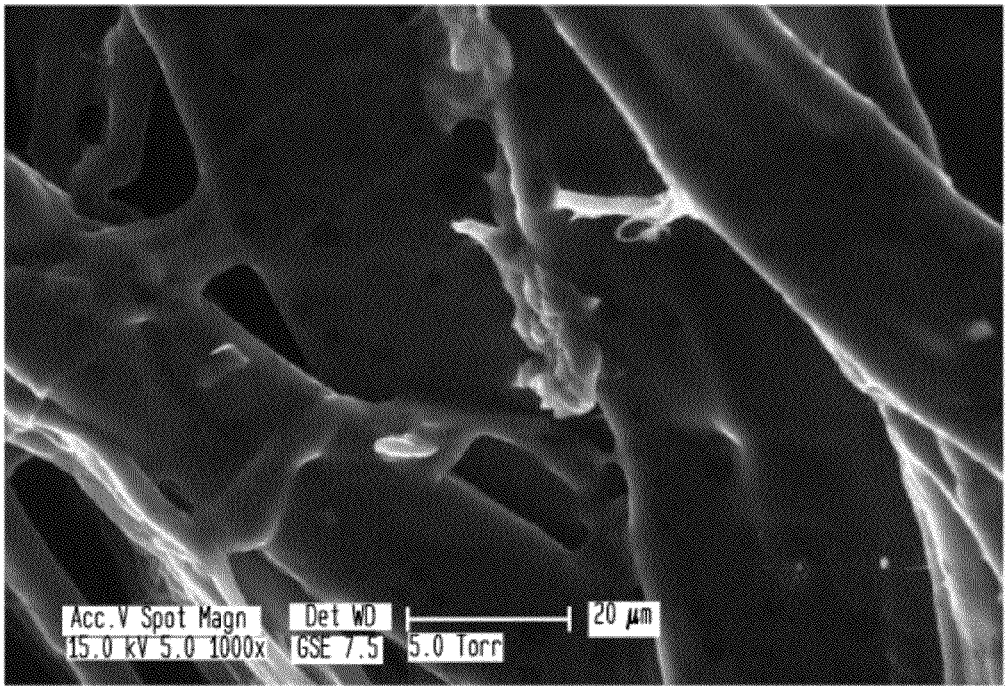
Figure 45C:
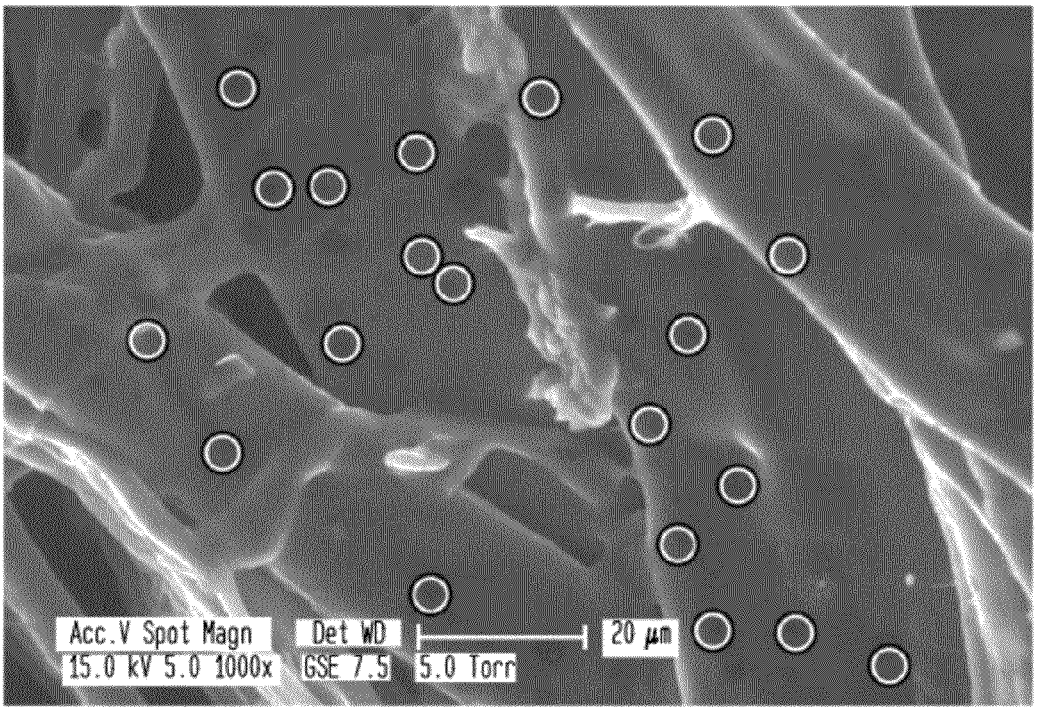
FIGS. 45C-G are versions of FIG. 45B in which the densities of the native image have been modified to make the "pits" observable in FIG. 45B stand out more clearly.
Figure 45D:
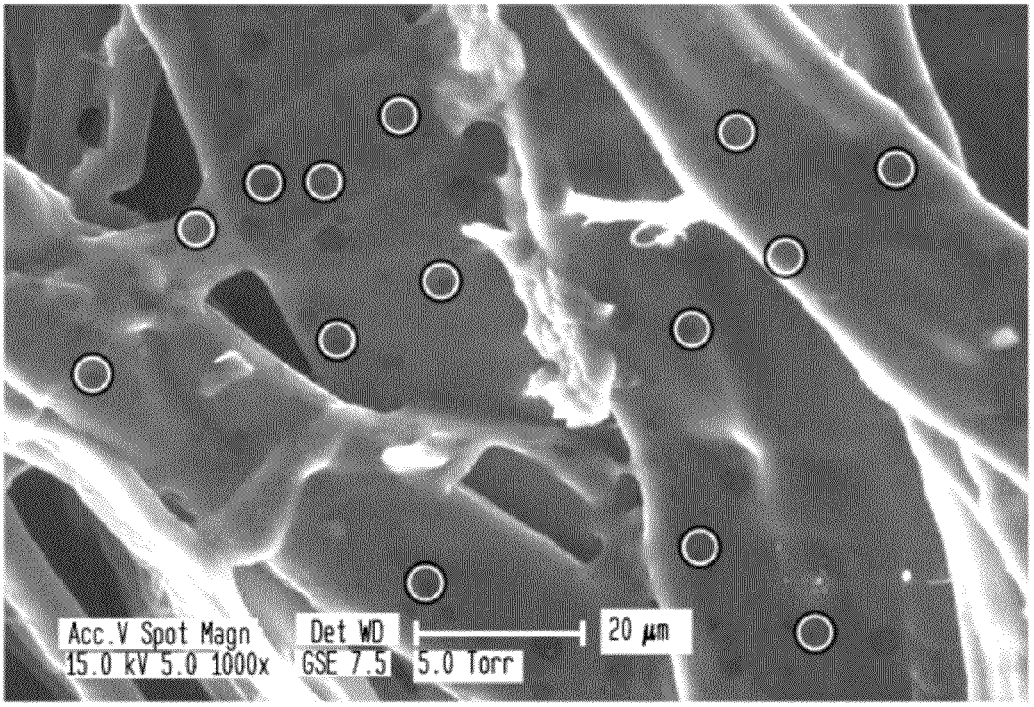
Figure 45E:
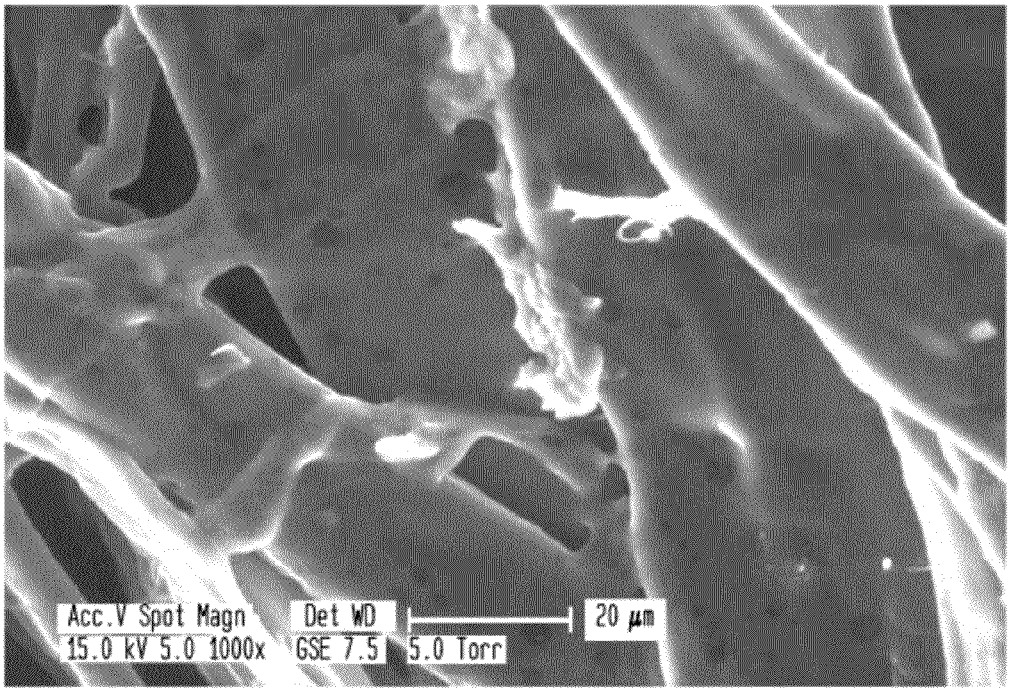
Figure 45F:
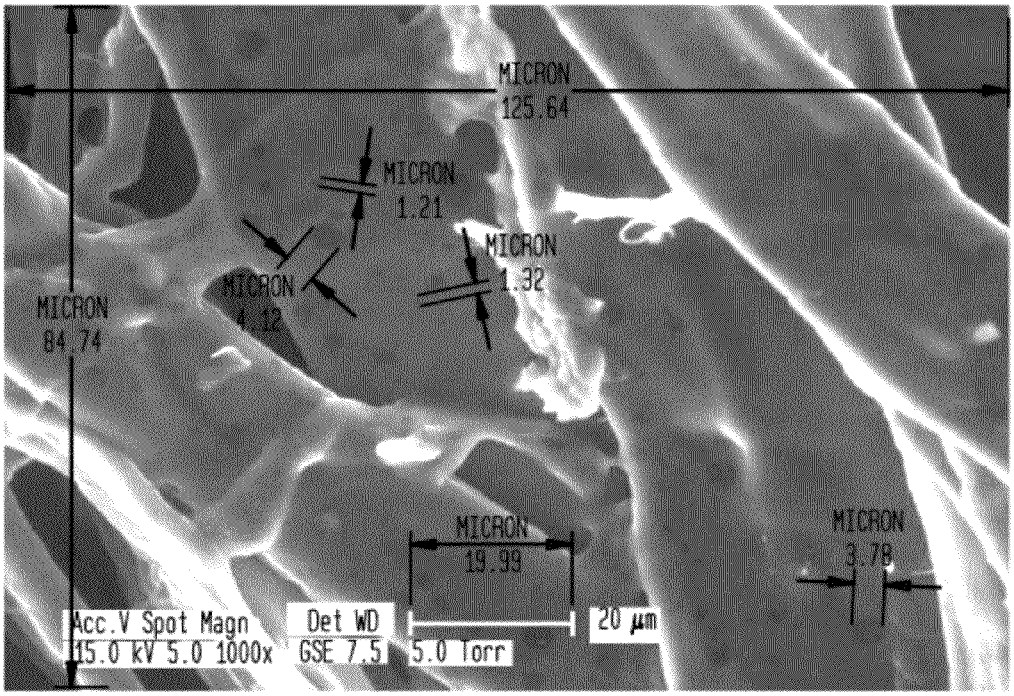
Figure 45G:
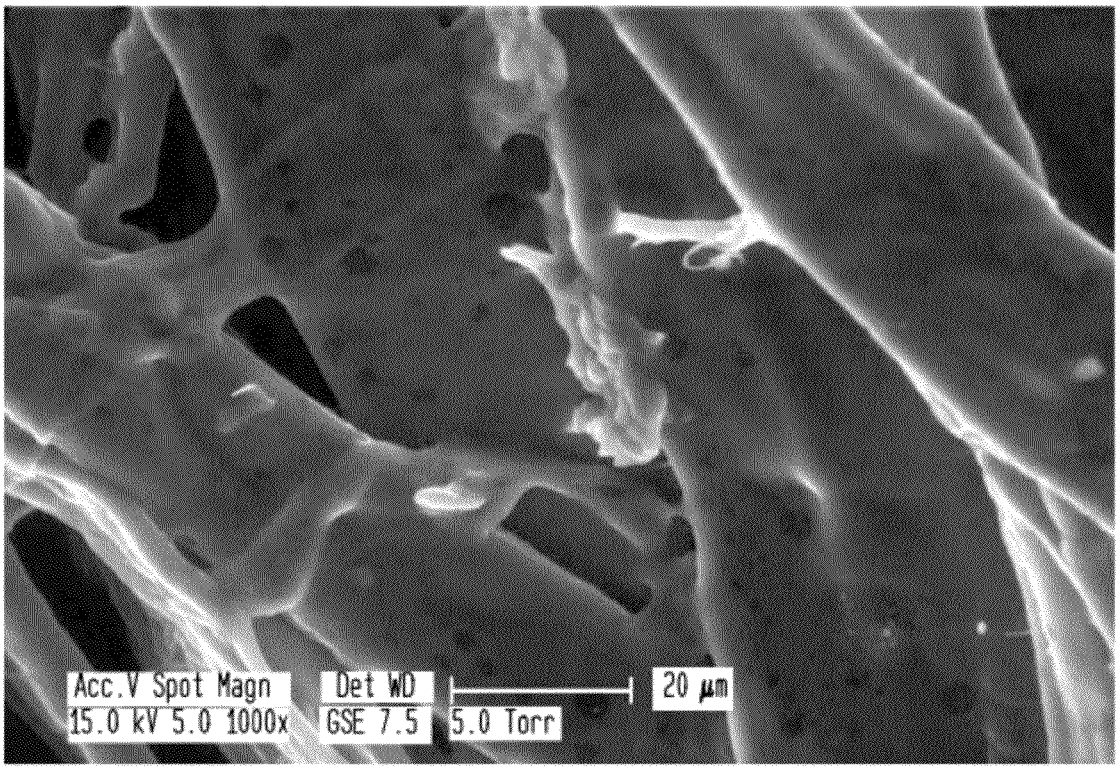
Figure 46A:
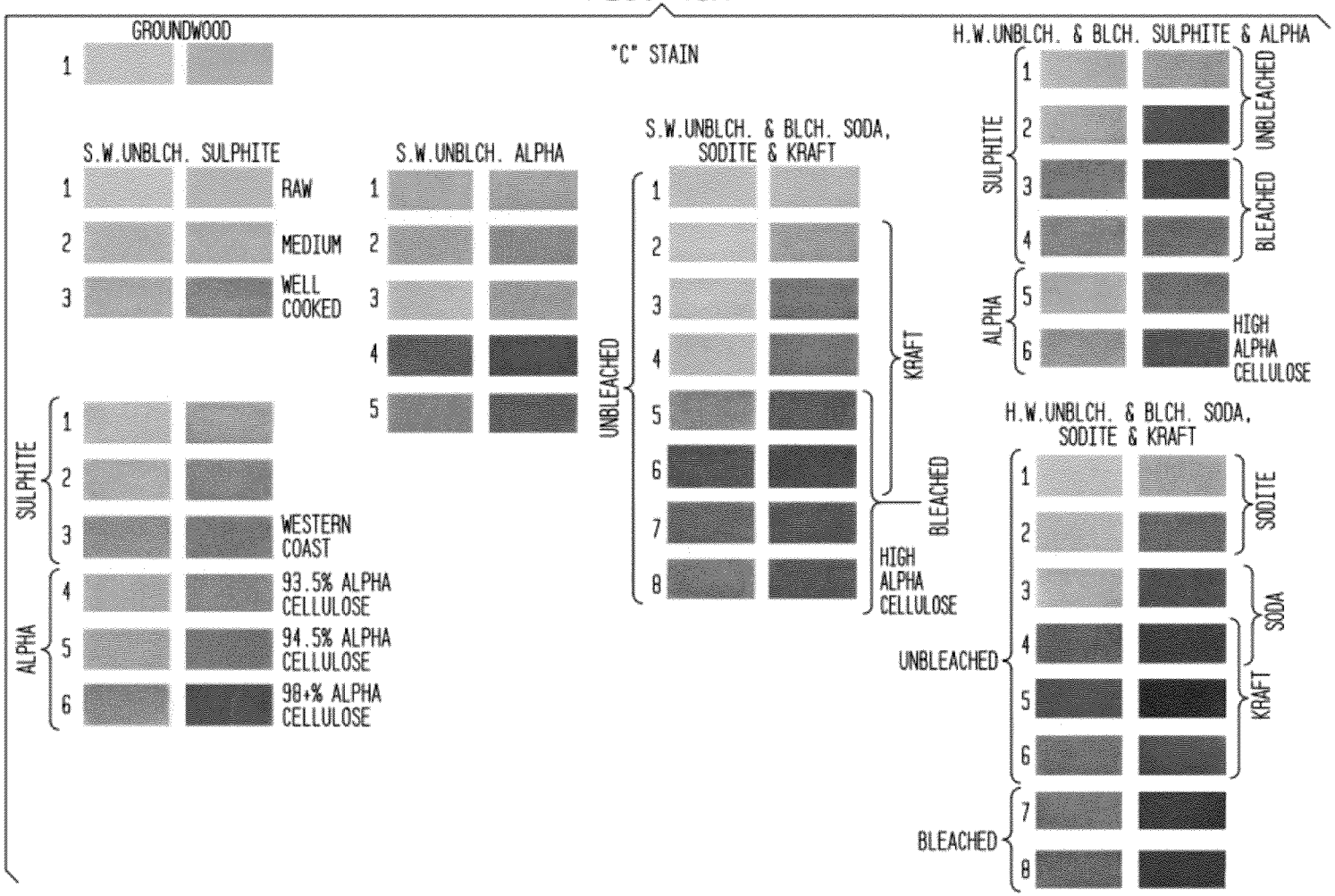
FIGS. 46A and 46B are, respectively, color reproduction of the upper and lower portions of Plate III "A Color Atlas for Fiber Identification" by John H. Graff, published by the Institute of Paper Chemistry, Appleton, Wis., 1940.
Figure 46B:
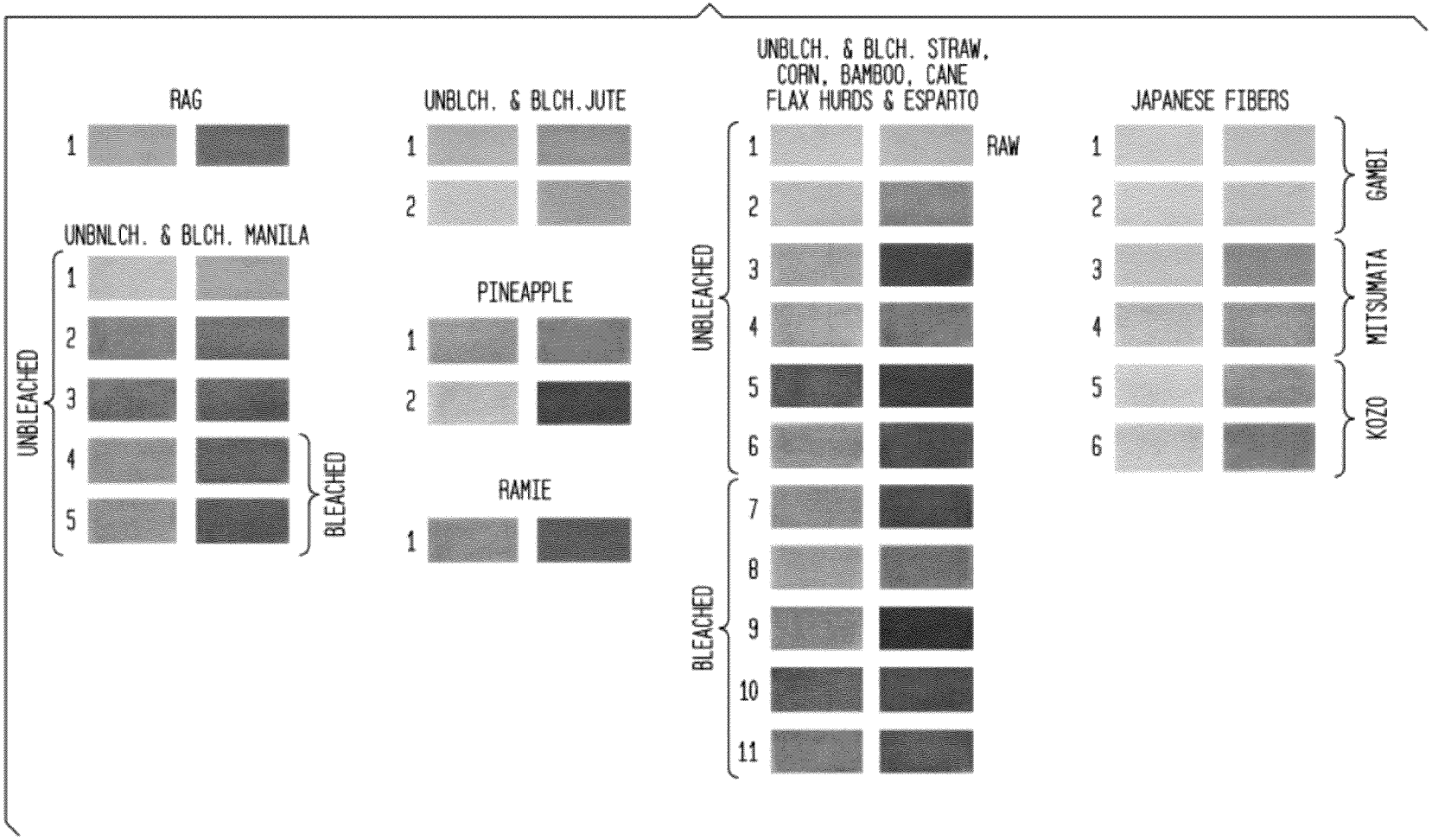
Figure 47:
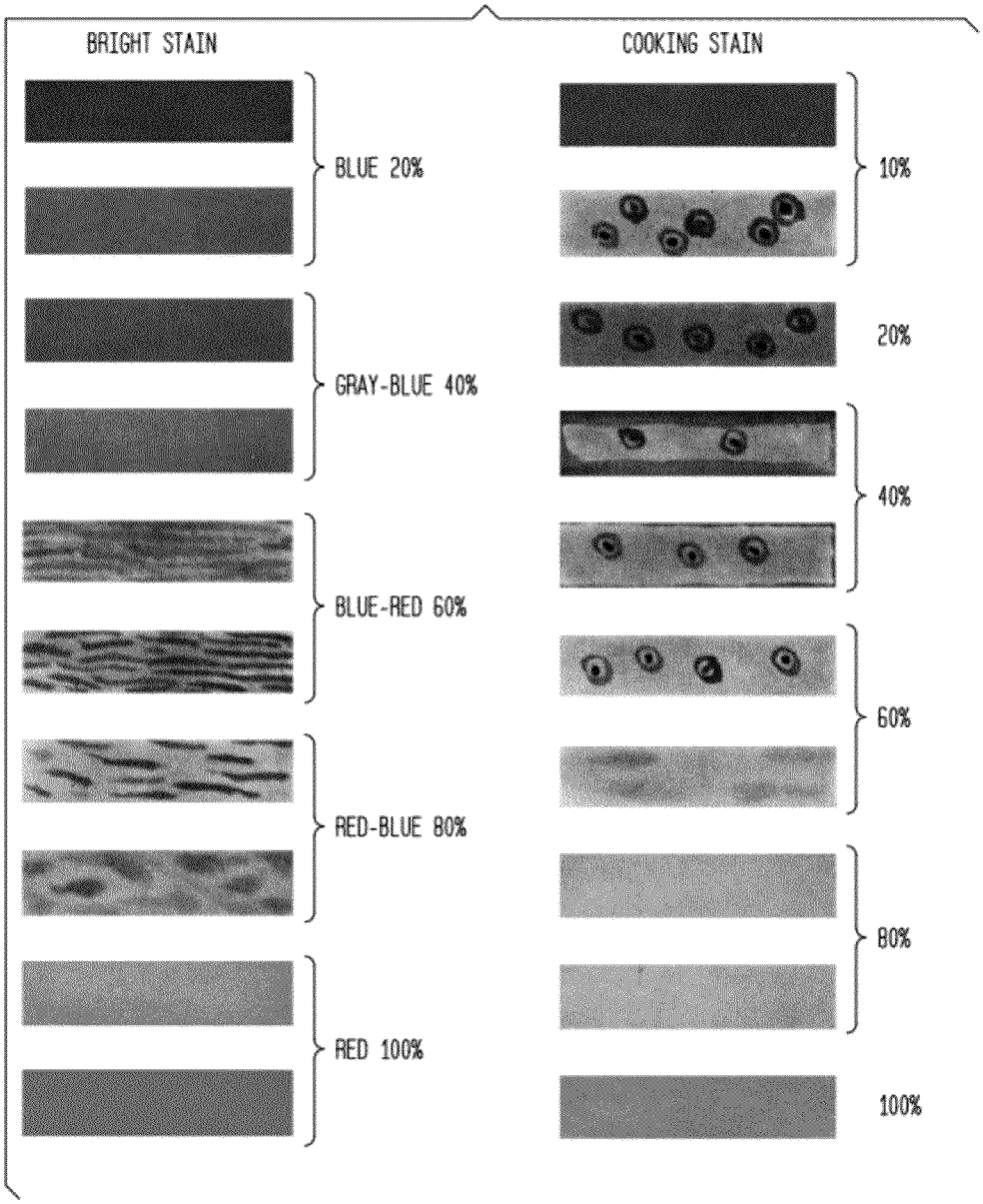
FIG. 47 is a color reproduction of the upper portion of Plate IV "A Color Atlas for Fiber Identification" by John H. Graff, published by the Institute of Paper Chemistry, Appleton, Wis., 1940.

The treatment process for preparation of LEC is described in WO2009124240, Highly Disordered Cellulose, (Atalla I), the entirety of which is incorporated herein by reference. In Atalla I, cellulose is treated with an alkali and an alcohol/water co-solvent system. Cellulose so treated shows dramatically less crystallinity than normal Kraft pulp, which makes this treatment ideal for subsequent enzymatic treatment to convert the cellulose to glucose. Cellulose chains in the fibers appear to be much more accessible after this treatment. Given this increased accessibility, it was hypothesized that this fiber might exhibit much less bonding and more bulk than an untreated fiber. However, fibers treated according to Atalla I still retain substantial crystallinity particularly along the length of the cellulosic chains, it appears that the primary effect of treatment according to Atalla I is to relax the bonds between adjacent chains thereby making the cellulose therein more accessible while greatly weakening the bonds between adjacent cellulosic chains. Fiber so treated is neither amorphous nor mercerized nor completely disordered but is, rather, nanoporous or laterally expanded. FIGS. 42A and 42B are schematic illustrations to help in visualizing the hypothesized differences in structure thought to result from the Atalla I treatment. In particular, FIG. 42A and FIG. 42B each illustrate 4 roughly parallel chains C of cellulose inside a single cellulose fiber. In FIG. 42A, representing untreated cellulose, chains C are largely parallel and are interconnected by inter-chain bonds IB, where the portions of bonds IB, hidden behind an adjacent cellulose chain C, are indicated in finer (0.25 point) broken lines. In FIG. 42B, representing treated cellulose, inter-chain bonds IB have been disrupted so that the spacing between them has grown and chains C are no longer as parallel. It is hypothesized that a disruption of this nature leads to the spreading and shifts observed in the X-Ray diffraction peaks of the treated fibers.

LEC fibers can be incorporated into tissue sheets made by any known process, including conventional wet pressing ("CWP"), through-air drying using a Yankee dryer ("TAD"), through air drying in which the sheet is dried on the fabric rather than being creped from a Yankee ("UCTAD") as well as methods in which a web at between about 30% and about 60% consistency is creped from a transfer cylinder using either a woven creping fabric or a perforate polymeric belt and thereafter dried in any convenient manner. Other new papermaking techniques recently developed for manufacture of tissue products can be used as well. The LEC fiber can be incorporated into the sheet homogeneously or layered into the exterior layers as would any other papermaking fiber. In cases where the anfractuous nature of the fibers conflicts with obtaining the desired degree of formation, well known foam forming techniques can be used to considerable advantage. Alternatively, well known associative thickener technology can be used as well to address formation issues thought to be attributable to the anfractuous nature of the fibers. Conventional papermaking chemicals can be used as well known by those having skill in the art. Conventional converting procedures can be used for transforming basesheets into finished salable products.

Conventional cellulosic fibers include any fiber typically used for papermaking having cellulose as a major constituent except those fibers described herein as laterally expanded cellulosic fibers or nanoporous cellulose. Conventional cellulosic fibers thus include cellulosic fibers prepared from virgin pulps or recycle (secondary) cellulosic fibers. Conventional cellulosic fibers include: nonwood fibers, such as cotton fibers, cotton linters, or cotton derivatives, abaca, kenaf, sabai grass, flax, esparto grass, straw, jute hemp, bagasse, milkweed floss fibers, corn stover, rice straw and pineapple leaf fibers; and wood fibers such as those obtained from deciduous and coniferous trees, including softwood fibers, such as northern and southern softwood kraft fibers; hardwood fibers, such as eucalyptus, maple, birch, aspen, or the like. Conventional cellulosic fibers can be liberated from their source material by any one of a number of chemical pulping processes familiar to one experienced in the art including sulfate, sulfite, polysulfide, soda pulping, etc and may be bleached, if desired, by chemical means including the use of chlorine, chlorine dioxide, oxygen, alkaline peroxide and so forth. Conventional fibers (whether derived from virgin pulp or recycle sources) also include mechanical or high yield fibers including groundwood, fibers prepared from thermomechanical pulp (TMP), chemithermomechanical pulp (CTMP) pressure/pressure thermomechanical pulp (PTMP), and alkaline peroxide mechanical pulp (APMP), neutral semi-chemical sulfite pulp (NSCS), high coarseness lignin-rich fibers, such as bleached chemical thermomechanical pulp (BCTMP), may, for example, be derived from a plant selected from the group consisting of: wood, cotton, flax, sisal, abaca, hemp, hesperaloe, jute, bamboo, bagasse, kudzu, corn, sorghum, gourd, agave, loofah and mixtures thereof. Conventional cellulosic fibers included wood pulp fibers which may be short (typical of hardwood fibers) or long (typical of softwood fibers). Nonlimiting examples of short fibers include fibers derived from a fiber source selected from the group consisting of Acacia, Eucalyptus, Maple, Oak, Aspen, Birch, Cottonwood, Alder, Ash, Chemy, Elm, Hickory, Poplar, Gum, Walnut, Locust, Sycamore, Beech, Catalpa, Sassafras, Gmelina, Albizia, Anthocephalus, and Magnolia. Nonlimiting examples of long fibers include fibers derived from Pine, Spruce, Fir, Tamarack, Hemlock, Cypress, and Cedar. Softwood fibers derived from the kraft process and originating from more-northern climates may be preferred. These are often referred to as northern softwood kraft (NSK) pulps. For the purposes of this application, mercerized fibers prepared from any of the preceding sources should also be considered conventional cellulosic fibers.

We found that addition of LEC fibers to otherwise conventional papermaking blends makes it possible for the papermaker to obtain great improvements in bulk, porosity, and opacity as well as novel tactile properties. It can be appreciated that not only do LEC fibers impart remarkable improvements in properties to standard TAPPI handsheets, they also respond more favorably to refining as demonstrated by TAPPI standard Valley Beater curves.

To demonstrate these points, a Northern Softwood Kraft (NSWK) was chosen as a premium fiber used in all types of papermaking, including tissue and towel production. The findings of this work can be summarized as follows:

Adding LEC fibers to a blend, whether refined or not, generally reduces tensile, burst, tear and stretch while increasing caliper, bulk, and porosity over the entire range of blending ratios.

Properties like caliper, bulk, burst, tensile, tear and stretch respond linearly with addition rates of unrefined blends while porosity is increased greatly.

LEC fibers respond to refining but consistently respond more slowly and end up with higher freeness and lower strengths than untreated NSWK fibers.

Proper mixing of the treated and untreated fibers is important to limit variability.

More specifically, results set forth herein indicate that:

The Atalla I treatment produces a highly desirable papermaking fiber where higher caliper, lower tensile and increased porosity is desired. This is especially true for tissue and towel grades, and is applicable to both wet pressed and through air dried base sheets.

In wet press processes, the relative insensitivity of these fibers to wet pressing can be exploited to increase the degree of wet pressing applied, thereby increasing productivity and/or reducing drying energy costs without necessarily unduly increasing the density of the sheets. This is especially applicable to grades where shoe presses are used.

The increased freeness realized with the addition of LEC fibers will allow for greater amounts of pressing at each section without the resultant crushing that often occurs with comparable conventional fibers. More efficient pressing in flat paper grades can result in substantial drying energy savings.

The very substantial increase in air flow through pressed sheets dramatically increases the potential to use typically very slow draining furnishes for through air dried products.

Treatment of recycled fibers with the Atalla I process offers the potential to dramatically improve the formation of typically slow draining furnishes by significantly raising their freeness, thereby improving productivity of the paper machine while reducing grade costs.

Currently, few high end premium consumer products are made with large amounts of recycled fiber. Applying the Atalla I treatment to form LEC fibers from recycle grades as described herein offers the potential to dramatically improve the tactile properties of recycled furnishes without the usual reduction in yield typically resulting from conventional processing of the raw waste paper to improve the quality thereof.

Non-woody fibers are often suggested for papermaking but tend to be slow draining furnishes that produce thin, noisy, sheets. Subjecting these fibers to the Atalla I process can significantly improve their properties for papermaking Rather than densifying the sheets, these treated non-woody fibers can open up the sheet and reduce the bonding potential.

The Atalla I process can be used to reduce the environmental impact of many agricultural operations. For example in many cases, rice straw is burned or buried to prepare the ground for the next crop. Instead, this straw could be used to produce a highly desirable papermaking fiber along with useful amounts of glucose if so desired. Similarly, fibers which are currently viewed as having very little value, such as those derived from corn stover, switchgrass, miscanthus, and lawn and tree maintenance byproducts can be utilized to produce glucose, papermaking fiber, glucose with papermaking fiber as a by-product or papermaking fiber with glucose as a by-product.

Since the Atalla I process apparently decreases the interchain bonding between the cellulosic chains in LEC fibers, it appears that, when LEC fibers are incorporated into blends of conventional papermaking fibers, these treated fibers create a debonding and bulk building effect on otherwise standard fiber blends, improving drying efficiency both through better air flow through the sheet as well as by starting with a dryer sheet, resulting in increased removal of water through mechanical pressing and in softer, thicker sheets.

Example 1

Over a period of 5-15 minutes, NSWK pulp was treated with a 75/25 ratio of ethanol/water into which was dissolved 7% NaOH over a period of 5-15 minutes. Following this soaking, the fibers were washed two times with a 75/25 mix of ethanol and water to substantially remove all of the NaOH. The fibers were then washed with water to remove the remaining ethanol and dried. These dried fibers were then re-slurried and used to produce handsheets in the desired fiber blend ratios. A more detailed description of this Atalla I process can be found in the WO2009124240 patent application, incorporated herein by reference.

Accordingly, a series of trials was conducted to more fully and precisely define the properties of LEC fibers. A great deal of care was taken to insure that fiber mixing was as uniform as possible. The blends of fibers were diluted to a set consistency and allowed to soak overnight. These blends were then mixed for about 3 minutes. Samples for the beater curves were then taken and the remaining fiber put through the British Disintegrator. Freeness was measured and, based upon the determined consistency, the volume of the solution needed for each handsheet was determined.

Effects of blending and refining NSWK fiber with LEC fiber derived from NSWK fiber were investigated using TAPPI Valley Beater runs and TAPPI standard T 205 sp-95 handsheet preparation and testing. Beating times of 0, 5, 15, 30, 45 and 60 minutes were studied over blends of 0, 25, 50, 75 and 100 percent LEC fiber blended with untreated NSWK. Handsheets were pressed and dried in rings and tested in a controlled environment testing laboratory. Unrefined blends of 5, 10, 15 and 20 percent LEC fibers were investigated to determine the sensitivity at lower addition rates. The handsheets prepared were tested according to TAPPI Standard T 220 sp-96.

A series of Valley Beater curves was run on 100% NSWK and 100% NSWK LEC fibers as well as on blends of 25/75, 50/50, and 75/25 blends of NSWK/NSWK LEC fibers, at beating times of 0, 5, 15, 30, 45, and 60 minutes. In addition to the handsheets made for these beater runs, handsheets were also made from unrefined blends of these fibers at 5, 10, 15 and 20 percent LEC treated fibers.

Figure 1:
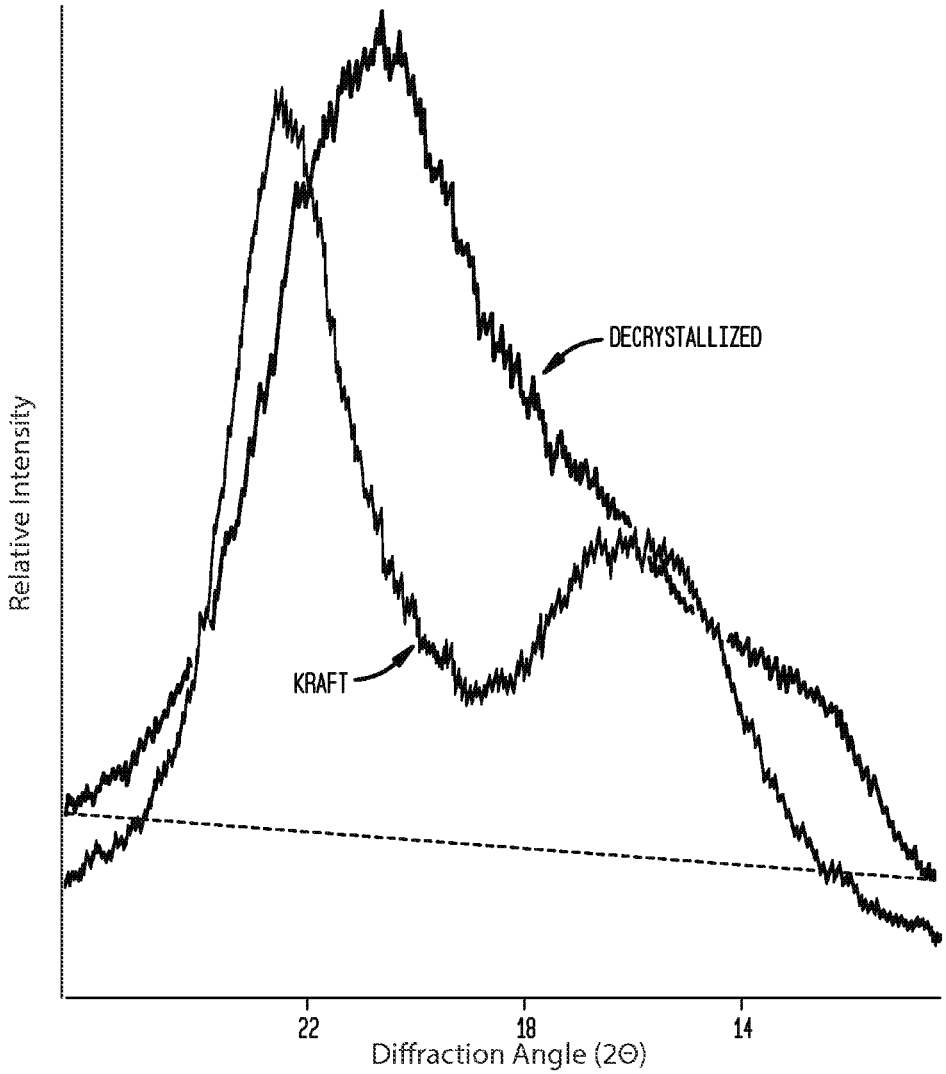
FIG. 1 is an X-Ray diffractogram comparing the X-Ray diffraction patterns of a bleached kraft pulp and fibers of laterally expanded cellulose.
Figure 3:
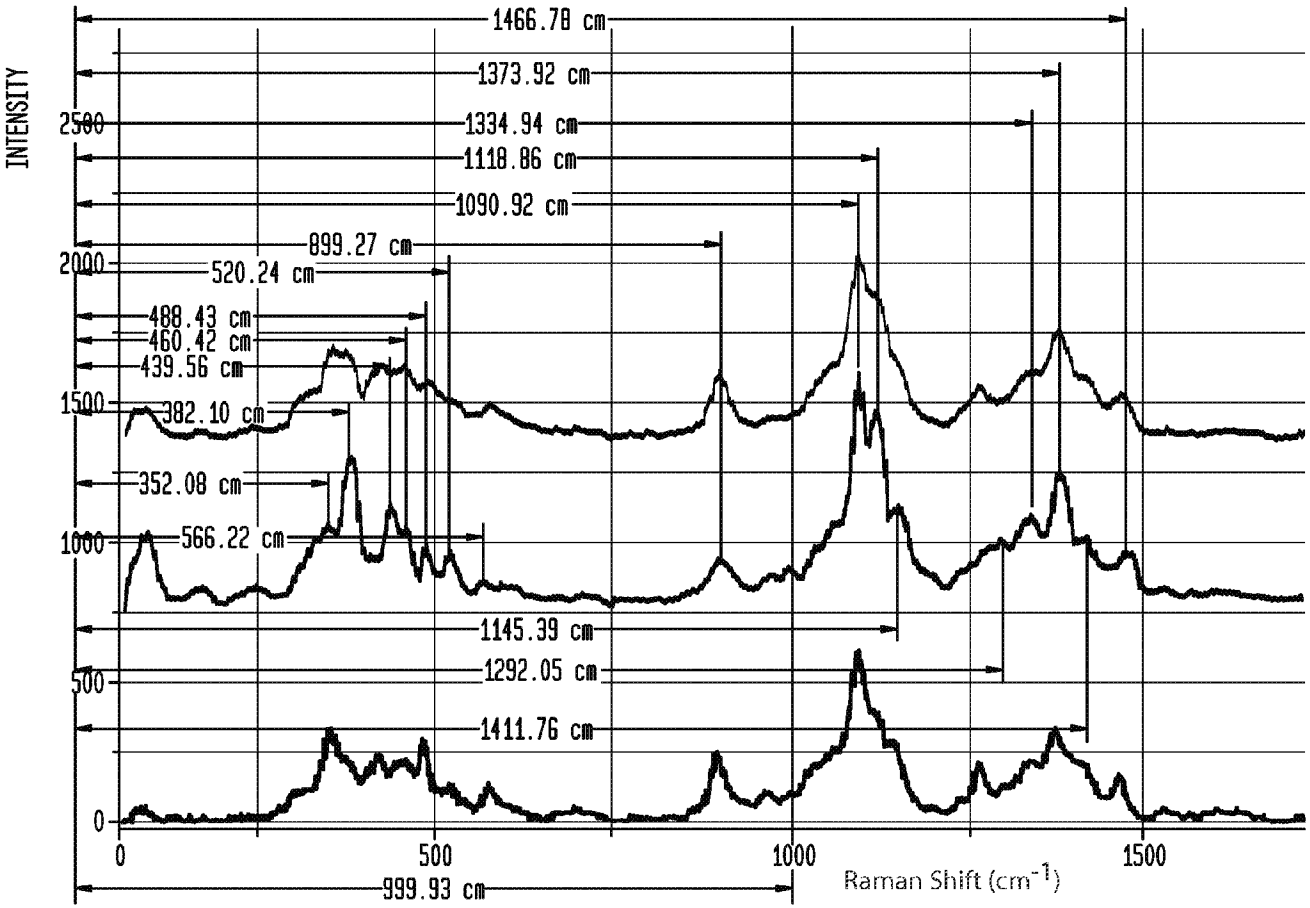
FIG. 3 compares the Raman spectra of cellulose I, cellulose II and laterally expanded cellulose of the present invention with the wave numbers corresponding to the most significant peaks being indicated for cellulose I.
Figure 4:
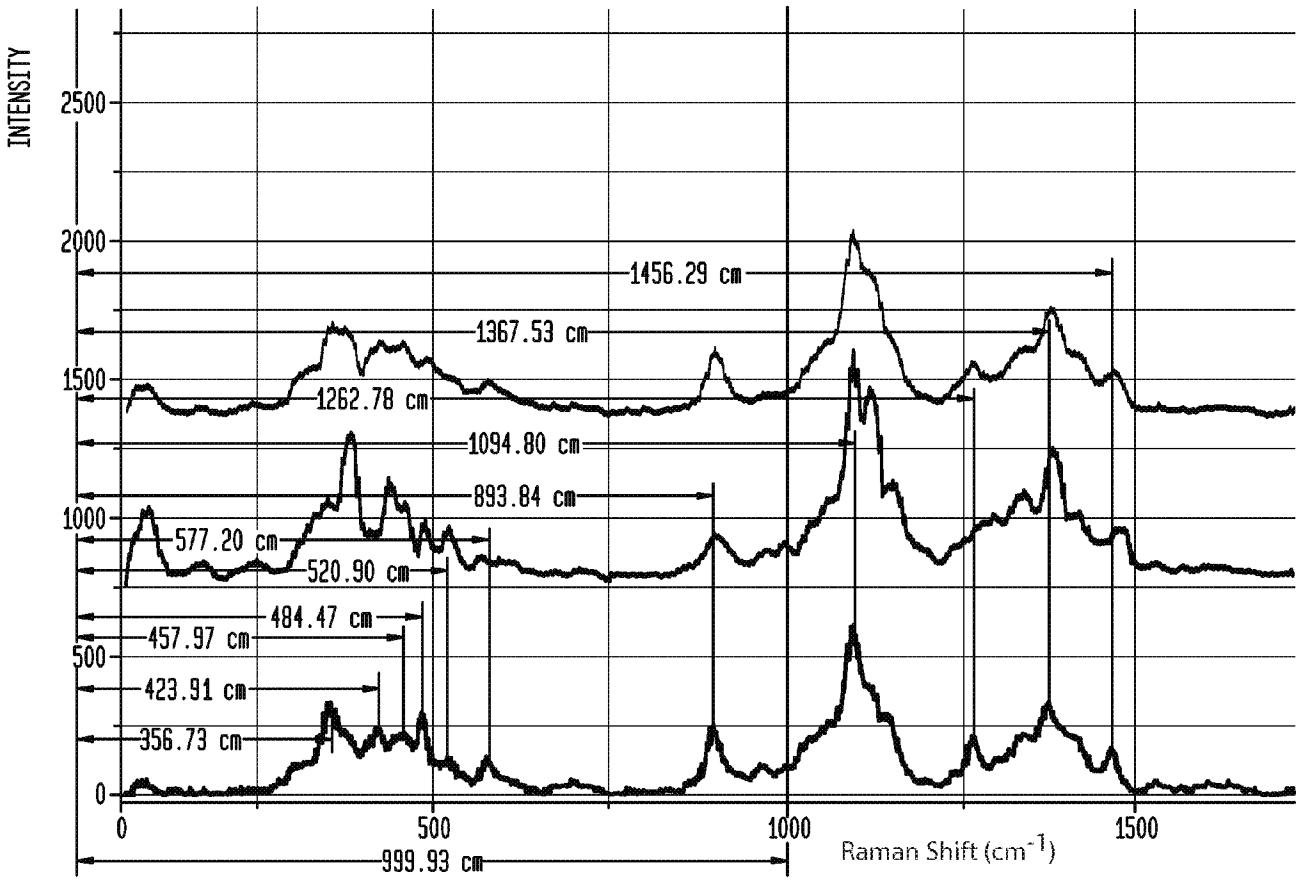
FIG. 4 compares the Raman spectra of cellulose I, cellulose II and laterally expanded cellulose of the present invention with the wave numbers corresponding to the most significant peaks being indicated for cellulose II.

An X-ray diffractogram was obtained of treated LEC fibers as set forth in FIG. 1. In this application, where "2Θ" appears after the degree "°" sign, it indicates that the angle denoted is that conventionally used in connection with X-Ray diffraction studies in which a so called 2Θ goniometer has been used to position the detector, sample and beam relative to each other and the data has been recorded accordingly. Additionally, Raman spectra were obtained comparing LEC fibers to Cellulose I and Cellulose II fibers as set forth in FIGS. 2, 3 and 4 using a Horiba Jobin-Yvon XploRA equipped with 785 nm and 532 nm lasers using an Andor DU-420 CCD detector 1200 grating (the spectrometer has 600, 1200, 1800 and 2400 gratings), using the 785 nm laser through the 10× objective. Further details of the machine's attributes can be found at the horiba.com web site under xplora-tm-124/.

In passing, it should be mentioned that on the Raman spectra presented herein as well as those in "Atalla II", U.S.

Provisional Application No. 61/382,604, filed Sep. 14, 2010 and entitled "NANOPOROUS CELLULOSE", which provides priority to U.S. application Ser. No. 13/822,190 published as U.S. Application Publication No. 2013/0172544, the far left hand line does not represent 0 Raman shift as the intensity of the spectrum at 0 is far too intense to be easily and meaningfully represented graphically with the remainder of the spectrum. The index markings on the spectra should accordingly be used in connection with the derivable scale to determine the locations and widths of the various peaks. Further, the Raman spectra presented herein were baseline corrected using known techniques often at least partially integrated into the software for the Spectrometers requiring the analyst to indicate baseline regions on the spectra.

Figure 5:
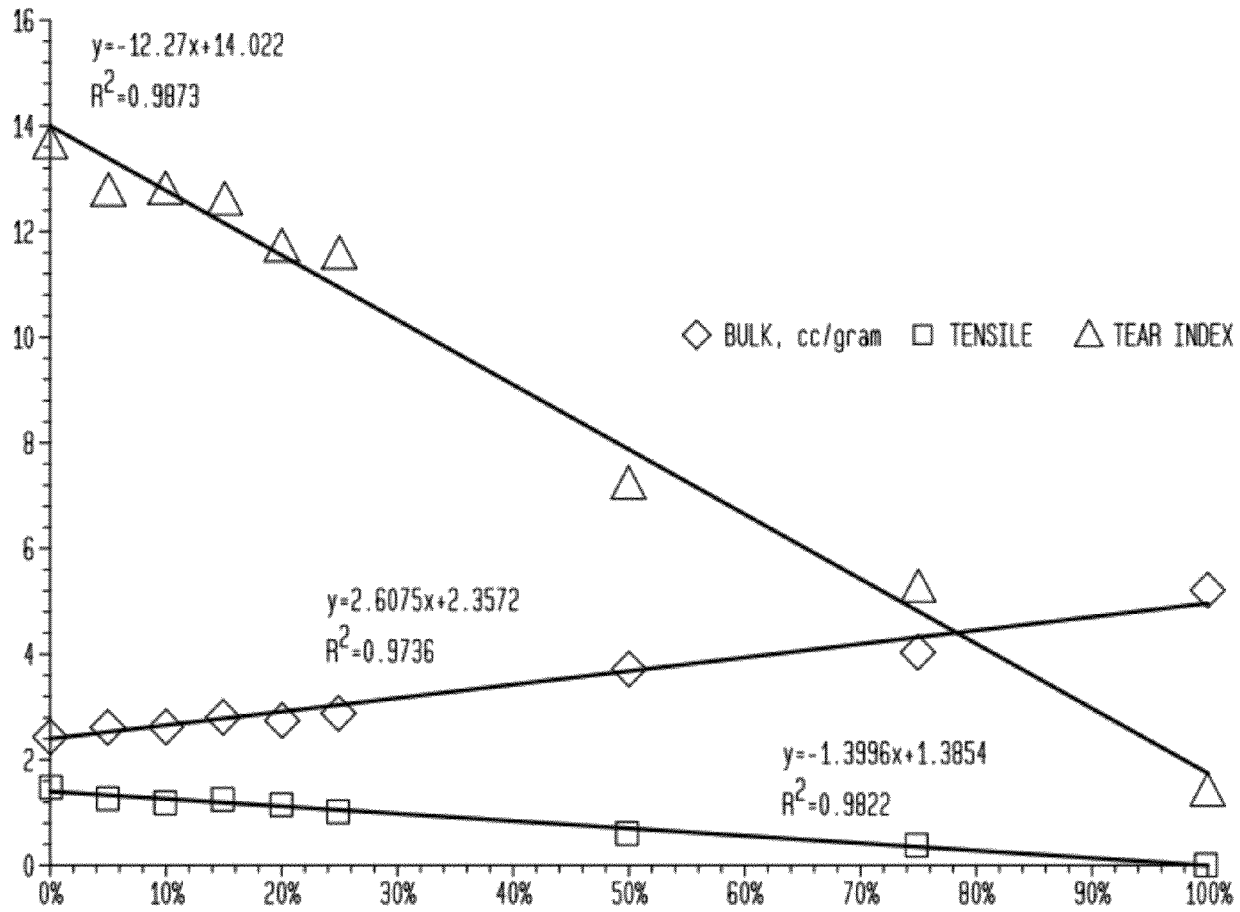
FIG. 5 illustrates the beneficial effects of addition of varying amounts of laterally expanded cellulose fibers to the properties of pressed handsheets.

FIG. 5 presents the effects of adding LEC fiber to handsheets made with unrefined furnishes including varying percentages of that LEC fiber.

Figure 6:
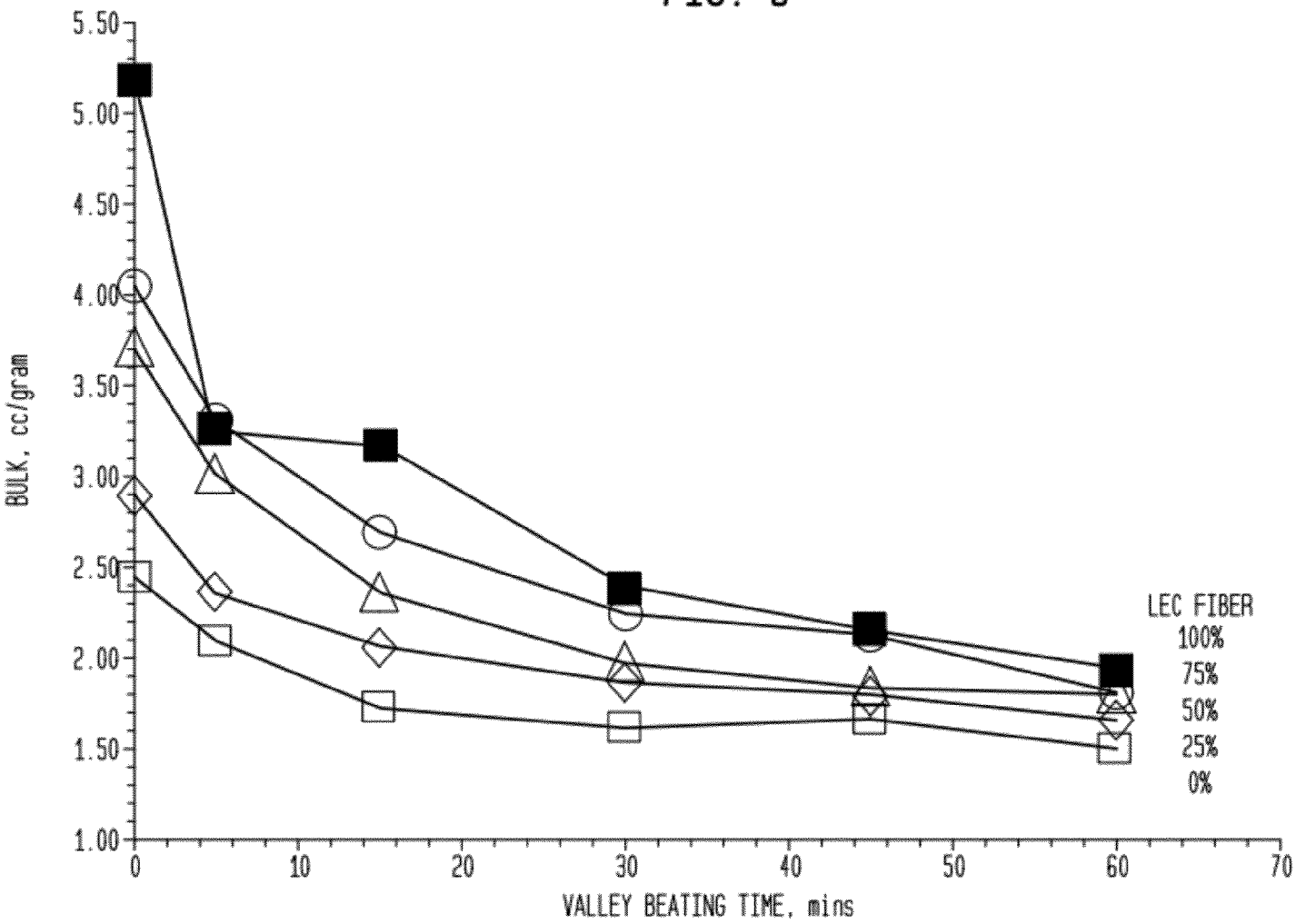
FIG. 6 illustrates the dramatic increases in bulk resulting from addition of varying amounts of laterally expanded cellulose fibers to pressed handsheets.

FIG. 6 illustrates the dramatic improvement in bulk attainable by incorporating LEC fiber into furnishes which are subsequently refined before being made into handsheets.

Figure 7:
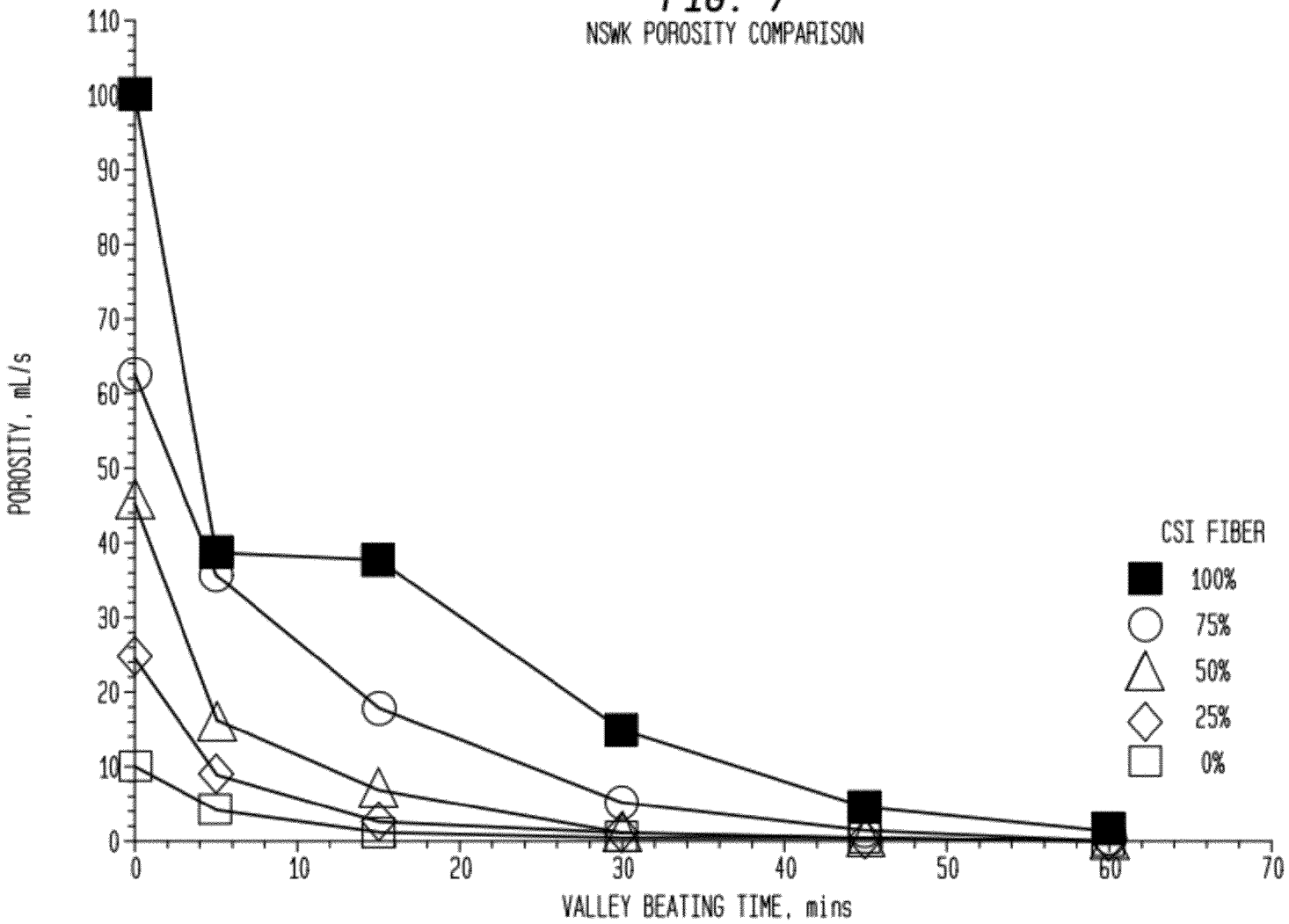
FIG. 7 illustrates variation in porosity of pressed handsheets comprising varying amounts of laterally expanded cellulose as a function of beating applied to the fibers in the furnish.

FIG. 7 illustrates the dramatic improvement in porosity attainable by incorporating LEC fiber into furnishes which are subsequently refined before being made into handsheets.

Figure 8:
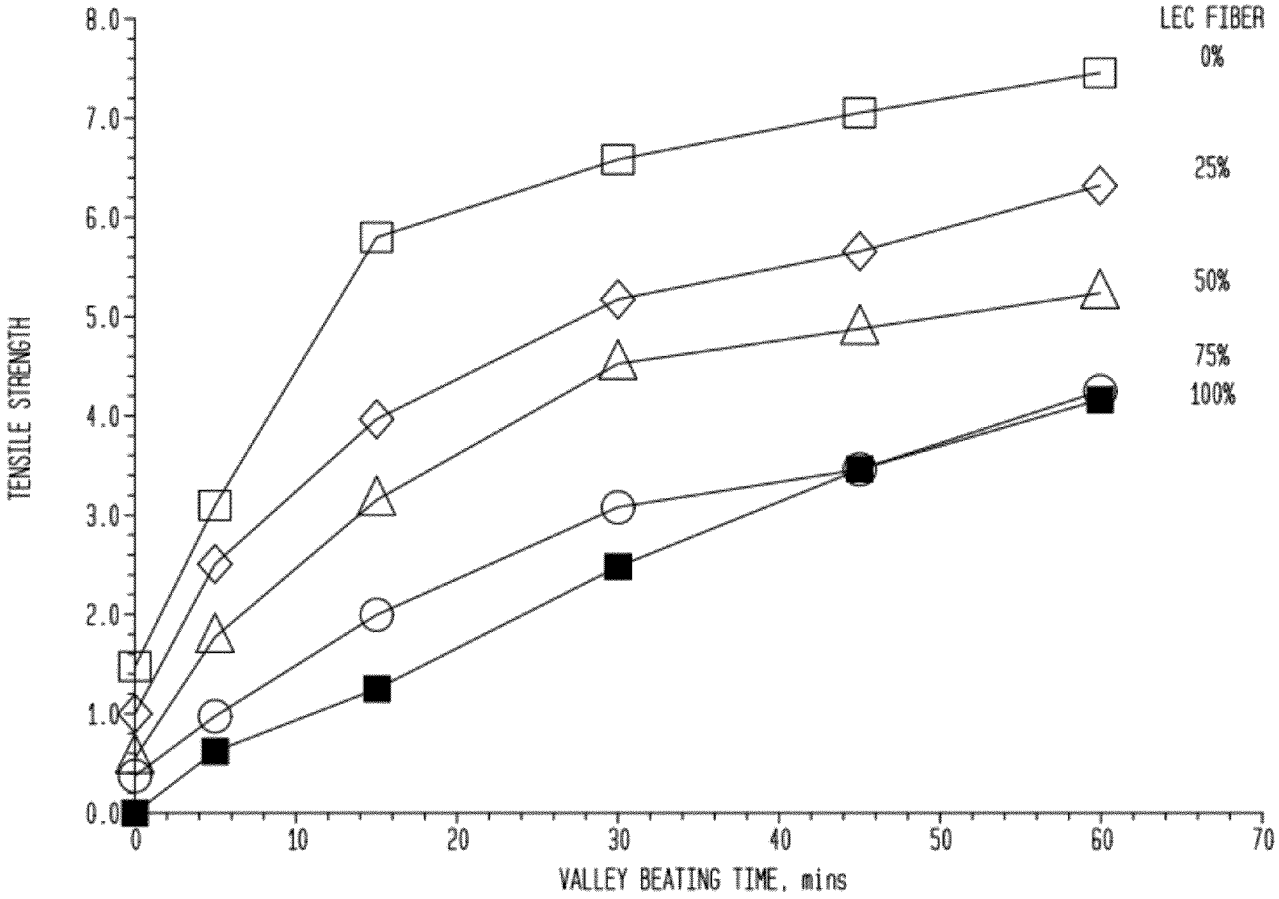
FIG. 8 illustrates variation in Tensile Strength of pressed handsheets comprising varying amounts of laterally expanded cellulose as a function of beating applied to the fibers in the furnish.
Figure 9:
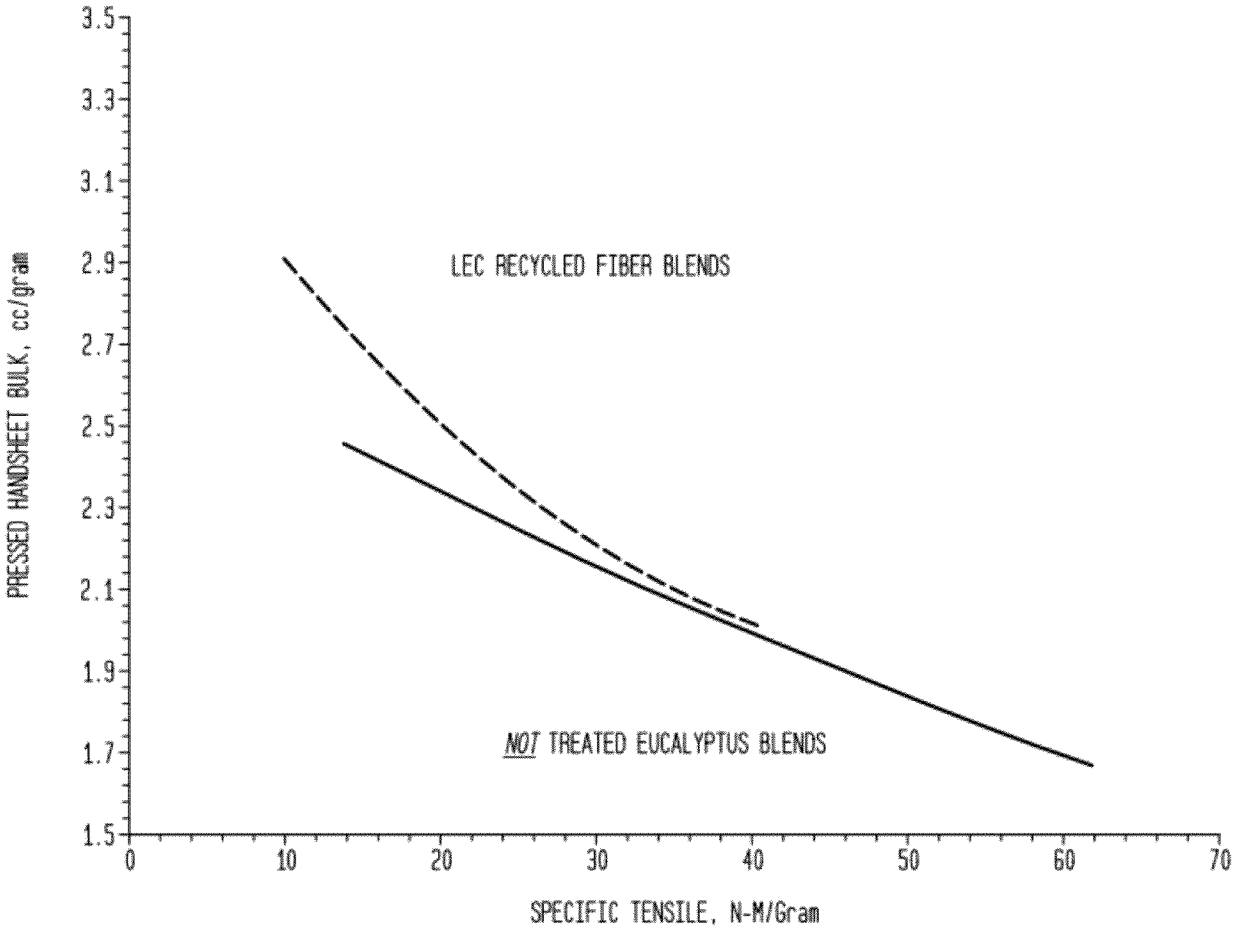
FIG. 9 compares bulk and tensile properties of pressed handsheets comprising laterally expanded recycled cellulose fibers to the bulk and tensile properties of pressed handsheets comprising conventional eucalyptus fibers.
Figure 10:
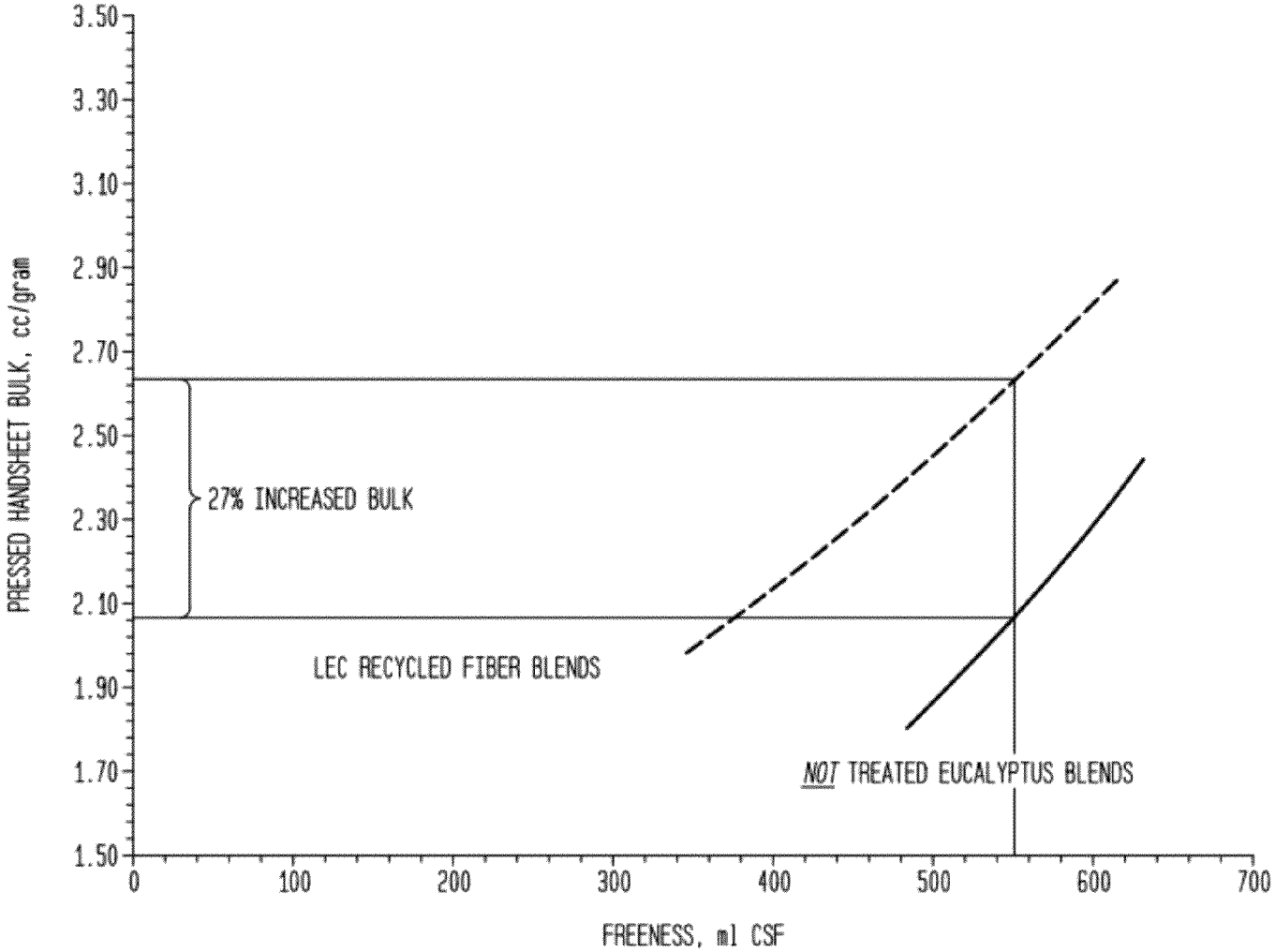
FIG. 10 compares bulk and freeness properties of pressed handsheets comprising blends of LEC fibers derived from recycled fibers with untreated recycled fiber to the bulk and freeness properties of pressed handsheets comprising conventional eucalyptus fibers.

FIG. 8 illustrates the reduction in tensile strength attainable by incorporating LEC fiber into furnishes which are subsequently refined before being made into handsheets.

FIGS. 9, 10, 12 and 13 compare the exceptionally high bulk attainable by incorporating blends of LEC fibers into handsheets to the bulk attained with handsheets from eucalyptus kraft fiber.

Figure 11:
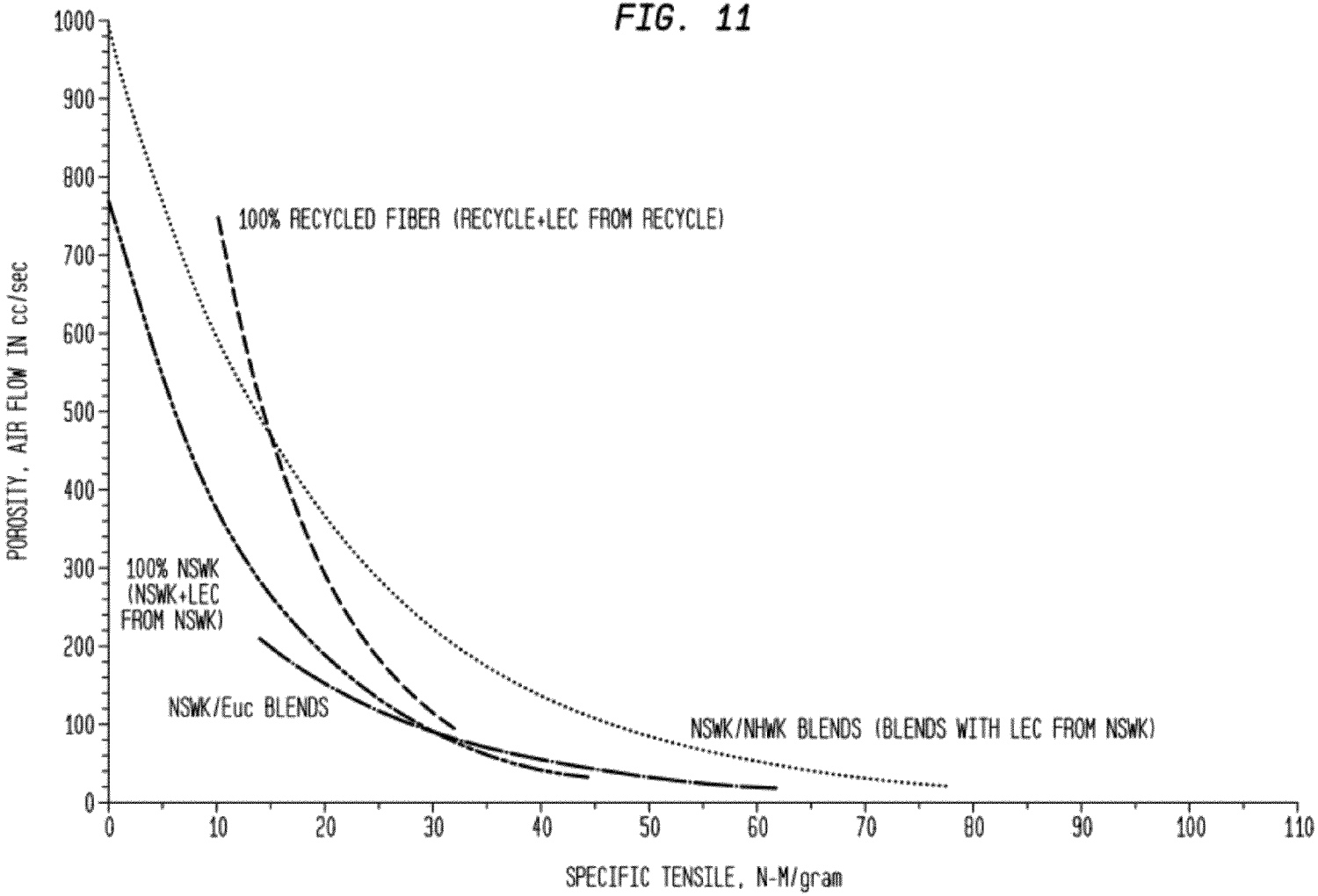
FIG. 11 compares porosity and tensile strength of pressed handsheets comprising blends of laterally expanded cellulose fibers derived from a variety of fibers.
Figure 12:
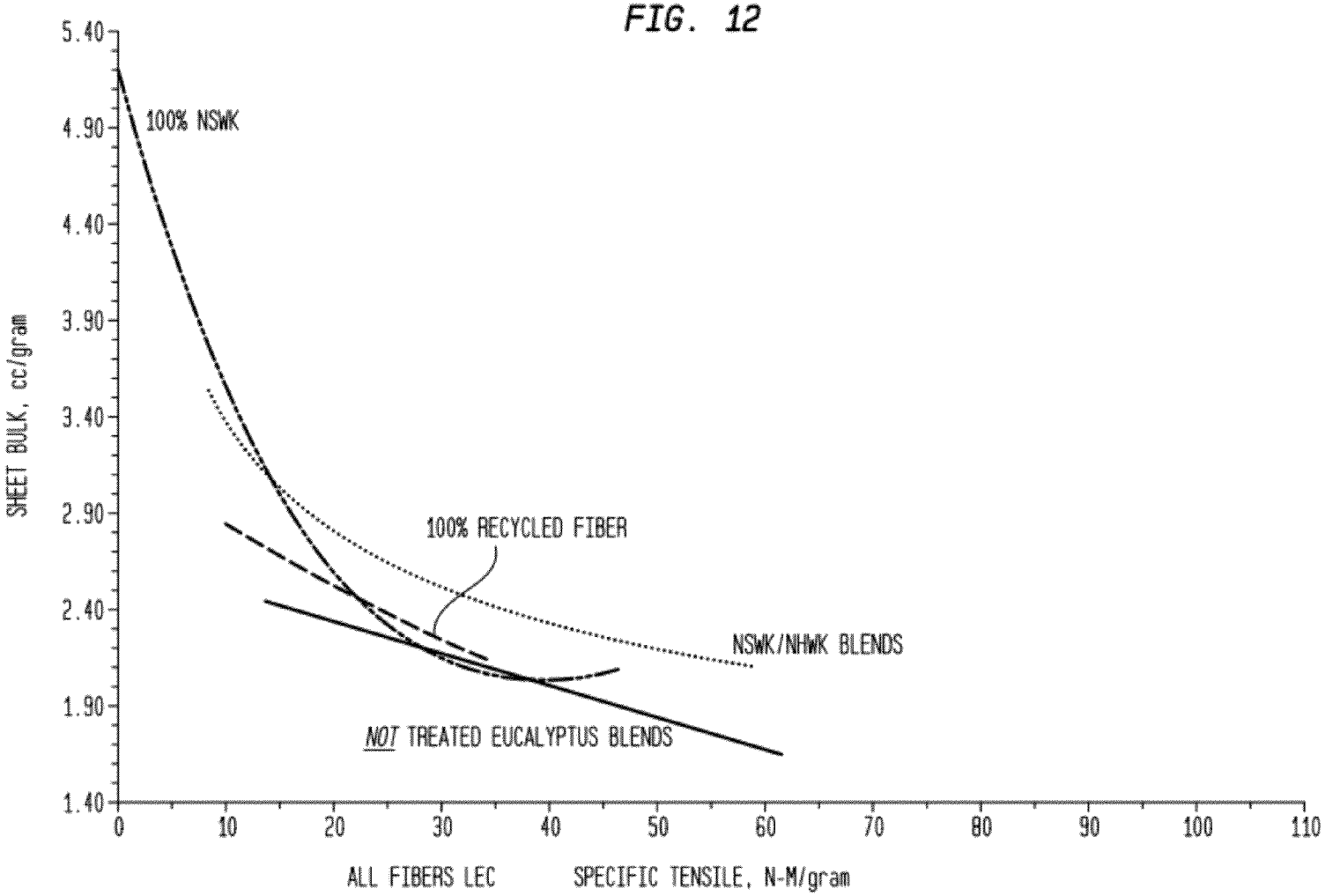
FIG. 12 compares bulk and tensile strength of pressed handsheets comprising blends of laterally expanded cellulose fibers derived from a variety of fibers.
Figure 13:
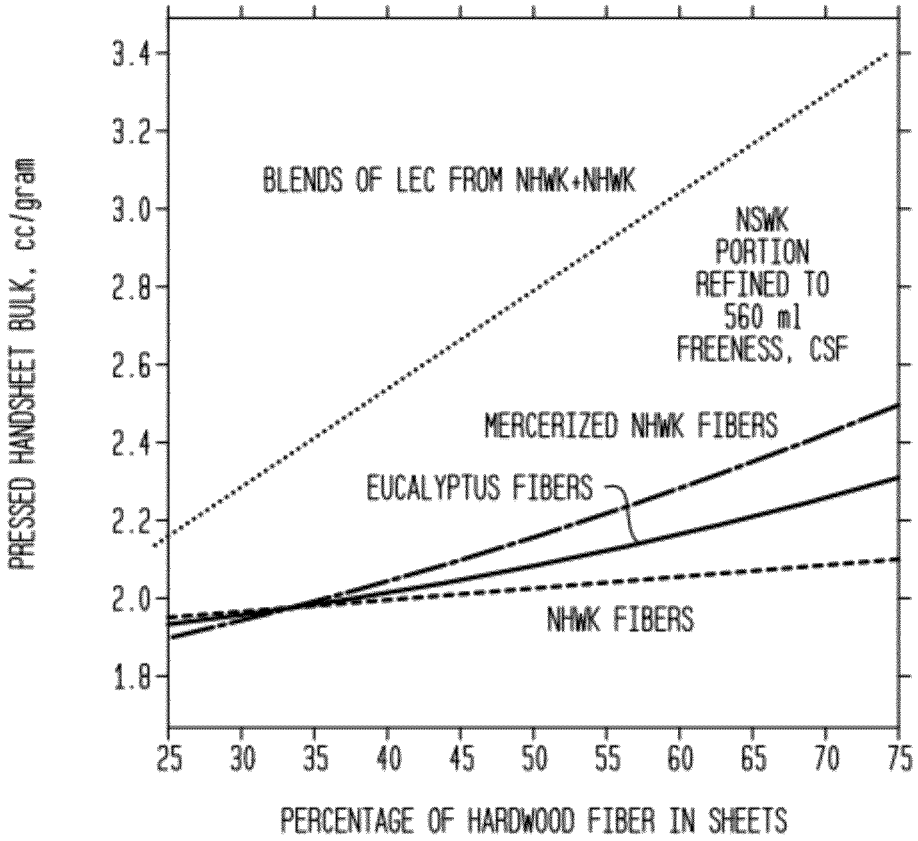
FIG. 13 illustrates the dramatic improvement in bulk achievable by incorporating varying amounts of laterally expanded cellulose fibers derived from Northern hardwood kraft fibers in handsheets comprising northern softwood kraft fibers as compared to the improvements in bulk attained by incorporating varying amounts of conventional northern hardwood kraft, eucalyptus, and mercerized northern hardwood kraft fibers.

FIG. 11 compares the exceptionally high porosity attainable by incorporating blends of LEC fibers into various furnishes for handsheets to the bulk attained with handsheets from eucalyptus kraft fiber.

Figure 14:
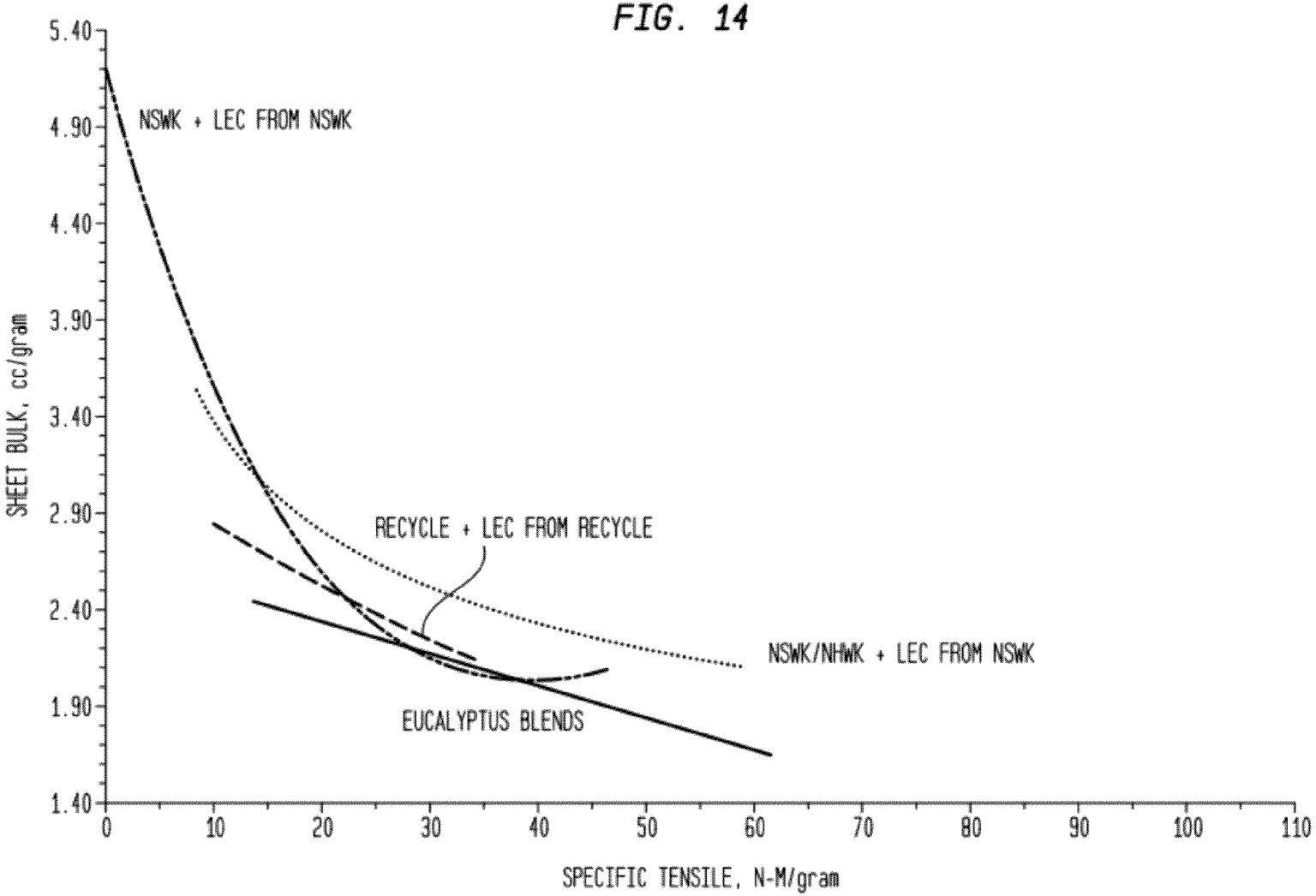
FIG. 14 illustrates that at comparable tensile strength, LEC fibers derived from NHWK fibers can provide more bulk than untreated Eucalyptus. Even LEC fibers derived from 100 percent recycled fiber surpass the bulk of Eucalyptus at lower tensile levels and are no worse at higher levels. This graph also shows towel potential using LEC derived from 100% NSWK.

FIG. 14 compares the tensile strength of handsheets made from various furnishes comprising LEC fiber blended with conventional fibers to the tensile strength of handsheets made from conventional blends with eucalyptus.

Figure 15:
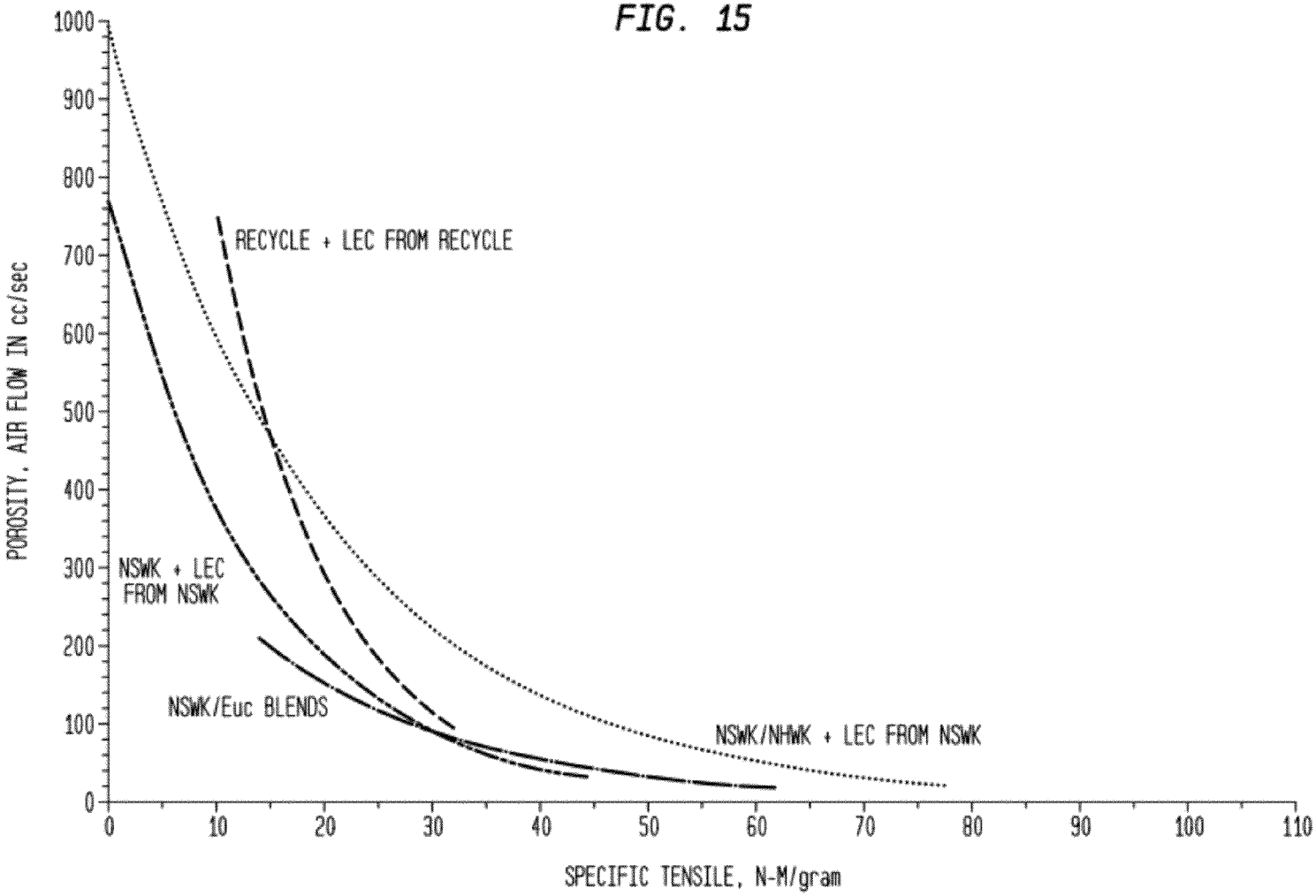
FIG. 15 illustrates the dramatic increase in sheet porosity achievable using blends of LEC fibers with other fibers.

FIG. 15 compares the porosity of handsheets made from various furnishes comprising LEC fiber blended with conventional fibers to the tensile strength of handsheets made from conventional blends with eucalyptus.

Discussion of Results

First Series of Trials

Figure 16:
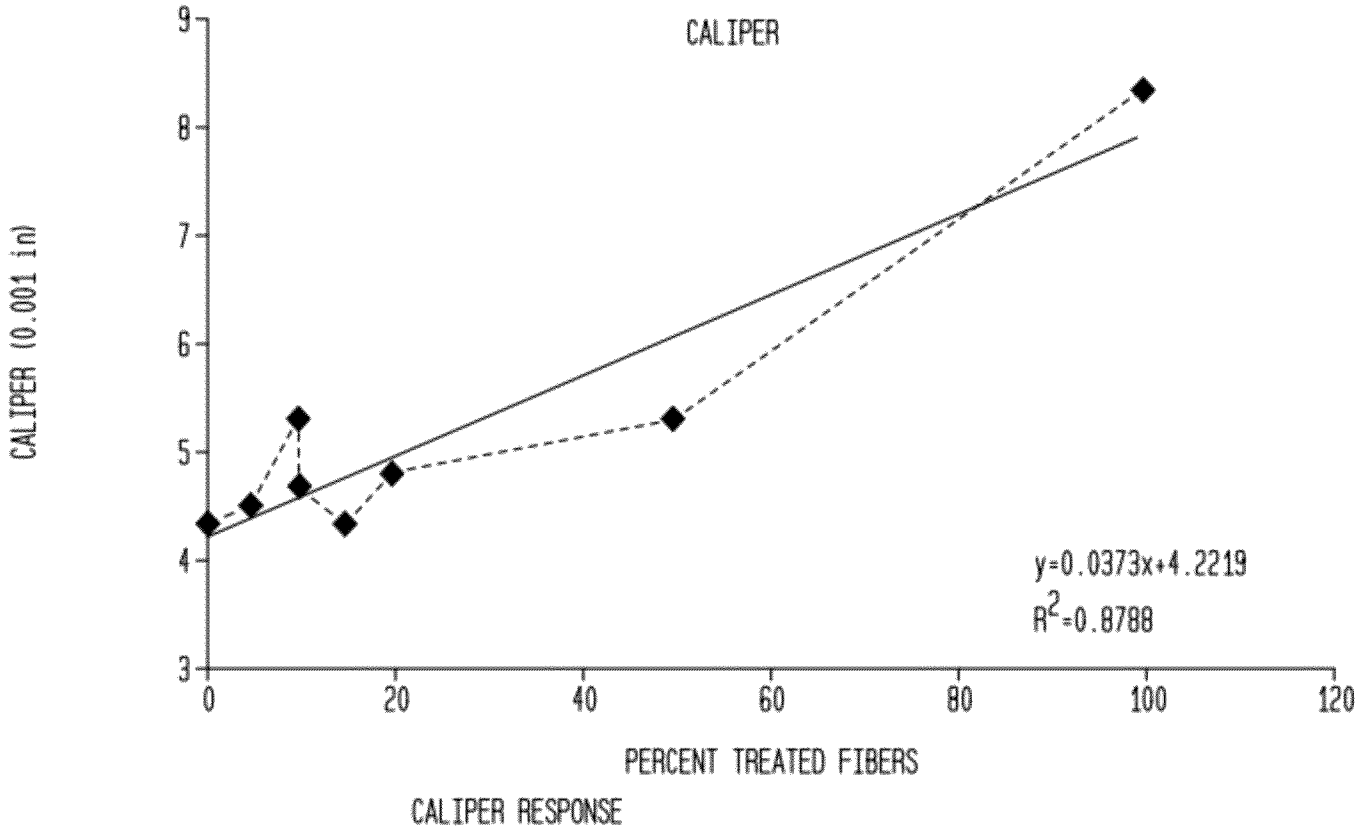
FIG. 16 illustrates the dramatic increase in sheet caliper achievable using blends of LEC fibers.
Figure 17:
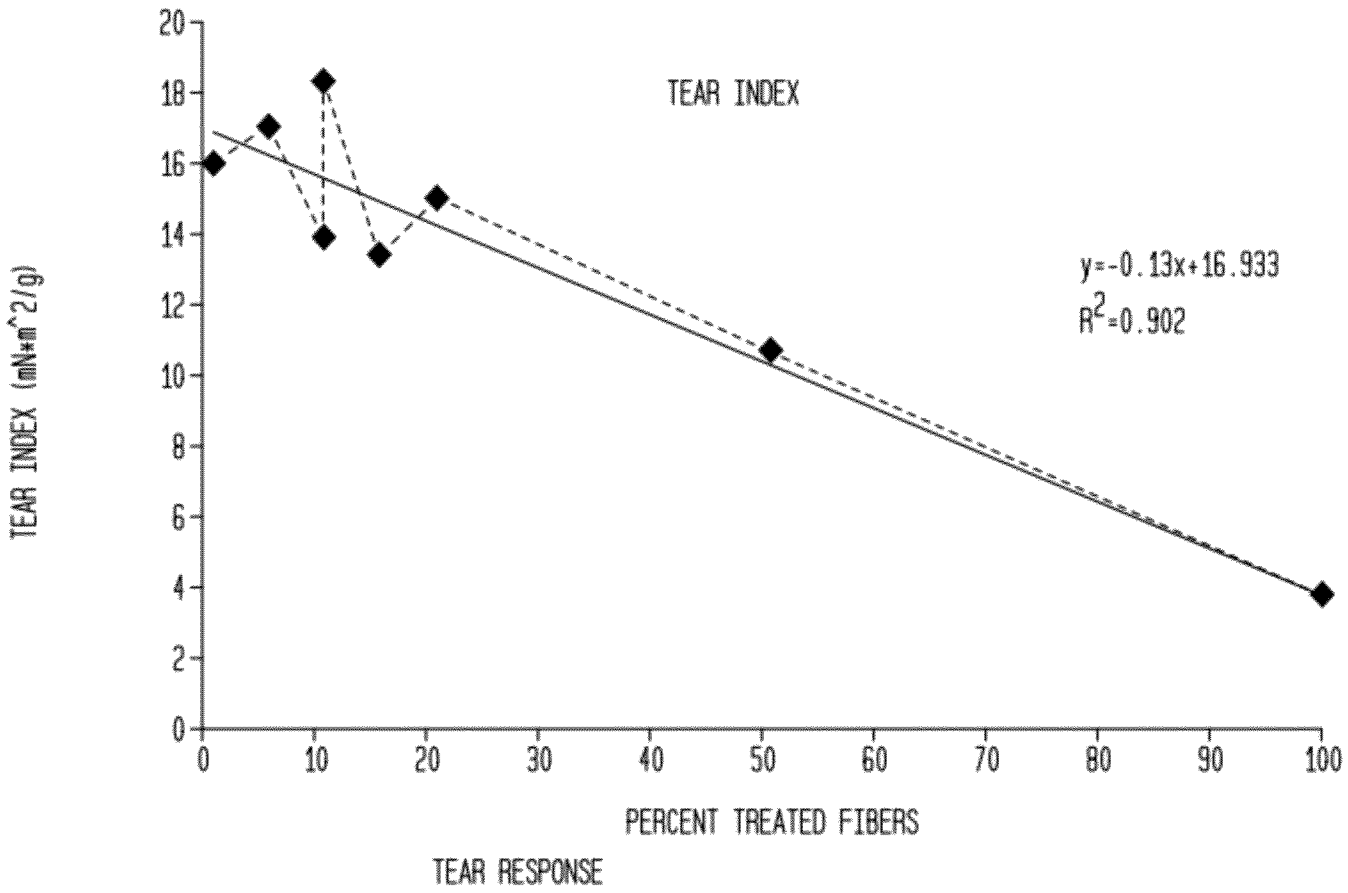
FIG. 17 illustrates the variation in tear strength achievable using blends of LEC fibers.
Figure 18:
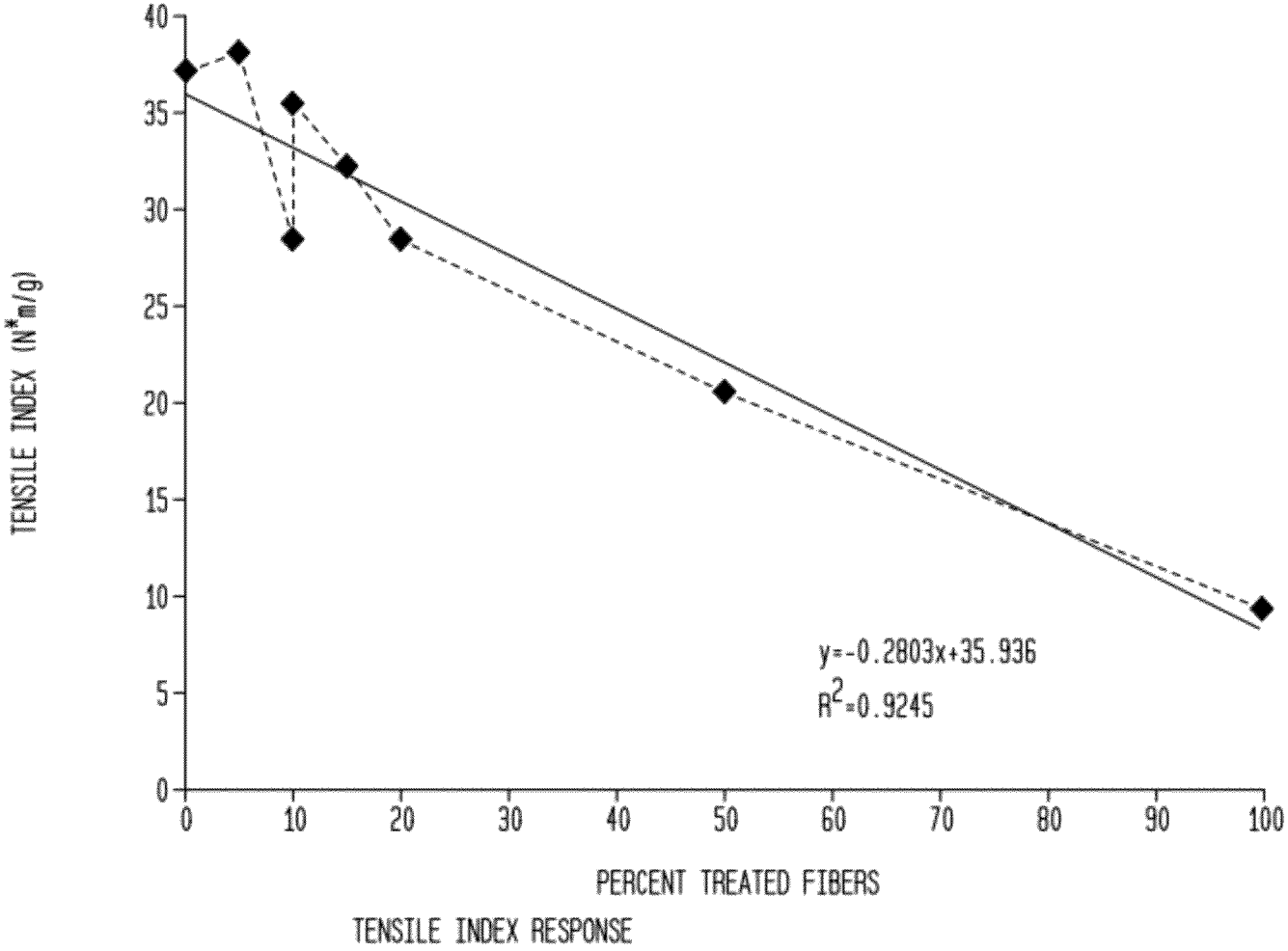
FIG. 18 illustrates the variation in Tensile Index achievable using blends of LEC fibers.

FIGS. 16, 17 and 18 illustrate results obtained in preliminary or exploratory trials in which it was later discovered that there were inaccuracies in the recorded compositions of the sheets. FIG. 16 shows the steep response of caliper with the blending of treated and untreated fibers. Similarly, addition of LEC fibers steeply reduces the tensile index of these sheets as is shown in FIG. 17. Tear strength reacts in a manner similar to tensile as shown in FIG. 18.

While these responses are significant, for such fiber to be commercially successful, it is very important to understand the behavior at the lower end of the addition curve for the cost/benefit ratio at each addition level. Clearly, there is considerable variability exhibited in each of these properties especially at the lower addition levels. Further, a careful visual analysis of the sheets made during this preliminary or exploratory run showed non-uniformities in the fiber mixing and formation of the handsheets.

Second Series of Trials

The second round of trials was carefully planned to eliminate the mixing and uniformity problems as seen with the exploratory set of handsheets. Throughout the runs, TAPPI standard methods were utilized for mixing the fibers, and for preparing and making the handsheets. It was decided that to better understand the behavior of these fibers, standard beater curves would be run on a range of blends from 100 percent NSWK to 100 percent treated NSWK fibers in intervals of 25 percent. In addition, sheets made with unrefined blends were produced to detail the lower end of the blending ratios, namely 5, 10, 15 and 20 percent treated fibers Therefore, while the preliminary or exploratory set of data produced directionally suggestive results providing an initial indication of the benefits attainable with LEC fibers, our analyses and conclusions about the properties these treated fibers impart to sheets and the economic benefits seen from using these fibers will be based solely on the second set of trials.

Refining Responses

Figure 19:
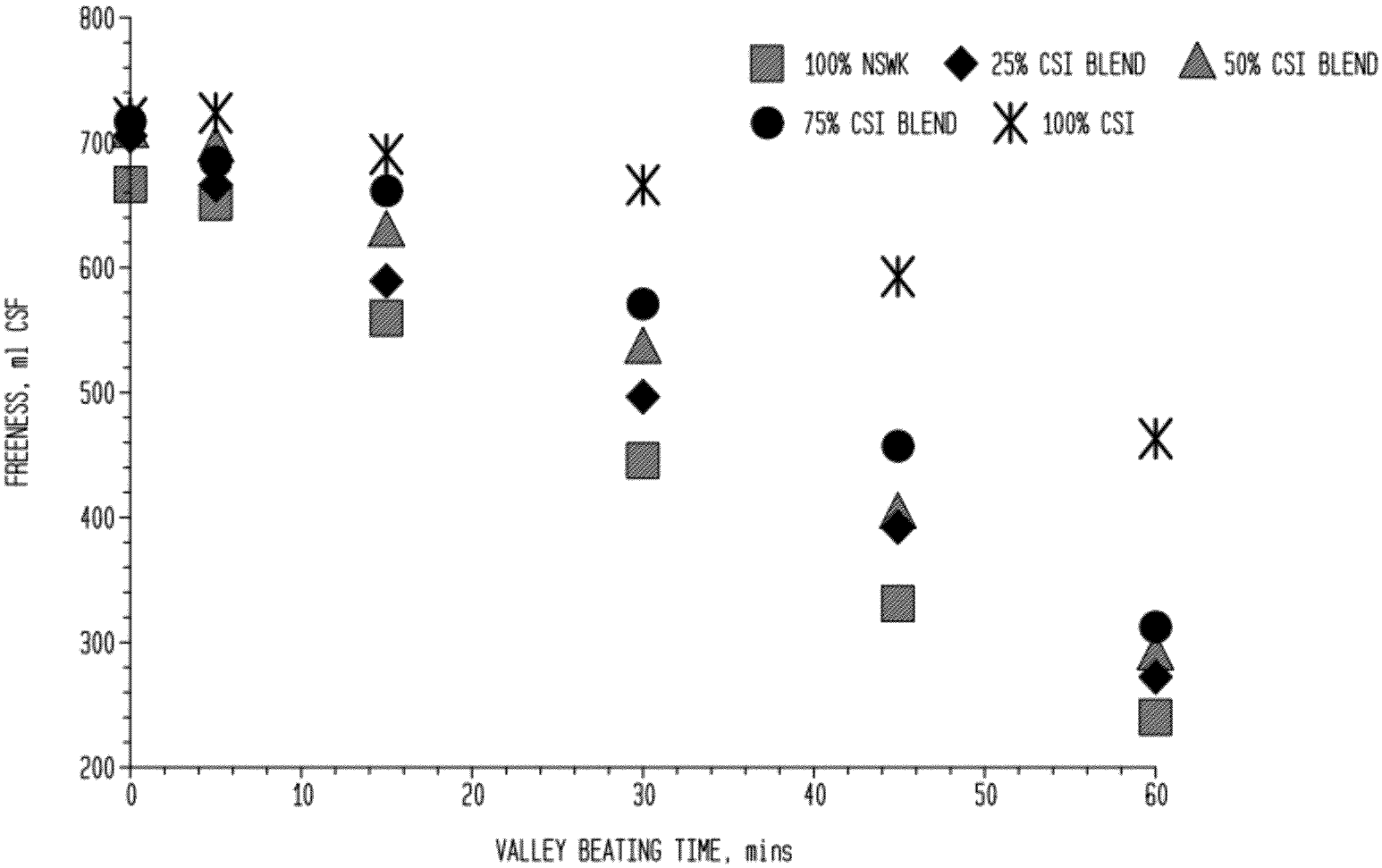
FIG. 19 illustrates the relative insensitivity of LEC fibers to refining in comparison to conventional fibers.
Figure 20:
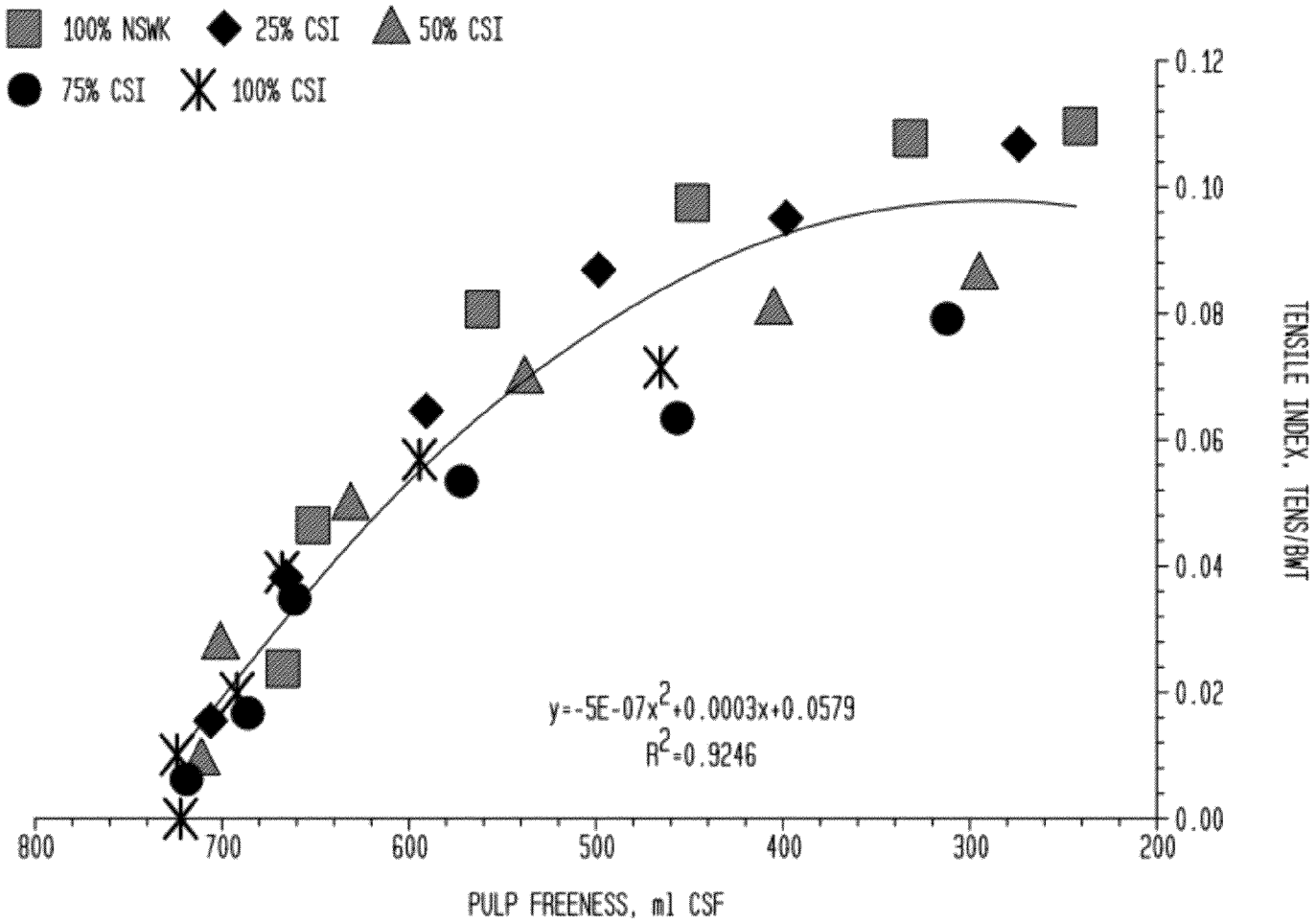
FIG. 20 illustrates the variation of the Tensile Index (Tensile Strength/Basis Weight) of various blends of LEC fibers and conventional fibers in response to variations in freeness.

Treated and untreated fibers and blends responded to the beating action in the Valley beater. Beating times of 0, 5, 15, 30, 45, and 60 minutes were used. FIG. 19 shows the comparisons of freeness response to beating times. Adding LEC fibers raises the freeness values at each beating time; and at 50, 75 and 100 percent addition of LEC fiber blends, a reduced response (slope) is seen over lower ratios. While it might be expected to be disadvantageous to use the LEC process to treat fibers and then refine them, this data shows that if, as is commonly done in some machines, a tickle refiner is used to control sheet strengths, the improvement in properties shown in LEC fibers has a surprising ability to withstand the negative effects of limited refining which does not exhaust all of the benefits attainable with LEC fibers. Furthermore, in the case of recycled fibers, when a highly refined fiber is subsequently treated with the Atalla I process, results like those seen in FIG. 19 are obtained as blending Atalla I treated recycled fibers into the mix will reduce the tensile, increase the freeness and therefore the formation potential of the sheet, along with increasing the caliper as shown in FIG. 20.

It appears that even highly refined LEC fiber will significantly reduce tensile and improve formation. For example, going from 100% NSWK to 100% LEC treated at the maximum refining levels, tensile can be seen to drop from 0.11 to about 0.07 (a 37% drop) while freeness rises from about 250 ml to about 450 ml. These are considered very significant changes. Another way to look at FIG. 20 is to compare the squares to the diamonds. Each diamond represents a 25% blend of LEC fiber compared to the 100% NSWK of the red square. Each diamond shows higher freeness and lower tensile than the untreated NSWK. The same is true for each of the comparisons of the amounts of LEC fibers added.

Figure 21:
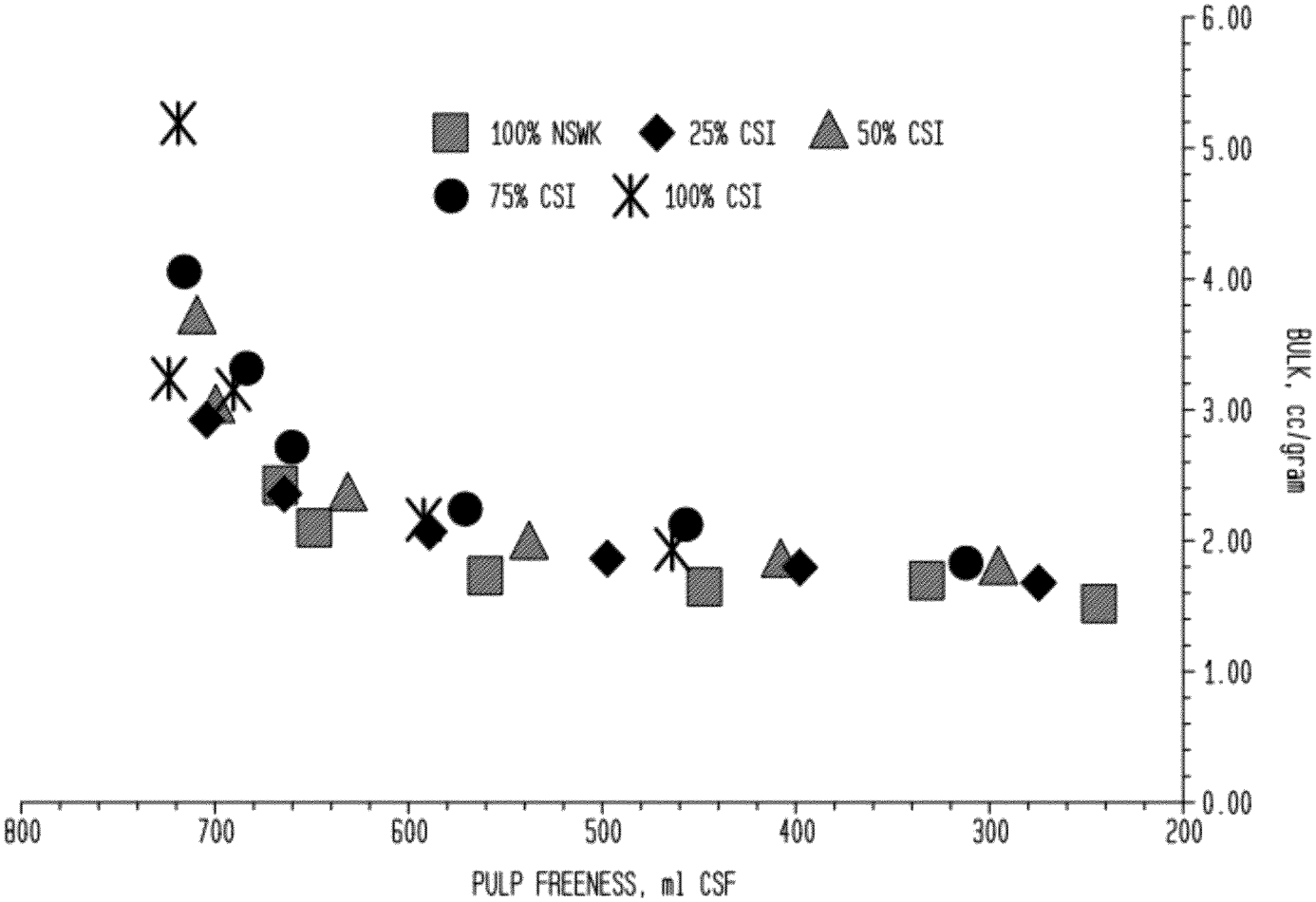
FIG. 21 illustrates the variations in bulk of LEC fibers of various blends of LEC fibers and conventional fibers in response to variations in freeness.

LEC fibers add to the caliper of the sheets in a manner that is approximately opposite the shape of the tensile curve. As LEC fibers are added, sheet bulk and freeness are increased while tensile strength is decreased—regardless of the refining level at least within the limits tested. FIG. 21 illustrates this comparison. To get to the level of freeness and bulk of a standard NSWK sheet, two levels of refining can be done on the 25% and 50% LEC blends, three levels with the 75% blend and 4 levels of refining on the 100% LEC blend to get to the same conditions. Furthermore, all of the blended sheets exhibit a higher bulk than the NSWK sheets at all of the freeness levels. It can therefore be concluded that adding LEC fibers to a mix will significantly increase bulk and reduce tensile strength at a higher freeness level. Thus, because LEC fibers are less sensitive to refining than conventional fiber, it is surprisingly found that the novel drainage and bulk properties contributed by the fiber are not erased by a moderate amount of refining. Accordingly, if a papermaker is afflicted with a particularly poorly draining furnish, such as a furnish comprising large amounts of recycle fiber, it is possible to alleviate the issues entailed by poor drainage by adding LEC fiber to the furnish and increasing the relative amount of refining imparted to the furnish to bring the tensile level of the resulting sheet back up to his original targets. In this way, it is possible that a maker of flat papers may be able to increase machine speed or cut drying load by incorporating LEC fiber into the furnish without sacrificing sheet properties.

Figure 22:
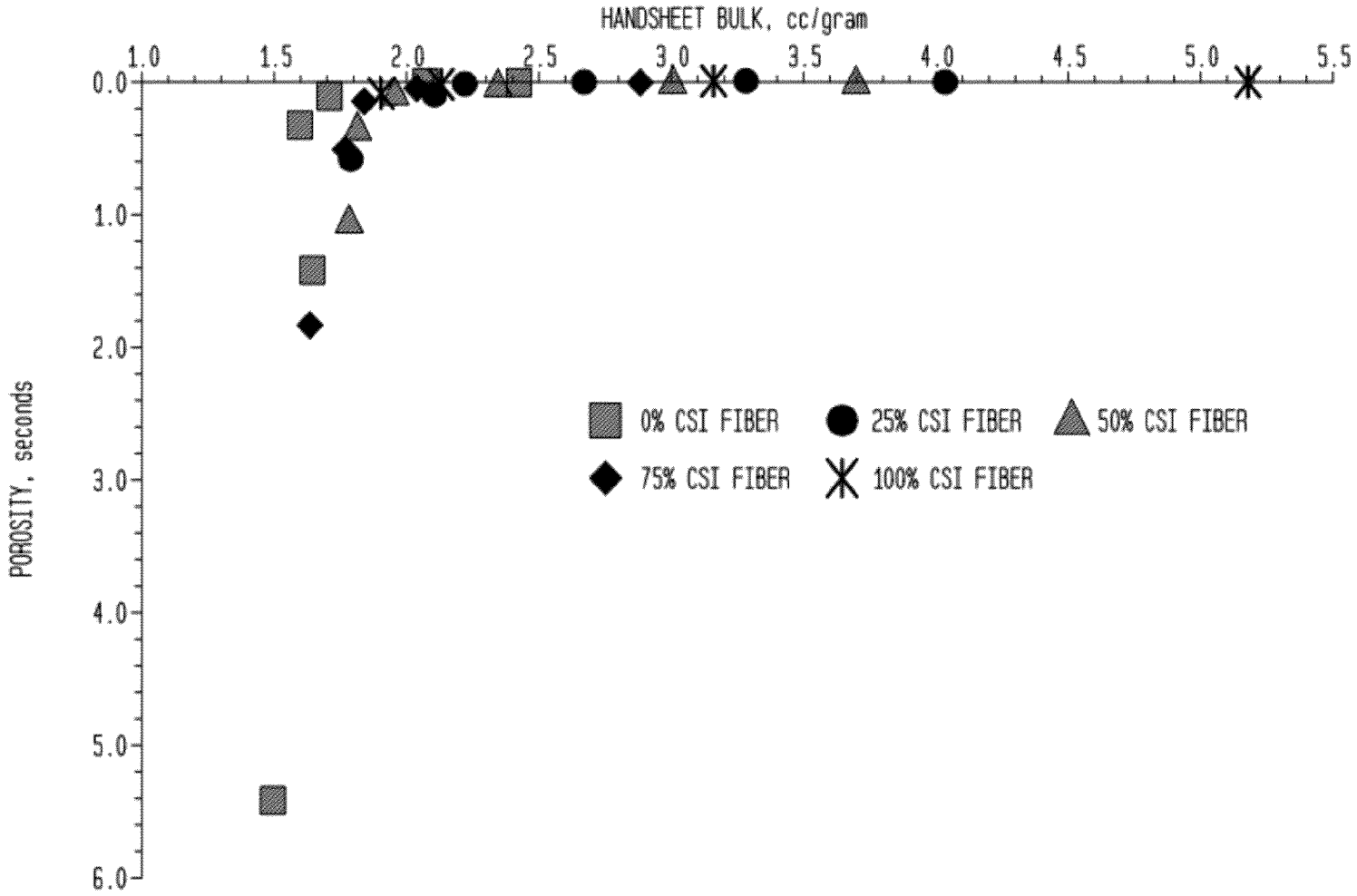
FIG. 22 illustrates the variations in porosity of handsheets made from various blends of LEC fibers and conventional fibers in response to variations in bulk.

Sheet porosity is also strongly affected by the addition of the LEC fibers. In FIG. 22 a plot of bulk versus porosity, represented by the time required for a specific volume of air to pass through the sheet, shows that the porosity of the sheet decreases markedly at high refining levels. In other words, it takes a very long time for the air to pass through the sheet and therefore it can be concluded that the sheet is not very porous to air flow. In actuality, any time over a couple of tenths of a second represents considerable highly undesirable closing of the sheet to air flow. The addition of LEC fibers clearly shifts this curve to the range of higher bulk and higher air flow rates. Even very highly refined LEC fibers at the 100% level maintain an acceptable level of flow. The importance of porosity becomes critical when highly refined furnishes are used to make tissue and towels as well as some flat paper grades. Recycled fiber furnishes tend to be highly refined and slow draining. Adding LEC fibers to recycled fiber furnishes can increase the drainage rate (freeness) for better formation, increase the caliper for better bulk, decrease density for lower tensile and increase porosity for better drying, especially if through air drying (TAD) is used. Normally, to get better air flows when using TAD with 100% recycled fiber furnishes, extensive cleaning is required which reduces fiber yield and increases fiber costs—possibly to such an extent that use of TAD becomes unattractive economically. It is believed that this may be the main reason that few recycled fiber sheets are through air dried even though using TAD to make tissue and towel sheets typically results in high bulk, high softness and high absorbency sheets that consumers generally prefer. It is believed that almost all high end TAD products are produced using virgin fibers, a good portion of which can be NSWK fiber which generally is very mildly refined or is sometimes not refined at all. Any refining of conventional fibers to be incorporated into a sheet to be through air dried tends to unduly slow down the drying process and therefore the production rate of the towel machine. From FIG. 22 it can be seen that highly refined NSWK results in an air flow time of over 5 seconds. Adding just 25% LEC fibers, even though they too are refined, reduces the flow time to less than half. Were those LEC fibers not refined at all and added to the highly refined fiber, an even more significant improvement in porosity should be expected.

Figure 23:
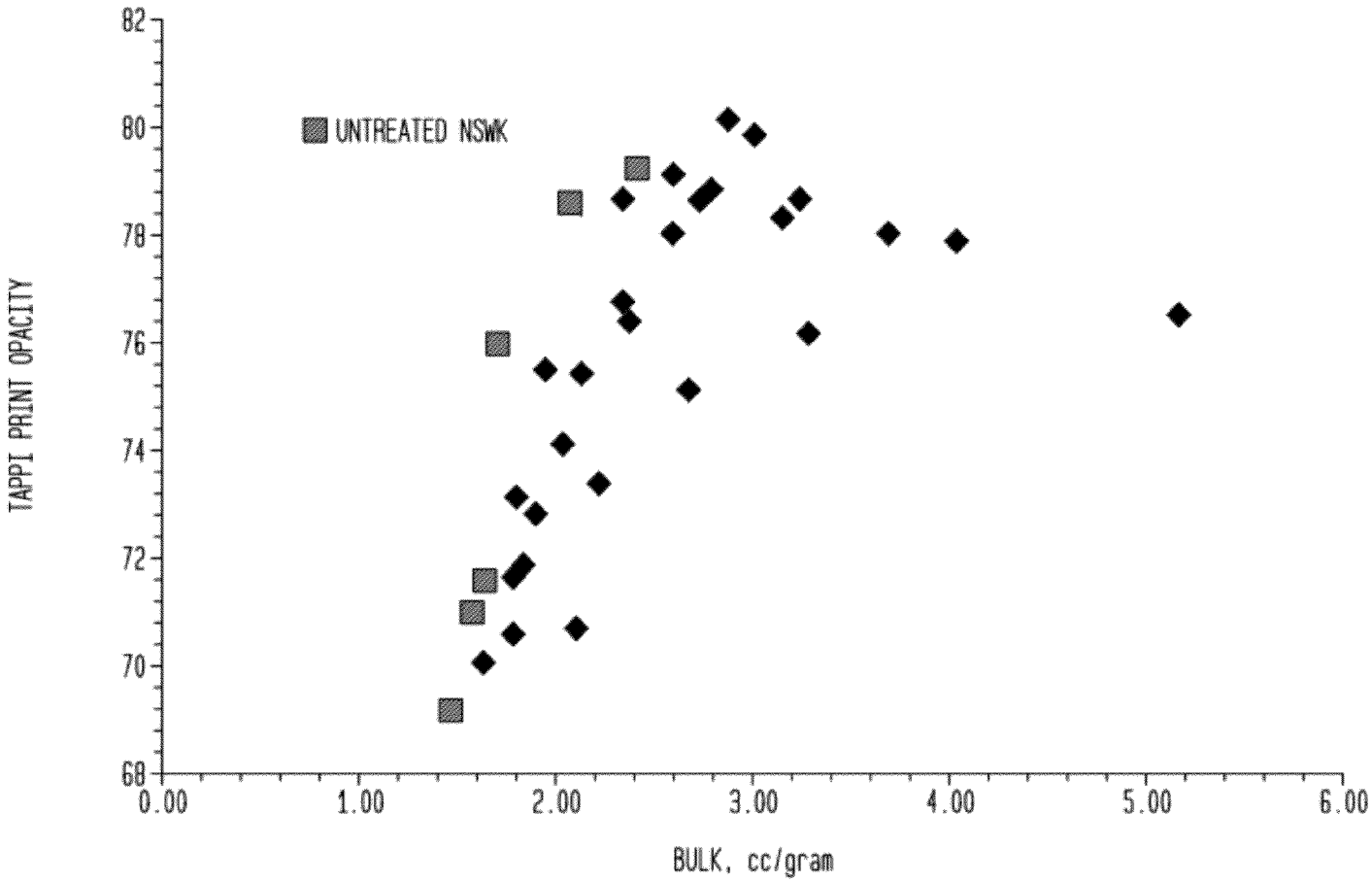
FIG. 23 illustrates the excellent opacity achievable with even bulky blends of LEC fibers.

In many paper grades, opacity is a very important property. FIG. 23 shows the impact of LEC fiber on TAPPI Print Opacity. The untreated fibers show a steep drop in opacity and bulk with increased refining. While treated fibers show a similar response, incorporation of varying amounts of LEC fibers gives the paper maker much flexibility in controlling both opacity and bulk. For example, an opacity of 78 can be produced over a range of bulk from about 2.3 to over 4 cc/gram. This can provide very significant flexibility allowing the paper maker to reduce basis weight, increase pressing, reduce drying costs, and make other changes to improve his grade's competitiveness or reduce costs.

Figure 24:
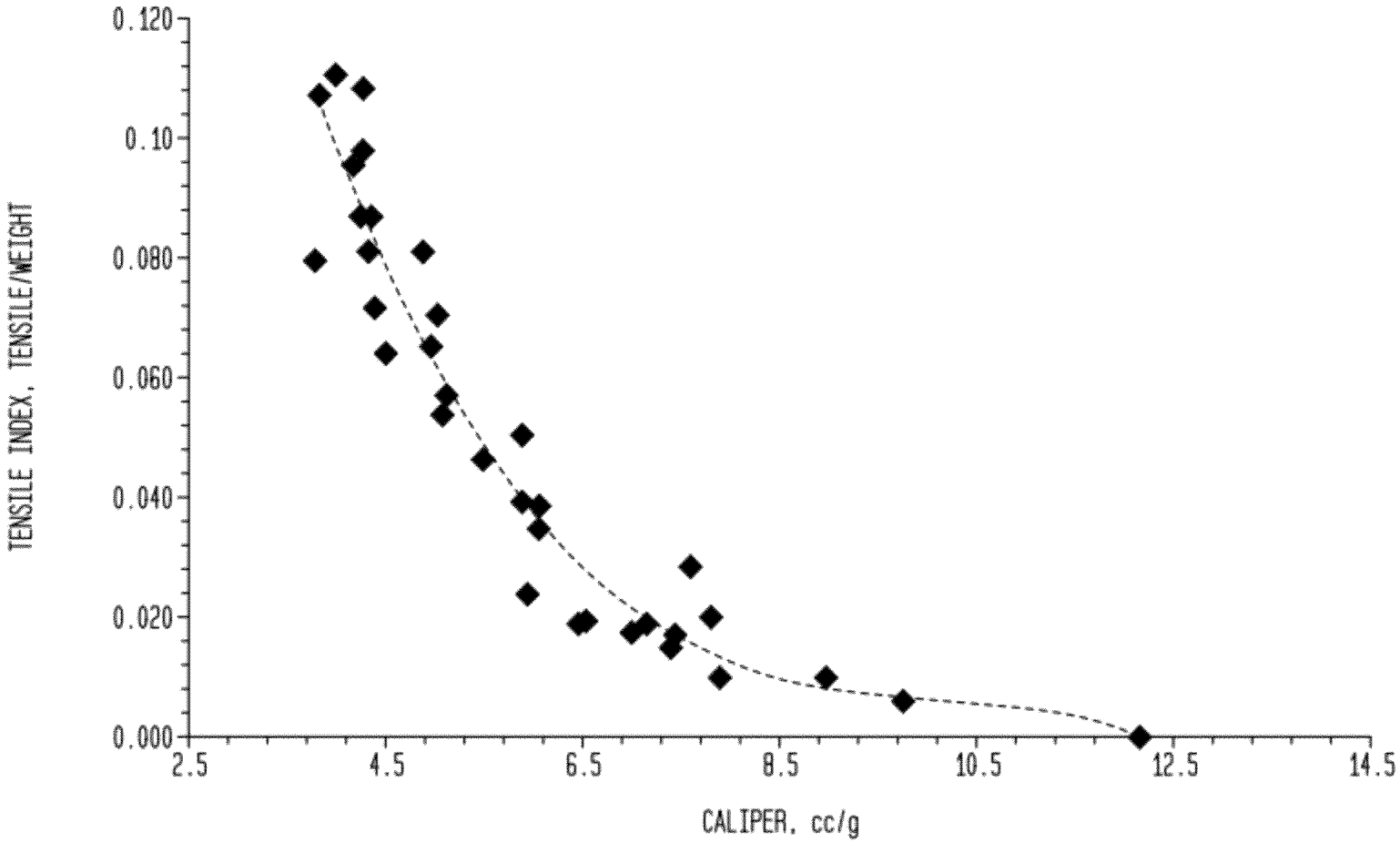
FIG. 24 illustrates the relationship between caliper and tensile strength of blends of LEC fibers with conventional fibers.

Other sheet properties, stretch, TEA, burst, and tear, were measured on handsheets made with refined fiber. Even though the response of LEC fibers to refining varies significantly from behavior of conventional fibers, in most other regards, it appears that LEC fibers behave similarly to conventional fibers while providing the enhanced sheet properties discussed herein. FIG. 24 shows the relationship between caliper and tensile index for all of the refined blends of NSWK and LEC fibers. Both fibers, LEC and conventional, appear to fall on the same line. This can mean that they behave similarly but lie at different ends of the scale. For example, high caliper comes at the cost of lower tensile but it doesn't appear to matter which type of fiber is being talked about. Both fall on approximately the same curve. Since no pattern in the outliers could be ascertained, they are taken to be normal variability in the production and testing of these handsheets. The conclusion reached is that these fibers act in a normal fashion but surprisingly do generate some very useful properties.

Unrefined Blends

Figure 25:
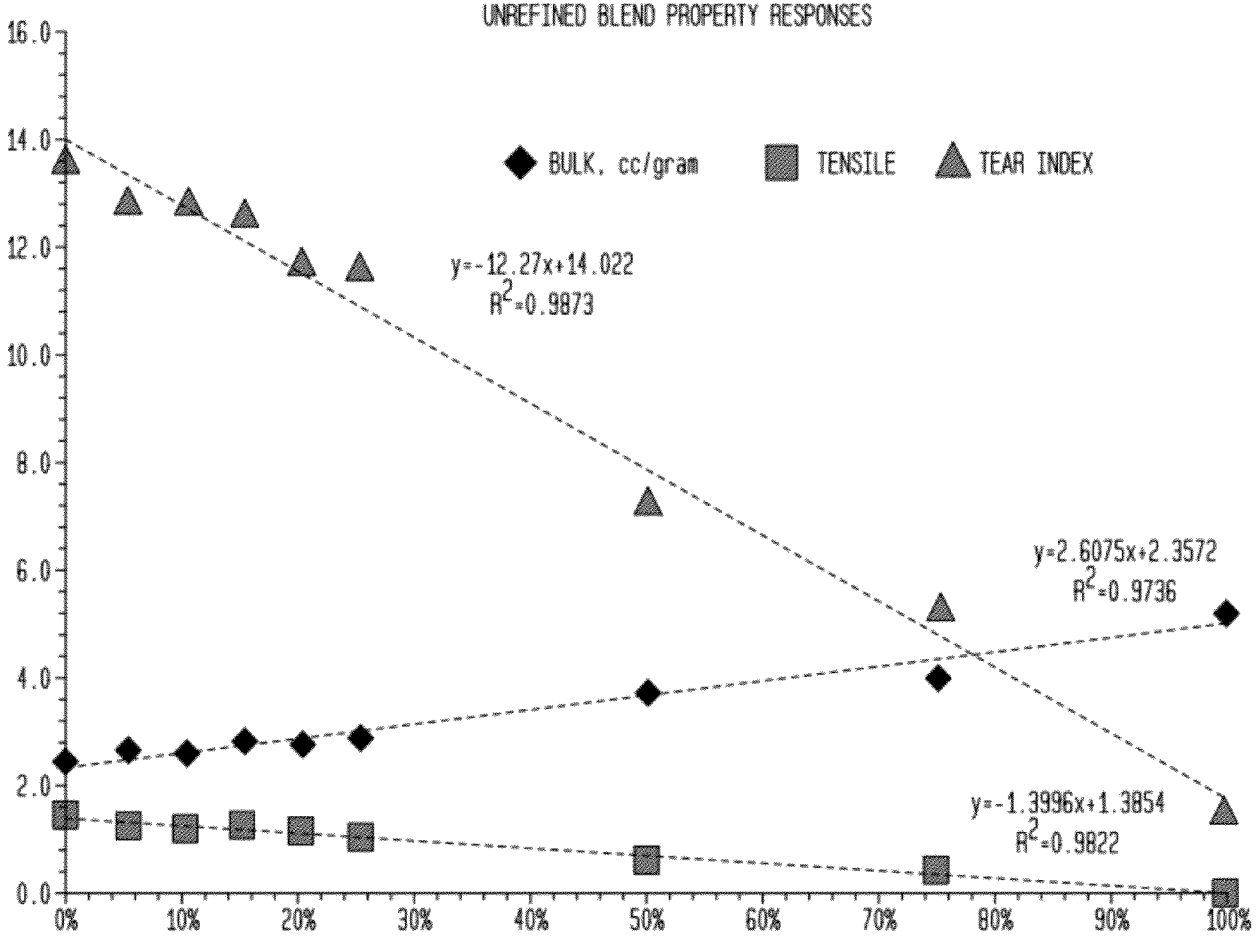
FIG. 25 illustrates the effects of incorporating LEC in handsheets.

When blended with unrefined NSWK fibers, unrefined LEC fibers act as debonding fibers in a very linear fashion for strength and bulk properties. FIG. 25 shows these relationships and the linear equations that describe them. Interestingly, the tensile and tear properties drop in direct proportion to the percentage addition of LEC fibers, while the bulk of the sheets increases slightly more.

Unrefined NSWK fibers are relatively debonded compared with heavily refined fibers as is shown in FIG. 20. There, the tensile strength of highly refined NSWK is seen to be about 5 times higher than unrefined. Since incorporation of refined LEC fiber into a sheet reduces its tensile substantially, it appears that a mixture of highly refined NSWK fiber with unrefined LEC fiber will reduce tensile to a much greater degree, thereby providing a powerful means of reducing the "rattle" and stiffness of sheets formed from highly refined NSWK furnish or a recycled fiber furnish by simply blending in unrefined LEC fiber.

Figure 26:
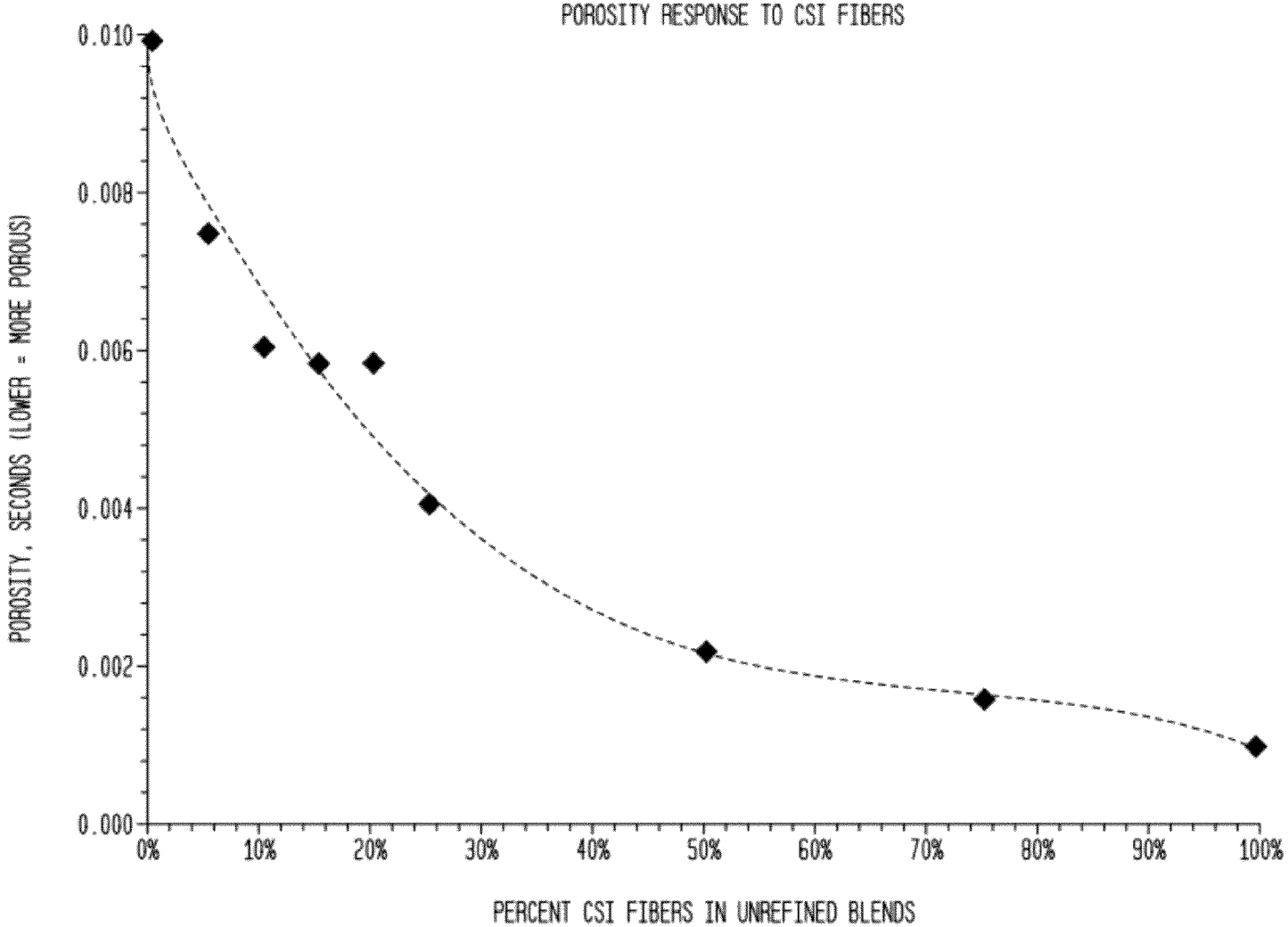
FIG. 26 illustrates the improvement in porosity resulting from inclusion of LEC fibers in handsheets.
Figure 27:
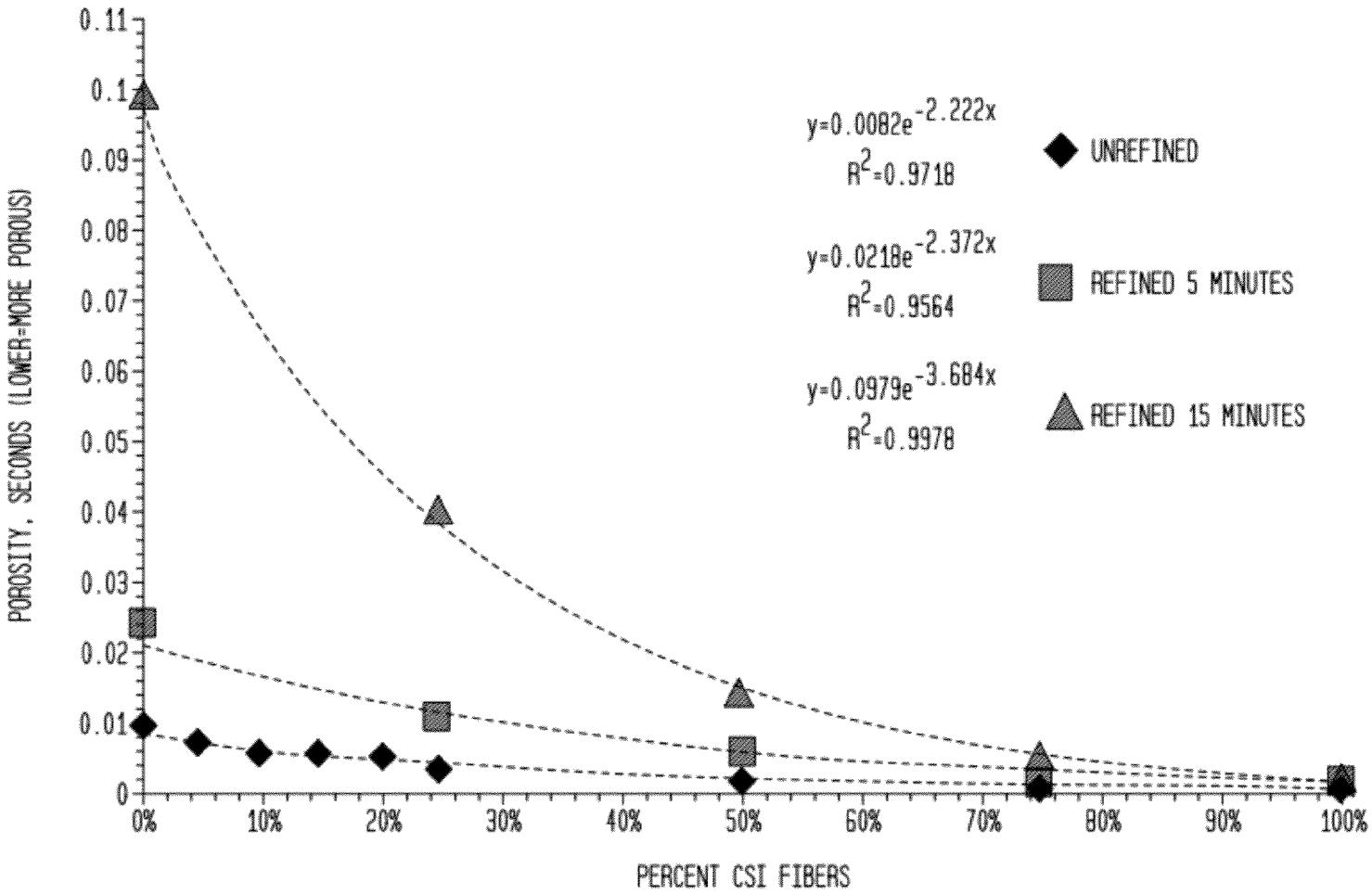
FIG. 27 illustrates the improvement in porosity resulting from inclusion of LEC fibers in handsheets derived from handsheets from refined blends of LEC and conventional fibers.

An even more valuable property of LEC fibers either refined or not, is their ability to significantly open up the sheet to increase the porosity as measured using the Gurley Method as explained in TAPPI T 460 and TAPPI T 536 for low and high air resistance respectively in which the time required to pass a given volume of air is measured and reported in seconds. As shown in FIG. 26, adding unrefined LEC treated fibers to unrefined NSWK greatly reduces the time required for a given quantity of air to flow through these pressed handsheets by as much as a factor of 10. As is generally experienced with TAD drying of tissue and towel sheets, any refining quickly reduces the porosity of the sheets and increases the pressure drop across the through driers, in turn slowing the drying process and productivity rate of the machine. While some refining may be used in TAD manufacturing, especially for towels, it is most often avoided to the extent feasible. However, when recycled fibers are used they tend to come to the process pre-refined and therefore are much harder to dry. To combat tendencies for excessive bonding and sheet densification, TAD towel processes often use chemical debonders in an attempt to ameliorate or reverse these effects. However, chemical debonders can be hard to control precisely and often lead to creping problems without necessarily opening the sheet up to the degree hoped for. Thus they often fail to provide significantly better air flows with an improvement in drying and productivity commensurate with the expense and complications involved therewith FIG. 27 demonstrates the potential for LEC treated fibers to very significantly open up refined sheets for improved air flows, even when the LEC fibers have been refined. Clearly, even slight refining of NSWK fibers decreases porosity by about 2.5 times while 15 minutes of refining reduces it by 10 times. Porosity changes of this magnitude could render a TAD process uneconomic.

As is shown in Table 2, adding 25% LEC treated fibers to unrefined NSWK fibers increases the air flow rate to such an extent that the time required to pass a given quantity decreases by 59 percent. Reductions of this magnitude essentially mean that the air flow rate has more than doubled. When the NSWK and the LEC treated fibers are refined together, increased air flow persists, remaining relatively constant even at higher refining levels. Therefore, it should be expected that adding unrefined LEC fibers to a refined NSWK fiber might increase porosity by at least this much and, very likely, significantly more. Even if less than 25% unrefined LEC treated fiber is used, its use would likely produce a drop of about this amount. Accordingly, the fibers of the present invention are particularly advantageous for use in through air dried grades of towel and tissue products as a particularly large portion of the expense of manufacturing through air dried grades stems from the cost of removal of water therefrom by evaporation. Due to the improved spring back of the fibers of the present invention as well as the more uniform pore structure and higher porosity of sheets including these fibers, it will be possible to remove more water mechanically from the sheet while preserving its open structure, thereby greatly decreasing the amount of energy required for drying of the sheets and increasing the operating speed of the papermachine thereby making it possible to produce relatively more paper for the given size of the papermachine. Preferably, a furnish used for making through air dried grades will comprise at least about 1% by weight of nanoporous cellulose fibers, preferably at least about 3%, more preferably at least about 4% and most preferably between about 5 and about 25% by weight of nanoporous cellulose fibers.

TABLE 3

Porosity Increase with 25% LEC Fiber

| % LEC Fiber | Beating Time (min.) | Porosity (sec.) | Time Reduction (%) |
|---|---|---|---|
| 0 | 0 | 0.0100 | |
| 25 | 0 | 0.0041 | 59 |
| 0 | 5 | 0.0250 | |
| 25 | 5 | 0.0114 | 54 |
| 0 | 15 | 0.1000 | |
| 25 | 15 | 0.0404 | 60 |
| 0 | 30 | 0.3280 | |
| 25 | 30 | 0.1476 | 55 |
| 0 | 45 | 1.4110 | |
| 25 | 45 | 0.5208 | 63 |
| 0 | 60 | 5.4140 | |
| 25 | 60 | 1.8300 | 66 |

In the Examples provided, LEC fibers and the conventional cellulosic papermaking fibers were blended before the refining step. To investigate the possibilities of using split stock refining systems, similar trials were conducted in which the LEC fibers were not refined but were blended with conventional papermaking fibers which had been previously refined to varying degrees. The results of these trials are set forth in Appendix I, parts 1 and 2. These results establish that LEC fibers behave far differently from either conventional papermaking fibers or mercerized cellulosic fibers and provide the papermaker with opportunities to improve both product performance and the productivity of his papermachine with significantly reduced costs for fiber.

LEC Potentials

Wet Pressing

While all handsheets tested were pressed to the same degree, the resultant tensile varied greatly with amounts of LEC fiber. These treated fibers appear to act like springs and expand back to larger sizes after pressing. In pressure controlled grades like tissue and towel, higher peak pressures result in dryer sheets after pressing. In pressure controlled nips, especially in machines where shoe presses are used, very high peak pressures can be combined with very sharp pressure release curves to greatly increase sheet dryness. An example of where this potential could be realized is a wet pressed, crescent former, tissue and towel machine of 300 inches of sheet width on the Yankee Dryer. This extreme width requires a very large diameter pressure roll to maintain the proper full width stiffness. Large diameters increase the width of the press nip and lower the average pressure in the nip. Reduced pressure results in lower post pressure roll consistency (PPRC) on the Yankee dryer. In this case, a typical PPRC might be expected to fall in about the 38-39 percent range. Incorporating LEC fibers into the furnish can make it possible to replace the pressure roll with a narrow shoe, shoe press which could realistically increase the dryness values to the 44-45 percent range without exceeding the 500 lbs/lineal inch (PLI) loading on the Yankee dryer. Moving from 38 percent to 45 percent dryness reduces the drying load from 1.6 lbs of water per lb of fiber down to 1.2 lbs/lb: a reduction of about 25 percent. It is possible that this is a conservative estimate of the savings potential since tissue and towel machines utilizing a shoe press routinely run to consistencies as high as 54 percent consistency after pressing.

However, using a shoe press alone does not automatically result in drying energy savings. A wet pressed tissue and towel machine utilizing a fabric creping step usually does not press to maximum dryness as this higher pressing can result in sheets that are too dense, too strong, and do not react to the subsequent creping steps in a way that yields the desired softness and absorbency for the grades being produced. But, when LEC is added to the furnish in such a machine, making the nascent web resistant to pressing, the tensile and density of the sheets can be controlled along with the high pressing to maintain and/or improve sheet properties while taking advantage of the much reduced drying costs. Adding these fibers to a 300 inch machine could allow the PPRC to reach or exceed 50 percent consistency while allowing the sheet to be adequately creped to produce the desired sheet properties. At a 50 percent PPRC, the drying costs would be further reduced from 1.2 lbs/lb down to just 1 lb/lb. Overall this consistency increase would reduce the drying load by about 37 percent—an amount which would be considered very significant even if only a small fraction of it were actually attained.

In response to environmental concerns, many urge that only recycled fibers should be used in tissue and towels or like paper grades that cannot be recycled. However, many consumers consider that recycle only grades exhibit a harsh feeling with low absorbency while sheets made from furnishes containing large amounts of recycled fibers can be similarly harsh and non-absorbent as well, depending on the amount of recycle fiber included. In general, this harshness may stem from the fact that most recycled fibers have been highly refined and contain large percentages of fines. Highly refined fibers are very conformable and therefore often form denser sheets than stiffer, less conformable, virgin fibers. In addition, fines can serve as a kind of "glue" often causing sheets to end up being very dense. In many cases, this density can prevent the creping process from opening these sheets up to get desired tactile properties. Treating a portion of the recycled fiber stream with the Atalla I process can produce sheets that are significantly less dense and easier to crepe making it possible to use very high amounts of recycled fibers in grades that are suitable both for the higher end of the commercial (away from home) market as well as in the consumer or retail market.

Heavier weight, flow controlled grades require both pressure and time control to get maximum water removal without "crush" sometimes referred to as sheet crushing or calendar crushing or calendar blackening—a formation disruption caused by fibers moving around in the press nip, thought to often be due to flowing water. Adding LEC fibers to these crush sensitive grades can provide a twofold advantage. First, these LEC fibers allow higher pressing levels without loss of bulk as a result of these higher loads. Secondly, as the data in Table 3 show, these treated fibers greatly increase the porosity of the sheets, thereby reducing the possibility of sheet crush in the press nip. These two effects potentially allow a paper maker to reduce drying load without sacrificing sheet formation or bulk.

When examined at high magnification using ESEM, the nanoporous fibers used in the present invention may be identified by large numbers of dark regions on the fibers having diameters between about 0.1 and 10 microns, preferably between about 0.5 and 7 microns and most preferably between about 1 and 5 microns; see FIGS. 43 B-E, FIGS. 44 B-E and FIGS. 45B-G. Preferably, these dark regions are present in a range of at least about $10^8$ regions per square meter, preferably between about $5\times10^8$ to about $10^{13}$ regions per square meter, more preferably between about $10^9$ to $10^{12}$, and most preferably between about $10^{10}$ to $10^{11}$ regions per square meter of fiber. See FIG. 45 F. It is not known at this time whether these are only darkened regions or if they are pits penetrating into the fiber. However, it is known that these darkened regions are not apparent on untreated or conventional fibers, see FIGS. 43 A, 44 A and 45A but may be readily observed on the treated fibers having the desirable properties described herein, see FIGS. 43 B-E, FIGS. 44 B-E and FIGS. 45B-G. Despite the use of the term "diameter", it can be observed that these regions are not perfect circles but are only roughly circular in shape.

Non-Woody Fibers

Fibers from sugar cane (bagasse), rice, wheat, and others, are often used in various grades of paper even though they are largely available on a seasonal basis. However, these fibers, while low in cost, are mostly shorter and finer than woody fibers; and, accordingly, sheets produced from them tend to have higher density, lower opacity, strength and noisiness. Therefore, especially considering the seasonality of availability, these fibers are at a competitive disadvantage as the sheets produced from them are not usually considered all that desirable. However, treating these fibers with the Atalla I process can significantly improve their performance in paper grades, transforming these less desirable fibers into bulky, debonding fibers that can greatly change the properties of sheets made with them. Such uses could help alleviate fiber shortages.

Environmental Concerns

Rice is one of the major food crops of the world. The process of rice production requires the removal of the straw from the fields prior to the planting of the next crop. Today in most of the world, that removal is accomplished by burning, which adds to air pollution. In California, laws require that this straw be landfilled rather than burned. Therefore, converting this unwanted straw into a desirable paper making fiber could reduce the fiber shortages experienced in growing nations, while improving air quality, conserving landfill space and providing another source of income for farmers growing these crops.

APPENDIX I

| Run No | Trial | run | Hardwood Type | Hardwood Level | Refining Time* | CSF Freeness, mL | Caliper | Bulk, cc/g | Basis Weight | TAPPI Opacity | Print Opacity |
|---|---|---|---|---|---|---|---|---|---|---|---|
| 5 | 19 | 5 | EUC | 50 | 30 | 509 | 5.13 | 2.01 | 64.70 | 80.66 | 80.16 |
| 8 | 13 | 8 | EUC | 25 | 0 | 630 | 6.17 | 2.45 | 64.01 | 80.63 | 79.82 |
| 12 | 30 | 12 | EUC | 25 | 10 | 621 | 5.22 | 2.10 | 63.17 | 79.11 | 78.56 |
| 13 | 6 | 13 | EUC | 75 | 30 | 550 | 6.02 | 2.27 | 67.29 | 84.00 | 82.79 |
| 14 | 5 | 14 | EUC | 75 | 0 | 601 | 6.03 | 2.51 | 61.14 | 82.87 | 81.57 |
| 25 | 15 | 25 | EUC | 25 | 30 | 486 | 4.44 | 1.67 | 67.44 | 77.30 | 77.46 |
| 29 | 22 | 29 | EUC | 50 | 0 | 604 | 5.98 | 2.43 | 62.62 | 81.84 | 80.92 |
| 33 | 38 | 33 | EUC | 50 | 20 | 569 | 4.86 | 1.93 | 63.98 | 80.27 | 78.57 |
| 37 | 26 | 37 | EUC | 75 | 10 | 607 | 5.87 | 2.37 | 62.83 | 82.81 | 80.70 |
| 38 | 5 | 38 | EUC | 75 | 0 | 602 | 5.98 | 2.28 | 66.51 | 84.62 | 82.83 |
| 44 | 14 | 44 | MH | 75 | 0 | 678 | 6.20 | 2.67 | 58.99 | 77.38 | 75.74 |
| 45 | 20 | 45 | MH | 50 | 0 | 670 | 6.85 | 2.64 | 65.93 | 80.36 | 78.40 |
| 46 | 8 | 46 | MH | 25 | 30 | 557 | 4.81 | 1.79 | 68.18 | 76.56 | 76.24 |
| 47 | 7 | 47 | MH | 25 | 0 | 678 | 5.94 | 2.37 | 63.57 | 78.91 | 78.38 |
| 48 | 23 | 48 | MH | 50 | 30 | 587 | 4.44 | 1.89 | 59.79 | 73.73 | 73.98 |
| 49 | 29 | 49 | MH | 75 | 20 | 656 | 5.36 | 2.47 | 55.17 | 73.63 | 73.81 |
| 50 | 27 | 50 | MH | 25 | 20 | 603 | 4.61 | 1.82 | 64.45 | 74.95 | 74.98 |
| 51 | 35 | 51 | MH | 75 | 30 | 649 | 5.41 | 2.40 | 57.29 | 75.91 | 75.41 |
| 52 | 34 | 52 | MH | 75 | 10 | 675 | 5.56 | 2.53 | 55.77 | 76.05 | 75.79 |
| 53 | 32 | 53 | MH | 25 | 10 | 648 | 4.93 | 2.01 | 62.22 | 76.22 | 75.82 |
| 4 | | 4 | MS | 75 | 0 | 722 | 8.02 | 3.11 | 65.39 | 76.72 | 75.22 |
| 6 | | 6 | MS | 50 | 0 | 712 | 7.50 | 3.04 | 62.63 | 79.20 | 77.56 |
| 9 | | 9 | MS | 25 | 30 | 624 | 4.76 | 2.03 | 59.59 | 72.91 | 72.16 |
| 11 | | 11 | MS | 25 | 0 | 696 | 6.45 | 2.71 | 60.35 | 77.41 | 76.15 |
| 15 | | 15 | MS | 50 | 30 | 688 | 6.26 | 2.50 | 63.67 | 76.54 | 75.58 |
| 20 | | 20 | MS | 75 | 20 | 720 | 7.48 | 3.35 | 56.64 | 74.72 | 74.97 |
| 24 | | 24 | MS | 25 | 20 | 664 | 5.35 | 2.05 | 66.12 | 77.20 | 76.67 |
| 1 | 4 | 1 | TH | 25 | 30 | 568 | 5.05 | 2.11 | 60.85 | 75.20 | 73.69 |
| 10 | 3 | 10 | TH | 25 | 0 | 678 | 7.15 | 2.78 | 65.25 | 79.86 | 79.35 |
| 16 | 33 | 16 | TH | 50 | 20 | 642 | 6.63 | 2.67 | 63.06 | 79.09 | 78.83 |
| 18 | 18 | 18 | TH | 50 | 0 | 686 | 8.04 | 3.18 | 64.29 | 80.17 | 79.56 |
| 21 | 16 | 21 | TH | 75 | 30 | 664 | 8.42 | 3.06 | 69.90 | 80.94 | 80.23 |
| 23 | 31 | 23 | TH | 75 | 10 | 677 | 8.59 | 3.50 | 62.30 | 80.06 | 79.24 |
| 27 | 25 | 27 | TH | 25 | 10 | 639 | 6.00 | 2.33 | 65.32 | 78.04 | 77.81 |
| 31 | 3 | 31 | TH | 25 | 0 | 673 | 6.57 | 2.63 | 63.58 | 82.02 | 78.55 |
| 34 | 4 | 34 | TH | 25 | 30 | 585 | 5.20 | 2.10 | 62.85 | 75.42 | 74.83 |

APPENDIX I-continued

| | | | | | | | | | | | |
|---|---|---|---|---|---|---|---|---|---|---|---|
| 39 | 11 | 39 | TH | 75 | 0 | 687 | 8.23 | 3.49 | 59.94 | 78.40 | 77.30 |
| 42 | 21 | 42 | TH | 50 | 30 | 631 | 6.86 | 2.59 | 67.24 | 79.46 | 77.78 |
| 2 | 36 | 2 | UNH | 25 | 20 | 559 | 4.83 | 1.88 | 65.43 | 77.70 | 76.54 |
| 3 | 17 | 3 | UNH | 50 | 30 | 476 | 4.84 | 1.91 | 64.42 | 77.86 | 75.82 |
| 7 | 2 | 7 | UNH | 25 | 30 | 479 | 4.50 | 1.77 | 64.70 | 75.05 | 75.13 |
| 17 | 37 | 17 | UNH | 75 | 20 | 543 | 5.53 | 2.10 | 66.83 | 80.28 | 79.47 |
| 19 | 1 | 19 | UNH | 25 | 0 | 622 | 6.01 | 2.35 | 64.93 | 79.52 | 78.70 |
| 22 | 12 | 22 | UNH | 50 | 0 | 617 | 6.03 | 2.25 | 68.16 | 80.43 | 79.51 |
| 26 | 9 | 26 | UNH | 75 | 0 | 572 | 5.33 | 2.16 | 62.52 | 79.82 | 79.29 |
| 28 | 2 | 28 | UNH | 25 | 30 | 487 | 4.47 | 1.79 | 63.61 | 74.70 | 73.73 |
| 35 | 24 | 35 | UNH | 25 | 10 | 614 | 4.89 | 2.00 | 62.00 | 76.48 | 75.33 |
| 36 | 28 | 36 | UNH | 75 | 10 | 569 | 5.29 | 2.12 | 63.44 | 79.51 | 78.04 |
| 40 | 1 | 40 | UNH | 25 | 0 | 636 | 6.12 | 2.27 | 68.65 | 81.10 | 78.89 |
| 41 | 10 | 41 | UNH | 75 | 30 | 531 | 5.41 | 2.07 | 66.36 | 81.92 | 78.29 |
| 1 | 6 | 54 | Recycle | 70 | 30 | 519 | 6.27 | 2.52 | 63.27 | 79.04 | 79.80 |
| 2 | 10 | 55 | Recycle | 0 | 0 | 405 | 5.15 | 1.98 | 65.95 | 78.86 | 79.62 |
| 3 | 1 | 56 | Recycle | 0 | 30 | 170 | 4.22 | 1.61 | 66.62 | 77.42 | 77.26 |
| 4 | 7 | 57 | Recycle | 70 | 0 | 552 | 6.93 | 2.66 | 66.24 | 78.48 | 78.80 |
| 5 | 2 | 58 | Recycle | 35 | 30 | 354 | 5.33 | 2.04 | 66.30 | 79.44 | 79.74 |
| 6 | 2 | 59 | Recycle | 35 | 30 | 350 | 5.35 | 2.00 | 67.73 | 78.99 | 79.69 |
| 7 | 1 | 60 | Recycle | 0 | 30 | 182 | 4.07 | 1.56 | 66.54 | 75.01 | 76.23 |
| 8 | 6 | 61 | Recycle | 70 | 30 | 502 | 6.83 | 2.56 | 67.77 | 79.92 | 80.46 |
| 9 | 4 | 62 | Recycle | 35 | 0 | 501 | 5.56 | 2.43 | 58.25 | 77.80 | 78.11 |
| 10 | 10 | 63 | Recycle | 0 | 0 | 436 | 5.16 | 2.17 | 60.29 | 78.00 | 77.72 |
| 11 | 4 | 64 | Recycle | 35 | 0 | 507 | 5.90 | 2.25 | 66.61 | 78.87 | 79.97 |
| 12 | 11 | 65 | Recycle | 100 | 30 | 613 | 7.89 | 2.95 | 67.87 | 78.94 | 79.70 |

| Run No | Trial | run | Burst | Burst Index | Porosity, sec./400 mL | Tear | Tear Index | Tensile | Tensile Index | TEA | Stretch |
|---|---|---|---|---|---|---|---|---|---|---|---|
| 5 | 19 | 5 | 17.82 | 0.2754 | 8.5 | 731.92 | 11.31 | 2.69 | 0.042 | 30.50 | 1.86 |
| 8 | 13 | 8 | 16.22 | 0.2534 | 2.8 | 673.50 | 10.52 | 1.34 | 0.021 | 13.26 | 2.39 |
| 12 | 30 | 12 | 17.03 | 0.2696 | 4.0 | 907.68 | 14.37 | 2.31 | 0.037 | 28.70 | 1.84 |
| 13 | 6 | 13 | 16.37 | 0.2433 | 3.7 | 483.76 | 7.189 | 1.47 | 0.022 | 11.49 | 1.38 |
| 14 | 5 | 14 | 14.35 | 0.2347 | 1.9 | 241.80 | 3.955 | 0.85 | 0.014 | 4.34 | 0.84 |
| 25 | 15 | 25 | 18.65 | 0.2765 | 25.7 | 721.98 | 10.71 | 4.15 | 0.062 | 57.50 | 2.10 |
| 29 | 22 | 29 | 15.64 | 0.2498 | 2.4 | 486.78 | 7.773 | 1.09 | 0.017 | 7.22 | 1.05 |
| 33 | 38 | 33 | 17.13 | 0.2678 | 5.6 | 741.58 | 11.59 | 2.17 | 0.034 | 19.28 | 1.44 |
| 37 | 26 | 37 | 15.33 | 0.2440 | 2.3 | 289.84 | 4.613 | 1.13 | 0.018 | 7.83 | 1.11 |
| 38 | 5 | 38 | 14.42 | 0.2168 | 2.1 | 313.80 | 4.718 | 1.06 | 0.016 | 4.90 | 0.78 |
| 44 | 14 | 44 | 16.09 | 0.2727 | 0.7 | 497.00 | 8.425 | 1.42 | 0.024 | 11.27 | 1.24 |
| 45 | 20 | 45 | 17.18 | 0.2606 | 1.2 | 747.26 | 11.33 | 1.68 | 0.026 | 16.78 | 1.53 |
| 46 | 8 | 46 | 43.42 | 0.6369 | 12.9 | 805.36 | 11.81 | 4.76 | 0.070 | 84.02 | 2.58 |
| 47 | 7 | 47 | 12.06 | 0.1897 | 1.8 | 852.42 | 13.41 | 1.71 | 0.027 | 20.14 | 1.77 |
| 48 | 23 | 48 | 25.38 | 0.4245 | 3.6 | 729.02 | 12.19 | 3.23 | 0.054 | 44.36 | 2.08 |
| 49 | 29 | 49 | 14.10 | 0.2557 | 1.0 | 518.60 | 9.401 | 1.80 | 0.033 | 17.96 | 1.57 |
| 50 | 27 | 50 | 35.60 | 0.5524 | 7.2 | 777.14 | 12.06 | 4.13 | 0.064 | 71.36 | 2.59 |
| 51 | 35 | 51 | 14.72 | 0.2570 | 1.2 | 598.52 | 10.45 | 2.05 | 0.036 | 26.76 | 2.13 |
| 52 | 34 | 52 | 10.53 | 0.1888 | 0.8 | 560.92 | 10.06 | 1.55 | 0.028 | 13.86 | 1.41 |
| 53 | 32 | 53 | 24.14 | 0.3880 | 4.0 | 926.16 | 14.88 | 3.10 | 0.050 | 48.68 | 2.28 |
| 4 | | 4 | 15.01 | 0.2295 | 0.4 | 374.74 | 5.731 | 0.81 | 0.012 | 6.19 | 1.25 |
| 6 | | 6 | 15.68 | 0.2504 | 0.7 | 606.84 | 9.689 | 1.11 | 0.018 | 10.36 | 1.46 |
| 9 | | 9 | 18.42 | 0.3091 | 7.4 | 774.30 | 12.99 | 3.84 | 0.064 | 52.50 | 2.08 |
| 11 | | 11 | 15.45 | 0.2561 | 1.2 | 773.92 | 12.82 | 1.30 | 0.022 | 12.11 | 1.42 |
| 15 | | 15 | 18.23 | 0.2862 | 1.5 | 817.76 | 12.84 | 2.37 | 0.037 | 36.34 | 2.23 |
| 20 | | 20 | 15.07 | 0.2661 | 0.42 | 547.98 | 9.674 | 0.93 | 0.016 | 9.13 | 1.61 |
| 24 | | 24 | 18.01 | 0.2723 | 4.0 | 897.32 | 13.57 | 3.20 | 0.048 | 52.54 | 2.42 |
| 1 | 4 | 1 | 17.88 | 0.2939 | 5.7 | 720.58 | 11.84 | 3.58 | 0.059 | 49.32 | 2.09 |
| 10 | 3 | 10 | 16.22 | 0.2486 | 1.4 | 674.60 | 10.34 | 1.18 | 0.018 | 11.66 | 1.50 |
| 16 | 33 | 16 | 17.62 | 0.2794 | 1.5 | 617.54 | 9.794 | 1.80 | 0.029 | 24.04 | 1.92 |
| 18 | 18 | 18 | 15.36 | 0.2390 | 0.8 | 427.48 | 6.649 | 0.82 | 0.013 | 5.78 | 1.10 |
| 21 | 16 | 21 | 16.30 | 0.2333 | 0.74 | 436.82 | 6.249 | 1.08 | 0.015 | 9.62 | 1.33 |
| 23 | 31 | 23 | 14.01 | 0.2248 | 0.52 | 252.36 | 4.051 | 0.61 | 0.010 | 4.36 | 1.17 |
| 27 | 25 | 27 | 17.95 | 0.2749 | 2.9 | 948.68 | 14.52 | 2.34 | 0.036 | 31.44 | 2.07 |
| 31 | 3 | 31 | 16.36 | 0.2573 | 1.8 | 699.76 | 11.01 | 1.27 | 0.020 | 11.98 | 1.43 |
| 34 | 4 | 34 | 18.75 | 0.2984 | 6.8 | 813.64 | 12.95 | 3.48 | 0.055 | 54.12 | 2.44 |
| 39 | 11 | 39 | 12.54 | 0.2092 | 0.5 | 205.70 | 3.432 | 0.51 | 0.009 | 3.03 | 0.98 |
| 42 | 21 | 42 | 17.57 | 0.2612 | 1.8 | 740.12 | 11.01 | 2.17 | 0.032 | 26.26 | 1.84 |
| 2 | 36 | 2 | 19.29 | 0.2948 | 13.9 | 816.34 | 12.48 | 4.63 | 0.071 | 72.92 | 2.47 |
| 3 | 17 | 3 | 18.31 | 0.2843 | 14.5 | 643.38 | 9.988 | 4.24 | 0.066 | 56.38 | 1.99 |
| 7 | 2 | 7 | 14.50 | 0.2241 | 19.9 | 739.96 | 11.44 | 4.43 | 0.068 | 66.02 | 1.86 |
| 17 | 37 | 17 | 17.95 | 0.2686 | 4.1 | 595.90 | 8.917 | 2.70 | 0.040 | 26.46 | 1.57 |
| 19 | 1 | 19 | 16.38 | 0.2523 | 3.1 | 932.84 | 14.367 | 1.76 | 0.027 | 18.18 | 1.54 |
| 22 | 12 | 22 | 17.29 | 0.2537 | 2.64 | 911.86 | 13.38 | 1.86 | 0.027 | 17.50 | 1.44 |
| 26 | 9 | 26 | 17.52 | 0.2802 | 3.7 | 624.56 | 9.990 | 2.08 | 0.033 | 18.42 | 1.40 |
| 28 | 2 | 28 | 19.07 | 0.2998 | 26.9 | 692.08 | 10.88 | 4.37 | 0.069 | 68.52 | 2.34 |
| 35 | 24 | 35 | 18.01 | 0.2904 | 6.7 | 909.78 | 14.67 | 3.20 | 0.052 | 45.84 | 2.10 |
| 36 | 28 | 36 | 17.90 | 0.2822 | 4.7 | 718.60 | 11.33 | 2.42 | 0.038 | 26.22 | 1.66 |
| 40 | 1 | 40 | 17.56 | 0.2557 | 3.0 | 1027.18 | 14.96 | 2.17 | 0.032 | 27.36 | 1.79 |
| 41 | 10 | 41 | 19.22 | 0.2897 | 6.5 | 681.76 | 10.27 | 3.27 | 0.049 | 37.62 | 1.73 |

APPENDIX I-continued

| | | | | | | | | | | | |
|---|---|---|---|---|---|---|---|---|---|---|---|
| 1 | 6 | 54 | 10.22 | 0.1615 | L5 | 413.26 | 6.531 | 1.52 | 0.024 | 23.00 | 2.13 |
| 2 | 10 | 55 | 15.12 | 0.2293 | 4.3 | 558.18 | 8.463 | 2.01 | 0.031 | 31.24 | 2.22 |
| 3 | 1 | 56 | 35.04 | 0.5260 | 86.2 | 486.82 | 7.308 | 4.14 | 0.062 | 70.14 | 2.49 |
| 4 | 7 | 57 | <7 | | 0.8 | 309.32 | 4.670 | 0.93 | 0.014 | 10.22 | 1.66 |
| 5 | 2 | 58 | 19.67 | 0.2966 | 9.5 | 488.24 | 7.364 | 2.70 | 0.041 | 47.36 | 2.55 |
| 6 | 2 | 59 | 19.26 | 0.2844 | 7.1 | 495.56 | 7.316 | 2.43 | 0.036 | 35.90 | 2.08 |
| 7 | 1 | 60 | 32.42 | 0.4873 | 69.2 | 460.34 | 6.919 | 4.03 | 0.061 | 69.14 | 2.50 |
| 8 | 6 | 61 | 9.95 | 0.1469 | 1.7 | 411.74 | 6.076 | 1.48 | 0.022 | 20.70 | 2.00 |
| 9 | 4 | 62 | 9.04 | 0.1552 | 1.5 | 467.76 | 8.030 | 1.30 | 0.022 | 15.74 | 1.75 |
| 10 | 10 | 63 | 14.69 | 0.2437 | 6.2 | 548.02 | 9.090 | 1.99 | 0.033 | 29.68 | 2.11 |
| 11 | 4 | 64 | 9.82 | 0.1475 | 1.8 | 436.86 | 6.559 | 1.44 | 0.022 | 18.16 | 1.81 |
| 12 | 11 | 65 | <7 | | 0.5 | 231.36 | 3.409 | 0.68 | 0.010 | 6.79 | 1.50 |

*Valley Beater Refining Time for Only the NWSK Portion of the Fiber Blend, TN = LEC derived from NHWK: UNH = untreated NHWK.

APPENDIX II

Summary Table Data Second Trials

| Run | NSWK | LEC | Beat Time, min | CSF, ml | Caliper, 0.001 in | Caliper/Bwt cc/g | Basis Weight, gsm | TAPPI Opacity | Print Opacity | Burst, psi |
|---|---|---|---|---|---|---|---|---|---|---|
| 1-0 | 100% | 0% | 0 | 667 | 5.94 | 2.44 | 61.94 | 79.23 | 79.19 | 10.59 |
| 1-1 | 100% | 0% | 5 | 650 | 5.49 | 2.09 | 66.78 | 79.04 | 78.6 | 25.35 |
| 1-2 | 100% | 0% | 15 | 560 | 4.88 | 1.72 | 71.99 | 76.61 | 75.96 | 52.39 |
| 1-3 | 100% | 0% | 30 | 447 | 4.27 | 1.61 | 67.53 | 72.36 | 70.9 | 62.07 |
| 1-4 | 100% | 0% | 45 | 331 | 4.27 | 1.66 | 65.45 | 70.14 | 71.56 | 68.12 |
| 1-5 | 100% | 0% | 60 | 241 | 3.99 | 1.49 | 67.94 | 67.37 | 69.09 | 66.09 |
| 6-0 | 95% | 5% | 0 | 694 | 6.54 | 2.61 | 63.58 | 81.53 | 79.13 | 8.38 |
| 7-0 | 90% | 10% | 0 | 706 | 6.47 | 2.61 | 62.94 | 79.46 | 78.04 | 8.11 |
| 8-0 | 85% | 15% | 0 | 700 | 7.17 | 2.79 | 65.25 | 80.12 | 78.81 | 9.63 |
| 9-0 | 80% | 20% | 0 | 714 | 7.01 | 2.75 | 64.66 | 80.12 | 78.68 | 10.29 |
| 2-0 | 75% | 25% | 0 | 705 | 7.4 | 2.90 | 64.89 | 80.85 | 80.13 | 14.5 |
| 2-1 | 75% | 25% | 5 | 665 | 6.07 | 2.36 | 65.44 | 79.54 | 78.66 | 21.67 |
| 2-2 | 75% | 25% | 15 | 589 | 4.94 | 2.06 | 61.03 | 74.54 | 74.1 | 39.76 |
| 2-3 | 75% | 25% | 30 | 497 | 4.36 | 1.85 | 59.76 | 71.08 | 71.81 | 49.19 |
| 2-4 | 75% | 25% | 45 | 397 | 4.17 | 1.78 | 59.42 | 69.52 | 70.54 | 52.73 |
| 2-5 | 75% | 25% | 60 | 273 | 3.84 | 1.65 | 59.16 | 68.42 | 70.01 | 57.57 |
| 3-0 | 50% | 50% | 0 | 711 | 8.98 | 3.71 | 61.49 | 78.79 | 78.04 | 14.09 |
| 3-1 | 50% | 50% | 5 | 700 | 7.61 | 3.01 | 64.13 | 80.99 | 79.93 | 15.44 |
| 3-2 | 50% | 50% | 15 | 632 | 5.88 | 2.35 | 63.5 | 77.06 | 76.76 | 31.28 |
| 3-3 | 50% | 50% | 30 | 538 | 5.01 | 1.97 | 64.71 | 75.52 | 75.47 | 44.68 |
| 3-4 | 50% | 50% | 45 | 405 | 4.36 | 1.83 | 60.61 | 72.37 | 73.01 | 47.5 |
| 3-5 | 50% | 50% | 60 | 294 | 4.27 | 1.79 | 60.43 | 70.63 | 71.63 | 51.16 |
| 4-0 | 25% | 75% | 0 | 717 | 9.77 | 4.04 | 61.38 | 77.95 | 77.88 | 13.9 |
| 4-1 | 25% | 75% | 5 | 685 | 7.44 | 3.30 | 57.32 | 76.83 | 76.18 | 10.05 |
| 4-2 | 25% | 75% | 15 | 661 | 6.06 | 2.69 | 57.26 | 75.46 | 75.09 | 17.52 |
| 4-3 | 25% | 75% | 30 | 571 | 5.07 | 2.23 | 57.62 | 73.7 | 73.35 | 30.03 |
| 4-4 | 25% | 75% | 45 | 456 | 4.52 | 2.12 | 54.06 | 70.02 | 70.68 | 34.24 |
| 4-5 | 25% | 75% | 60 | 311 | 3.78 | 1.80 | 53.41 | 69.54 | 70.51 | 40.97 |
| 5-0 | 0% | 100% | 0 | 721 | 12.16 | 5.18 | 59.58 | 76.62 | 76.49 | 13.68 |
| 5-1 | 0% | 100% | 5 | 724 | 7.9 | 3.25 | 61.75 | 79.52 | 78.69 | 13.66 |
| 5-2 | 0% | 100% | 15 | 691 | 7.8 | 3.17 | 62.54 | 80.22 | 78.35 | 9.41 |
| 5-3 | 0% | 100% | 30 | 667 | 5.88 | 2.38 | 62.84 | 77.15 | 76.39 | 24.08 |
| 5-4 | 0% | 100% | 45 | 593 | 5.13 | 2.14 | 60.8 | 75.86 | 75.4 | 38.16 |
| 5-5 | 0% | 100% | 60 | 464 | 4.39 | 1.92 | 58.2 | 72.59 | 72.76 | 42.71 |

| Run | Burst Index, Burst/Bwt | Porosity, secs | Tear, mN | Tear Index, Tear/Bwt | Tensile, (kN/m) | Tensile Index, Tensile/Bwt | Tensile Index × 1000 | TEA | Stretch, % 1 in gap |
|---|---|---|---|---|---|---|---|---|---|
| 1-0 | 0.171 | 0.01 | 846 | 13.662 | 1.47 | 0.024 | 23.733 | 19.55 | 1.86 |
| 1-1 | 0.380 | 0.025 | 1331 | 19.929 | 3.1 | 0.046 | 46.421 | 46.04 | 2.58 |
| 1-2 | 0.728 | 0.1 | 1025 | 14.242 | 5.81 | 0.081 | 80.706 | 113.9 | 3.26 |
| 1-3 | 0.919 | 0.328 | 715 | 10.587 | 6.59 | 0.098 | 97.586 | 134.48 | 3.13 |
| 1-4 | 1.041 | 1.411 | 723 | 11.042 | 7.06 | 0.108 | 107.869 | 139.54 | 3.1 |
| 1-5 | 0.973 | 5.414 | 703 | 10.340 | 7.47 | 0.110 | 109.950 | 168.44 | 3.53 |
| 6-0 | 0.132 | 0.00753 | 816 | 12.829 | 1.25 | 0.020 | 19.660 | 10.93 | 1.42 |
| 7-0 | 0.129 | 0.00607 | 808 | 12.838 | 1.19 | 0.019 | 18.907 | 11.94 | 1.59 |
| 8-0 | 0.148 | 0.00587 | 825 | 12.650 | 1.25 | 0.019 | 19.157 | 12.98 | 1.55 |
| 9-0 | 0.159 | 0.00587 | 761 | 11.765 | 1.14 | 0.018 | 17.631 | 9.86 | 1.39 |
| 2-0 | 0.223 | 0.00407 | 753 | 11.611 | 1 | 0.015 | 15.411 | 10.68 | 1.77 |
| 2-1 | 0.331 | 0.0114 | 1247 | 19.056 | 2.51 | 0.038 | 38.356 | 42.44 | 2.39 |
| 2-2 | 0.651 | 0.0404 | 870 | 14.257 | 3.97 | 0.065 | 65.050 | 76.46 | 2.94 |
| 2-3 | 0.823 | 0.1476 | 738 | 12.354 | 5.18 | 0.087 | 86.680 | 90.86 | 2.81 |
| 2-4 | 0.887 | 0.5208 | 654 | 11.011 | 5.66 | 0.095 | 95.254 | 100.1 | 2.67 |
| 2-5 | 0.973 | 1.83 | 592 | 10.014 | 6.32 | 0.107 | 106.829 | 114.66 | 2.75 |
| 3-0 | 0.229 | 0.0022 | 448 | 7.287 | 0.59 | 0.010 | 9.595 | 5.13 | 1.48 |
| 3-1 | 0.241 | 0.00627 | 1187 | 18.511 | 1.81 | 0.028 | 28.224 | 27.14 | 2.15 |

APPENDIX II-continued

Summary Table Data Second Trials

| | | | | | | | | | |
|---|---|---|---|---|---|---|---|---|---|
| 3-2 | 0.493 | 0.0147 | 1118 | 17.604 | 3.18 | 0.050 | 50.079 | 61.7 | 2.78 |
| 3-3 | 0.690 | 0.096 | 942 | 14.556 | 4.56 | 0.070 | 70.468 | 88.48 | 3.06 |
| 3-4 | 0.784 | 0.351 | 836 | 13.789 | 4.91 | 0.081 | 81.010 | 86.78 | 2.8 |
| 3-5 | 0.847 | 1.051 | 756 | 12.513 | 5.25 | 0.087 | 86.877 | 98.06 | 2.96 |
| 4-0 | 0.226 | 0.0016 | 325 | 5.302 | 0.38 | 0.006 | 6.191 | 3.6 | 1.71 |
| 4-1 | 0.175 | 0.0028 | 650 | 11.338 | 0.97 | 0.017 | 16.923 | 12.12 | 1.92 |
| 4-2 | 0.306 | 0.00567 | 995 | 17.384 | 2 | 0.035 | 34.928 | 31.12 | 2.26 |
| 4-3 | 0.521 | 0.0212 | 859 | 14.907 | 3.09 | 0.054 | 53.627 | 63.56 | 2.97 |
| 4-4 | 0.633 | 0.0837 | 734 | 13.579 | 3.45 | 0.064 | 63.818 | 71.22 | 3 |
| 4-5 | 0.767 | 0.593 | 627 | 11.740 | 4.24 | 0.079 | 79.386 | 97.18 | 3.46 |
| 5-0 | 0.230 | 0.001 | 86 | 1.439 | 0 | 0.000 | 0.000 | * | * |
| 5-1 | 0.221 | 0.0026 | 317 | 5.126 | 0.61 | 0.010 | 9.879 | 5.71 | 1.52 |
| 5-2 | 0.150 | 0.00267 | 801 | 12.807 | 1.25 | 0.020 | 19.987 | 14.55 | 1.71 |
| 5-3 | 0.383 | 0.00673 | 1244 | 19.797 | 2.48 | 0.039 | 39.465 | 47.94 | 2.68 |
| 5-4 | 0.628 | 0.0245 | 887 | 14.586 | 3.46 | 0.057 | 56.908 | 84.32 | 3.5 |
| 5-5 | 0.734 | 0.0954 | 689 | 11.832 | 4.16 | 0.071 | 71.478 | 107.32 | 3.68 |

Low grades fibers such as those derived from recycle sources appear to be greatly improved by converting a portion of the cellulose fibers therein to laterally expanded cellulose.

Example 2

Figure 28:
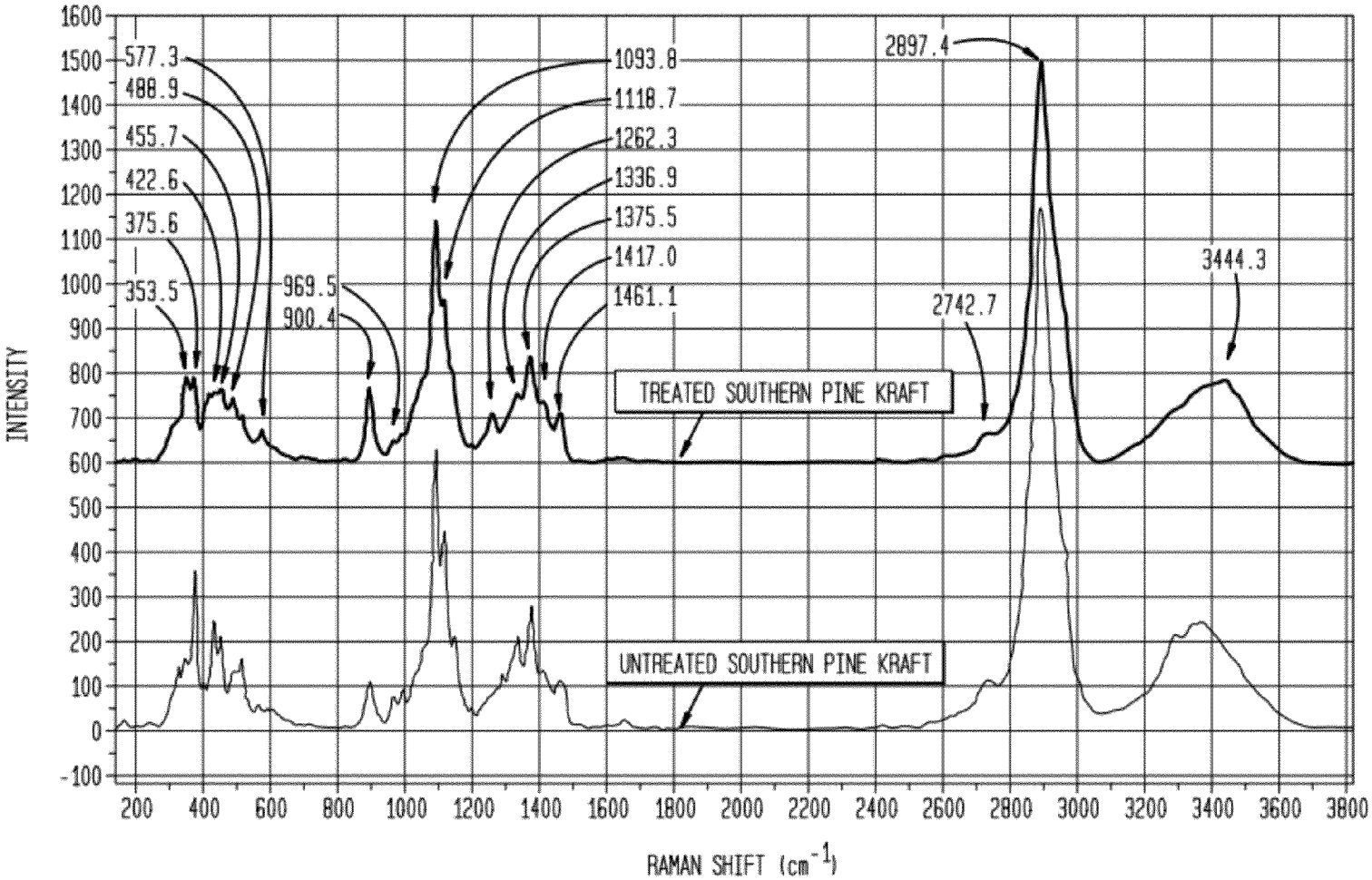
FIGS. 28-32 present Raman spectra obtained from various cellulosic fiber sources before and after treatment to convert the cellulose therein to nanoporous cellulose.

Southern pine kraft was treated as in Example 1 and the Raman spectrum therefor was measured. The results comparing treated to untreated pulp are shown in FIG. 28.

Example 3

Figure 29:
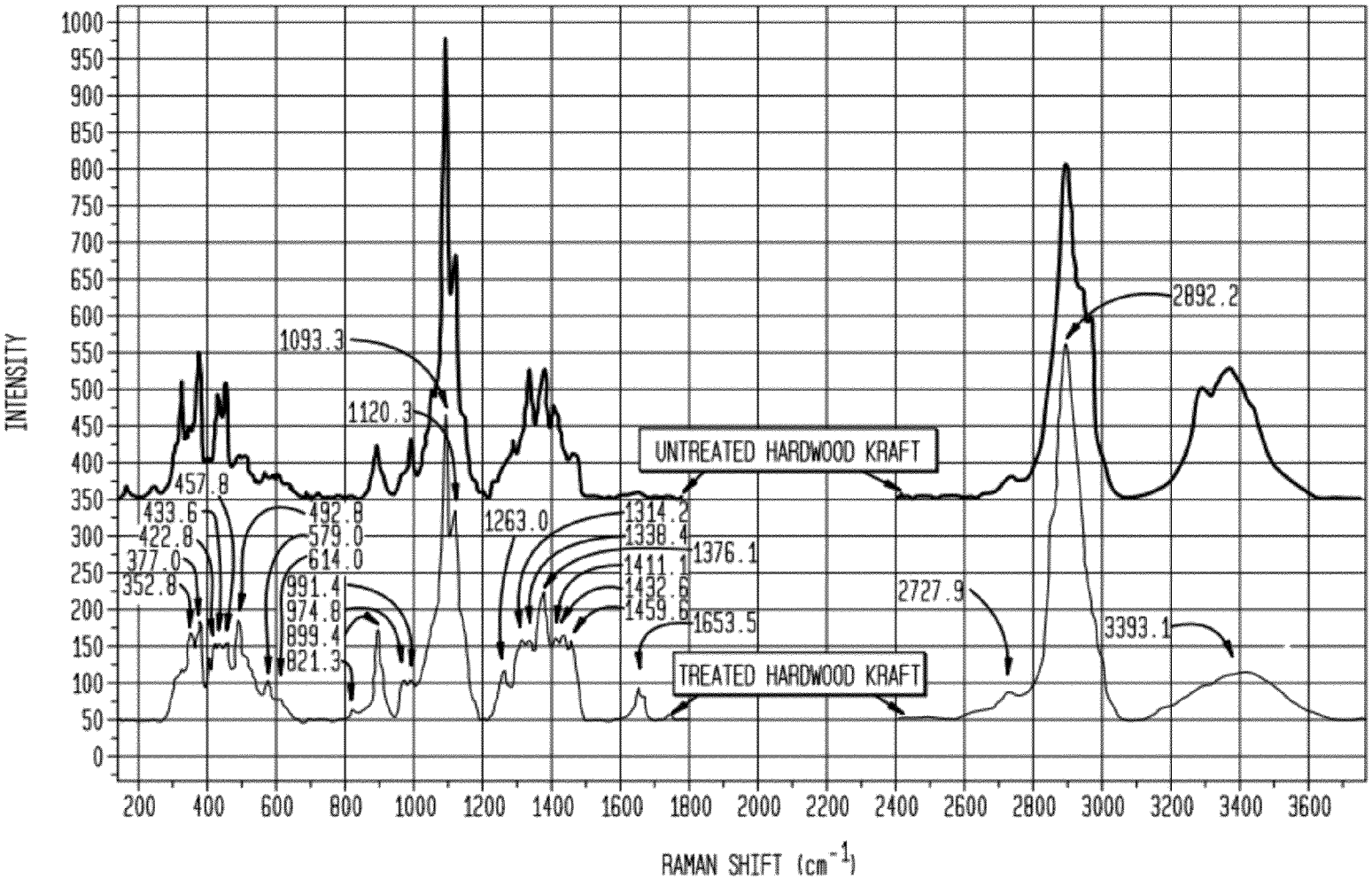

Northern Hardwood Kraft was treated as in Example 1, and the Raman spectrum therefor was measured. The results comparing treated to untreated pulp are shown in FIG. 29.

Example 4

Figure 30:
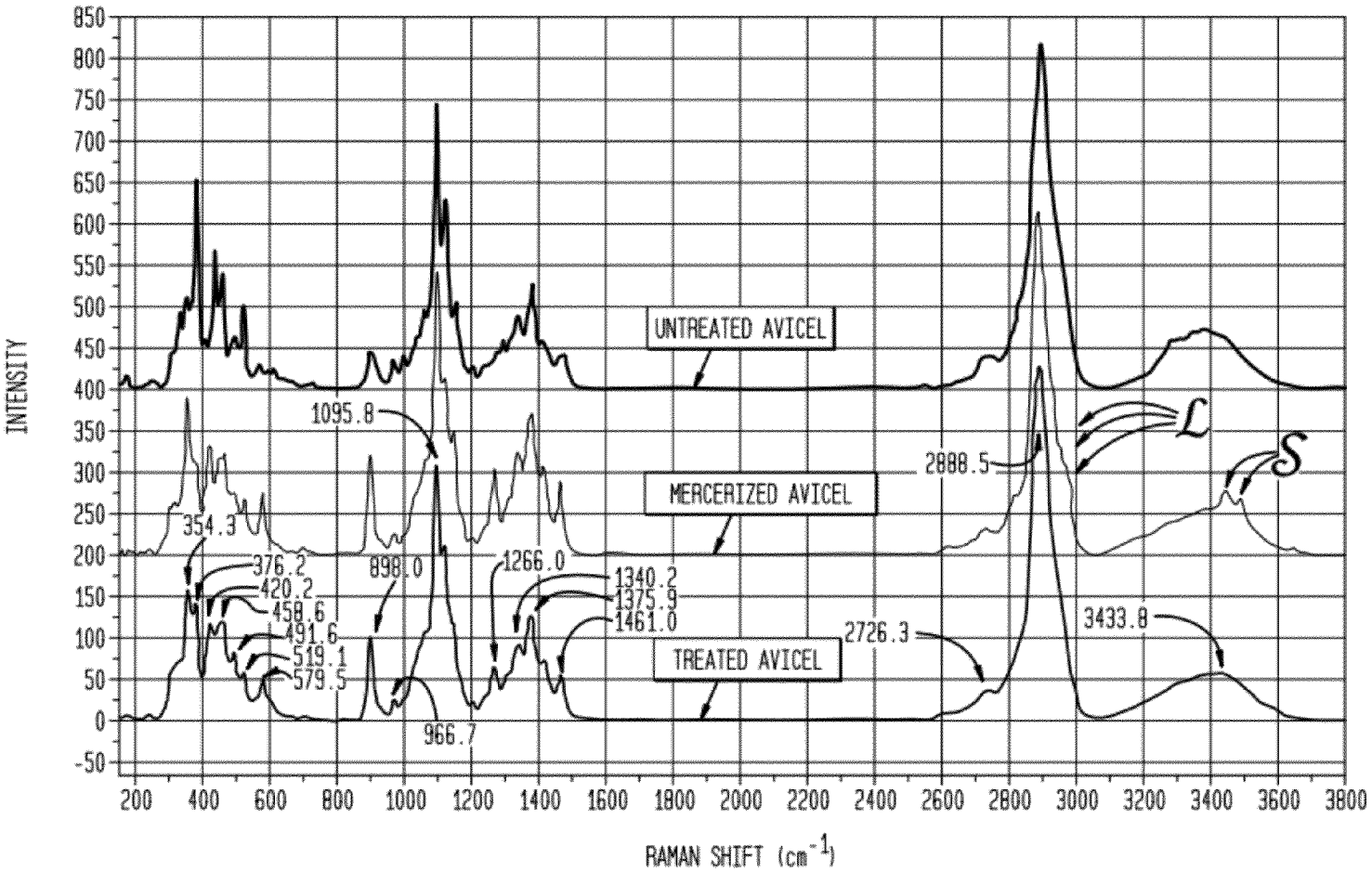

Avicel crystalline cellulose was treated as in Example 1, and the Raman spectrum therefor was measured. The results comparing treated Avicel to Cellulose I and Cellulose II are shown in FIG. 30. On the right hand side of the peak near 2888 for the mercerized Avicel, a group of three ledges L can be perceived at about halfway up the peak while a pair of sawteeth S can be perceived between 3400 and 3500 $cm^{-1}$. These particular conformations appear to be peculiar to mercerized cellulose and in cases of doubt can be used to distinguish the Raman spectrum of mercerized cellulose from nanoporous, laterally expanded, cellulose in which the descent from the peak near 2888 $cm^{-1}$ is smooth and without inflection points and only one local maximum is observed between 3200 $cm^{-1}$ and 3600 $cm^{-1}$.

Example 5

Figure 31:
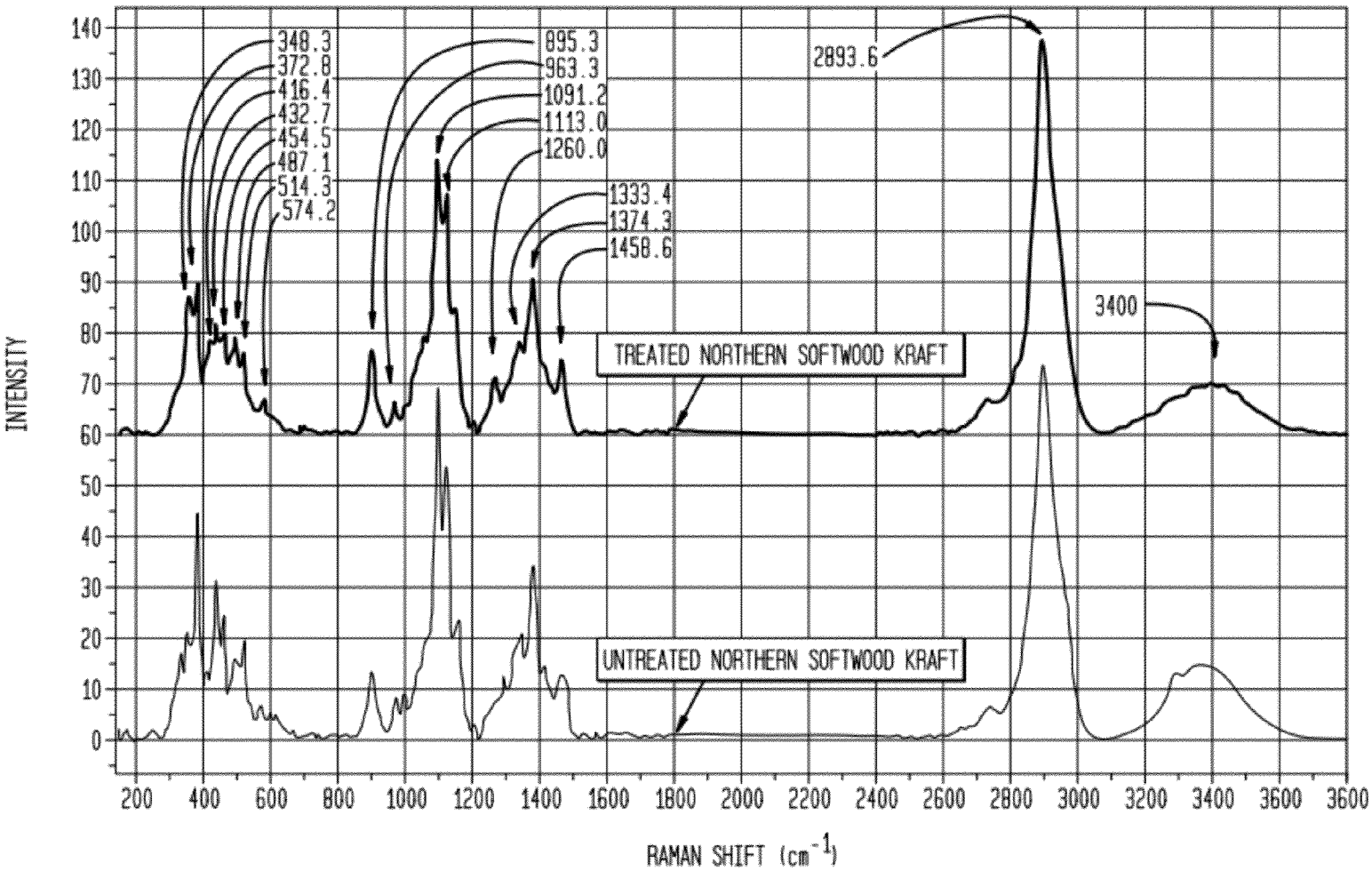

Northern Bleached Softwood Kraft was treated as in Example 1, and the Raman spectrum therefor was measured. The results comparing treated to untreated pulp are shown in FIG. 31.

Table 4 below compares the width at half height of characteristic bands in these spectra. It can be appreciated that, in general but with some exceptions, the effect of treatment is to widen the characteristic bands by merging the peaks therein relative to the untreated fiber source.

TABLE 4

Widths of Characteristic bands at Half Height

| | Band | | | | | | | | |
|---|---|---|---|---|---|---|---|---|---|
| Pulp | 250 $cm^{-1}$-400 $cm^{-1}$ | | | 400 $cm^{-1}$-600 $cm^{-1}$ | | | 1100 $cm^{-1}$ | | |
| Source | Tr. | Un-Tr. | Ratio | Tr. | Un-Tr. | ratio | Tr. | UN-Tr. | ratio |
| S Pine | 51.87 | 20.5 | 2.53 | 70.2 | 43.6.6 | 1.61 | 51.2 | 47.2 | 1.085 |
| NHWK | 75.1 | 64.3 | 1.16 | 71.8 | 49.6 | 1.45 | 63 | 44.2 | 1.43 |
| Avicel | 47.6 | 14.1 | 3.37 | 81.0 | 40.5 | 2.00 | 47.6 | 44.0 | 1.08 |
| NBSK | 51.6 | 14.1 | 3.66 | 66.2 | 46.9 | 1.41 | 53.1 | 45.3 | 1.17 |

Example 6

Figure 32:
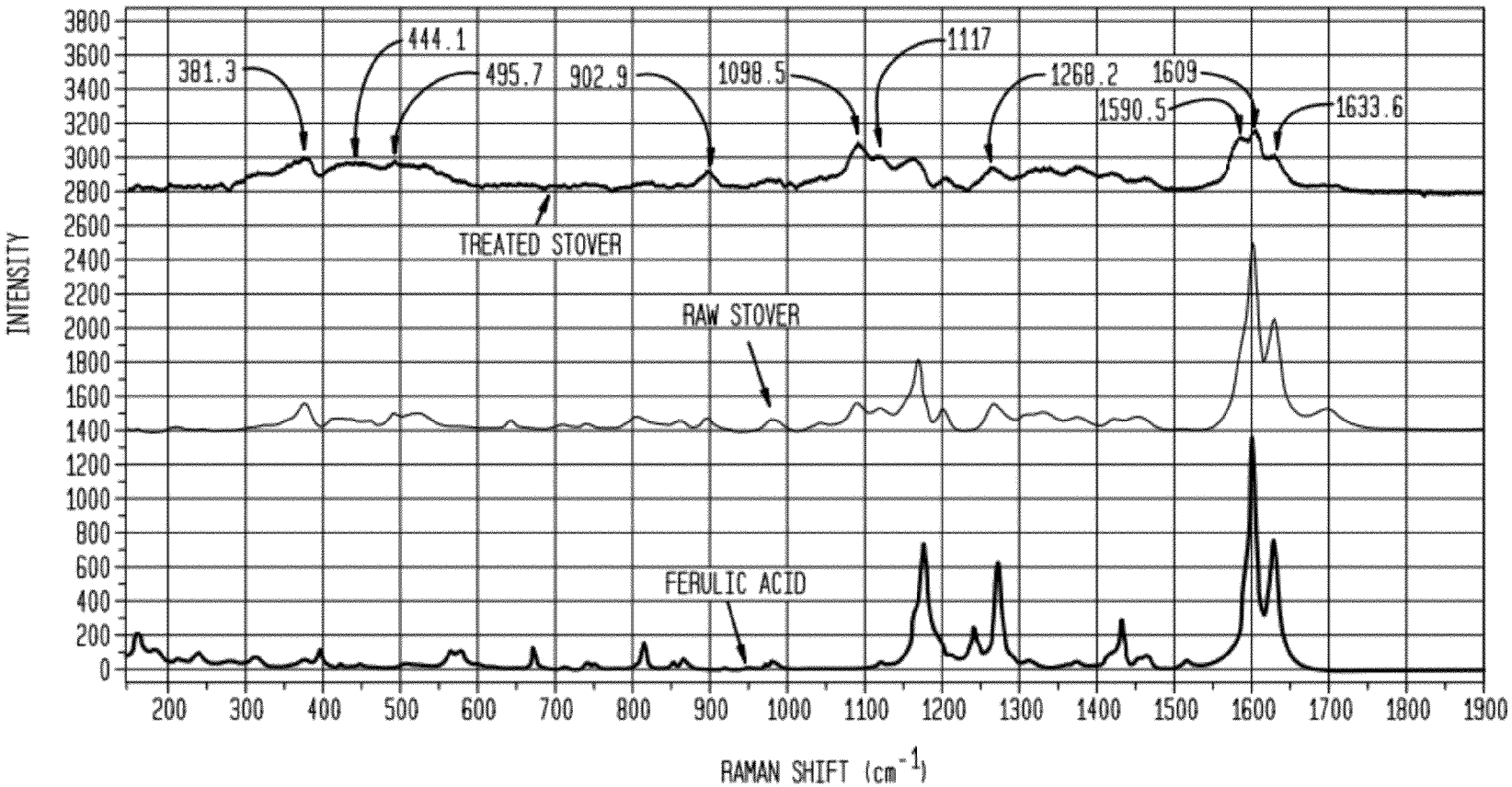
Figure 33:
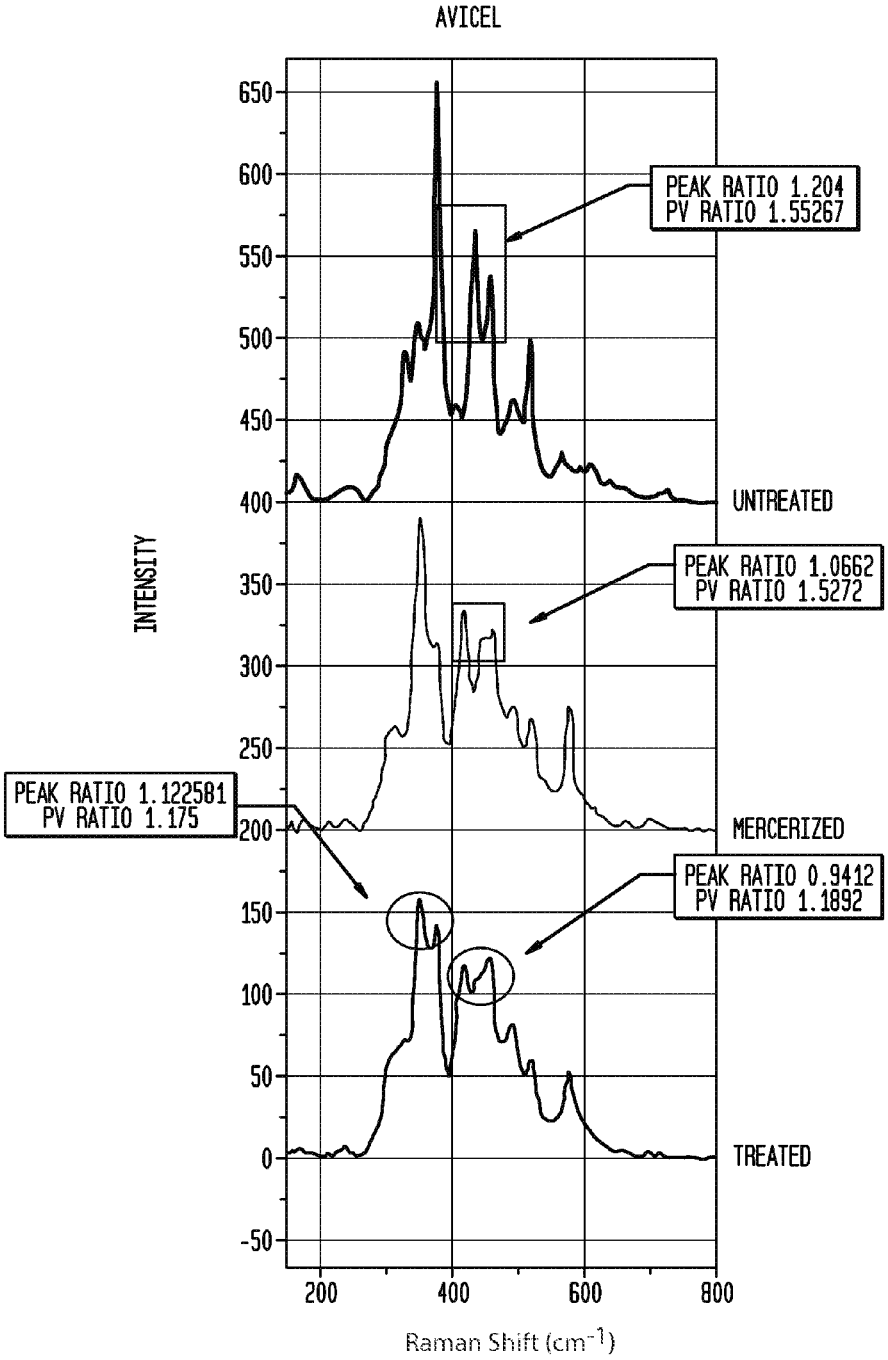
FIGS. 33-36 present enlarged views of the Raman spectra of treated and untreated fibers derived from Avicel, southern pine, Northern softwood kraft and hardwood kraft in the range of from about 200 to about 600 $cm^{-1}$, illustrating the ratio of the heights of the peaks and the peak to valley ratio of the doublets exhibited by the treated fiber as compared to the far more differentiated structures exhibited in the untreated fibers.
Figure 34:
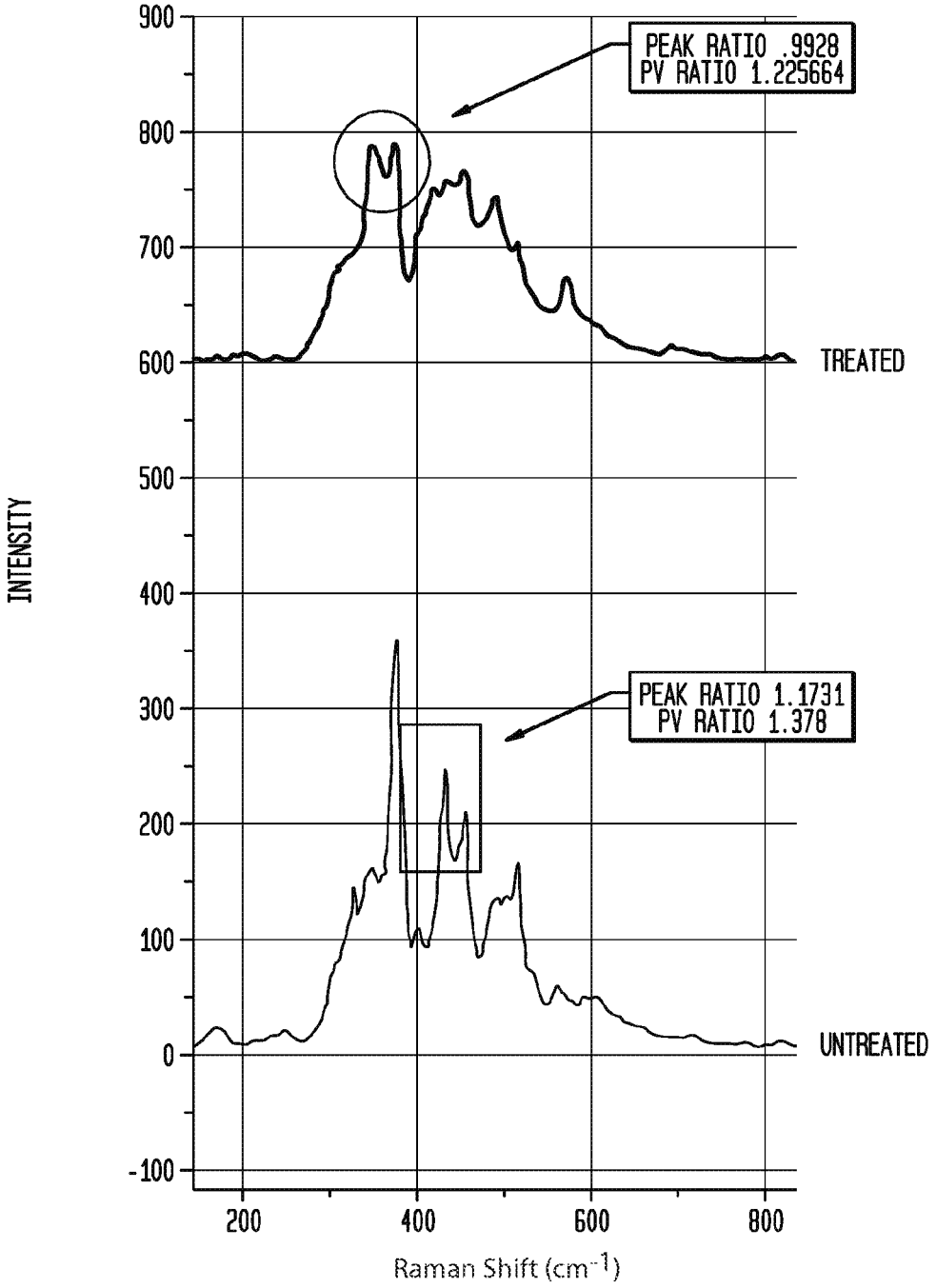
Figure 35:
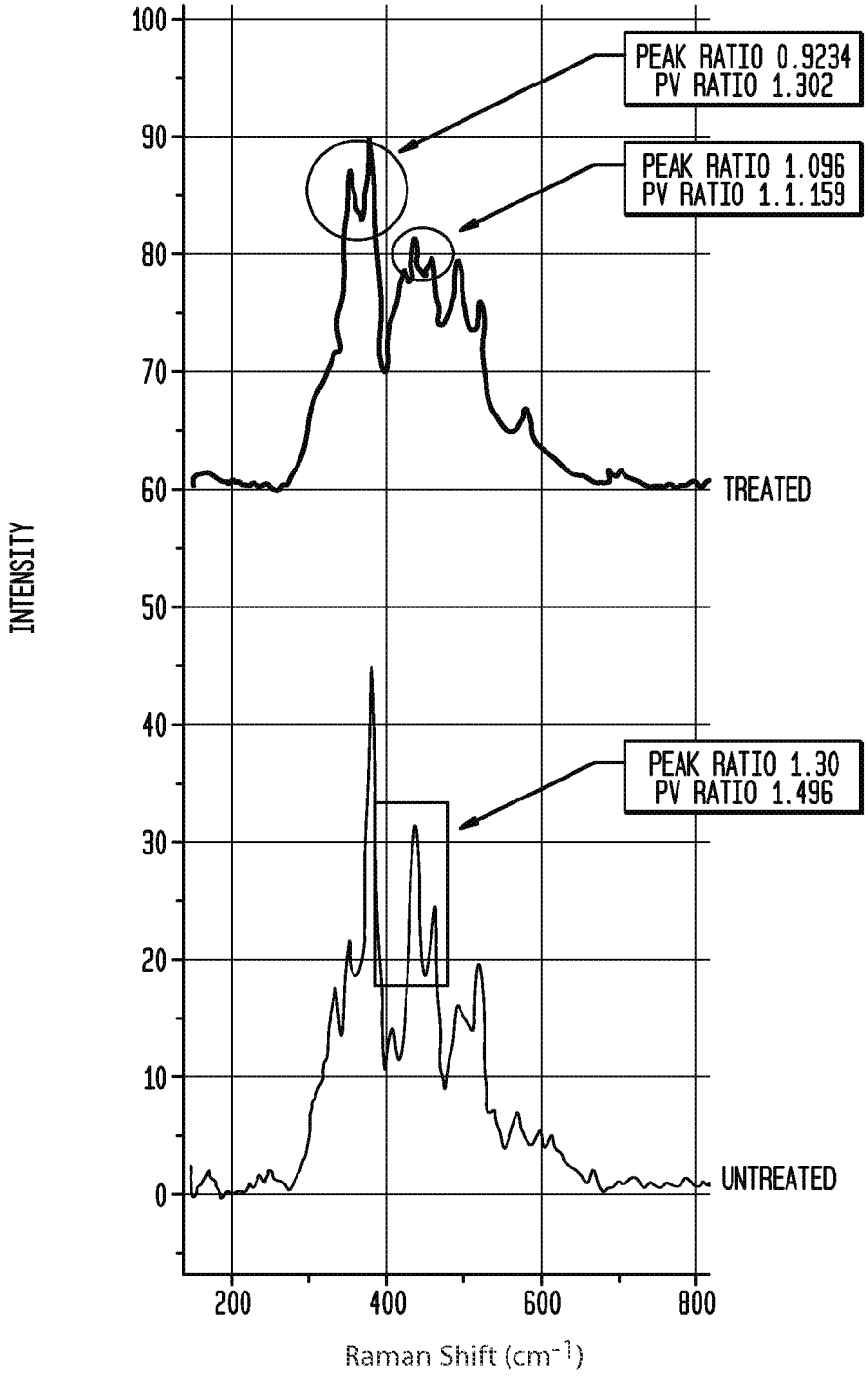
Figure 36:
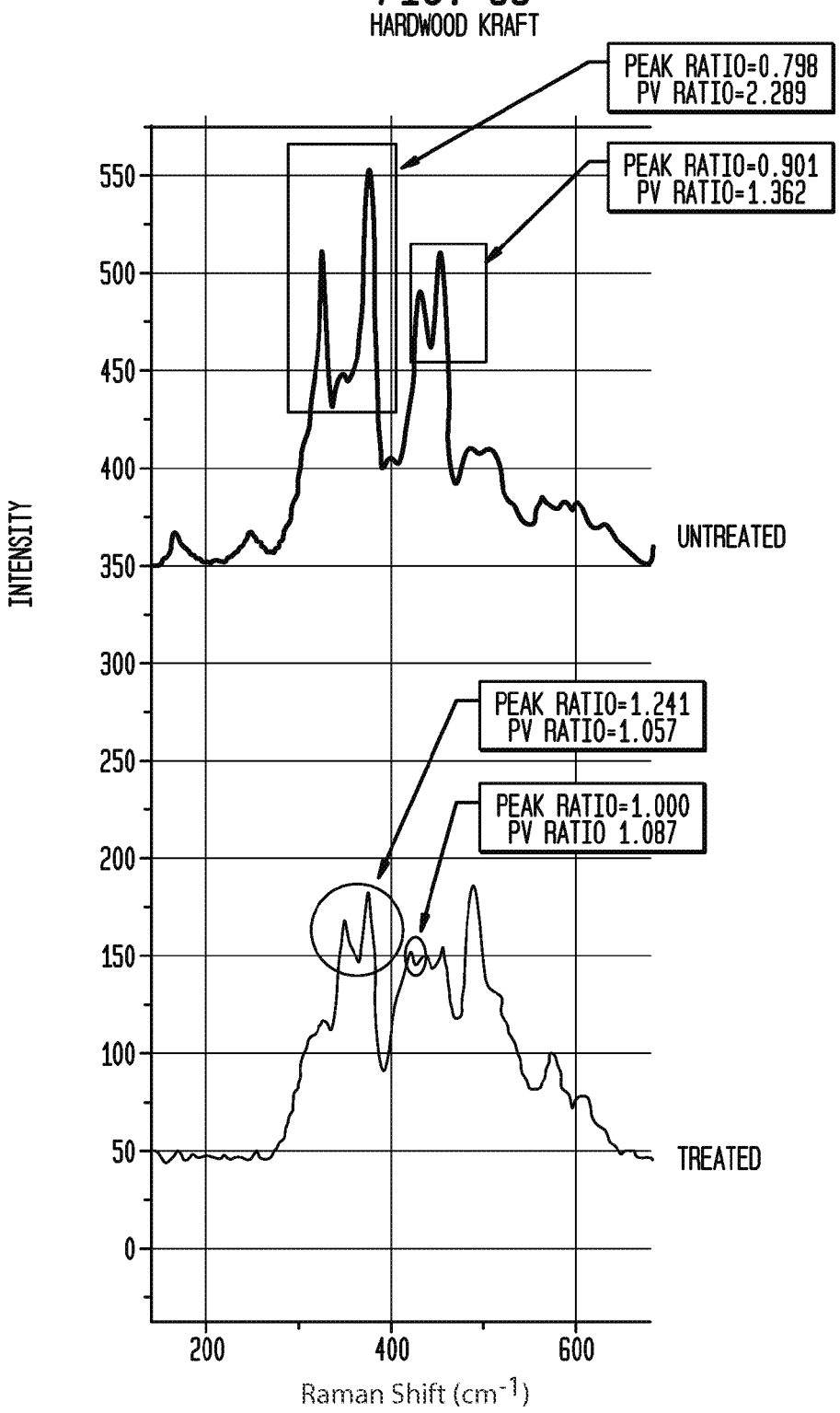

Corn Stover was treated as in Example 1, and the Raman spectrum therefor was measured. The results comparing treated to untreated stover and ferulic acid are shown in FIG. 32. It can be appreciated that ferulic acid is extracted without undue degradation making this potentially a valuable source of ferulic acid as a by-product, or perhaps the main product, of the process of treating corn stover.

Table 5 presents the locations of the characteristic peaks in the Raman spectra of the nanoporous cellulose fibers treated herein while Table 5A presents the widths of the characteristic peaks at half height with overlapping peaks being counted as one peak when the spectrum remains above half the height of the tallest peak throughout.

FIGS. 33-36 focus in on the portion of the Raman spectrum between 200 and 600 $cm^{-1}$. It can be appreciated that each spectrum of treated fiber exhibits at least one doublet closely adjacent to 400 $cm^{-1}$, each except for Southern pine exhibiting a doublet just above and just below, the presence of a doublet in this band being characteristic of laterally expanded cellulose, or if you will—nanoporous cellulose. While it is expected that those working with Raman spectra will instantly be able to distinguish doublets, Table 5B illustrates the differences between the doublets formed in the treated celluloses with the peaks in the same wave number range in untreated cellulose.

For these samples, it can be observed that:

the peak to peak ratio (ratio of the height of adjacent peaks) in the treated celluloses are all less than 1.25, with each exhibiting at least one doublet having a peak to peak ratio of less than about 1.2, preferably less than 1.15, and most preferably less than 1.1; and the peak to valley ratio of each doublet is less than 1.35, with each exhibiting at least one doublet with a peak to valley ratio of less than 1.2 and preferably less than 1.1.

In contrast, it can be appreciated that, in the untreated cellulose samples:

the peak to peak ratio exceeds 1.1 and the peak to valley ratio exceeds 1.35.

None of these untreated celluloses exhibit adjacent peaks in this area with a peak to peak ratio of less than 1.25 and a peak to valley ratio of less than 1.25, while each of these treated celluloses had at least one pair of adjacent peaks with a peak to peak ratio of less than 1.1 and a peak to valley ratio of less than 1.25.

Figure 1A:
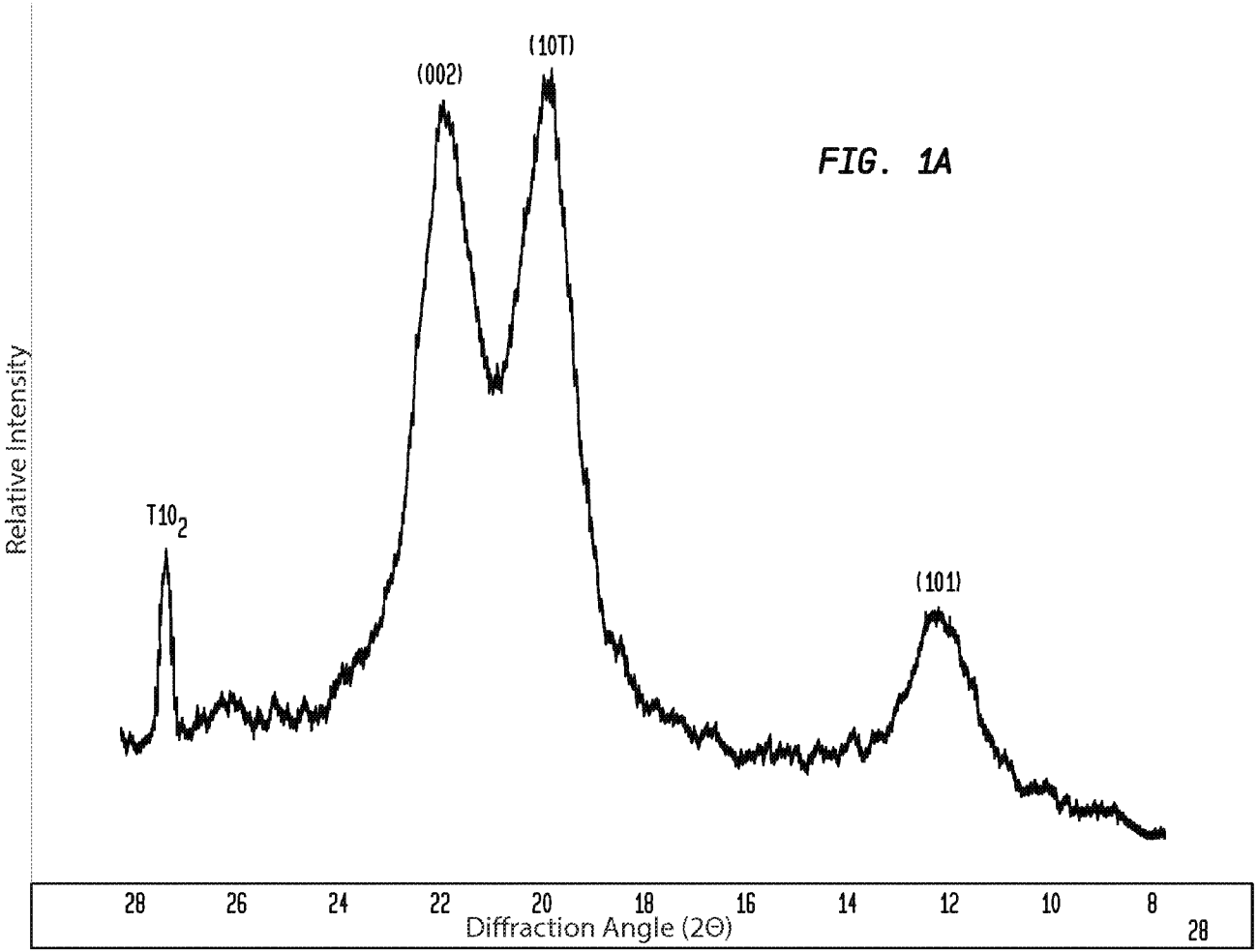
FIG. 1A is an X-Ray diffractogram illustrating the X-Ray diffraction pattern of Cellulose II pulp.
Figure 37:
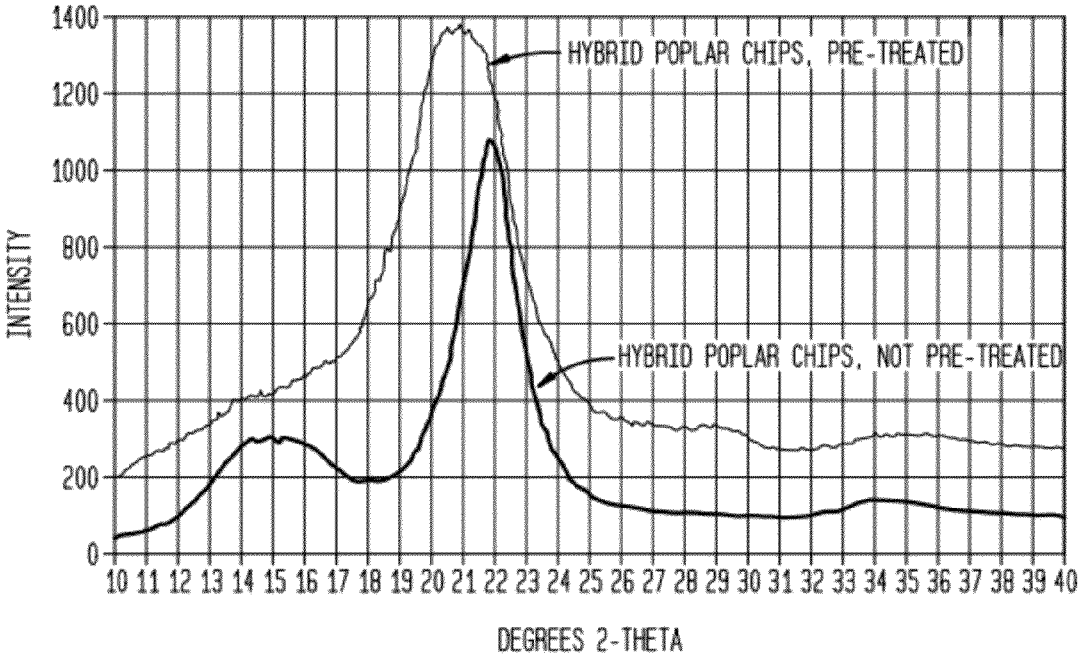
FIGS. 37-40 illustrate X-ray diffractograms of treated and untreated cellulose fibers obtained from Poplar chips, Nekoosa hardwood chips, Northern Bleached Softwood Kraft and Deer Corn stover respectively.
Figure 38:
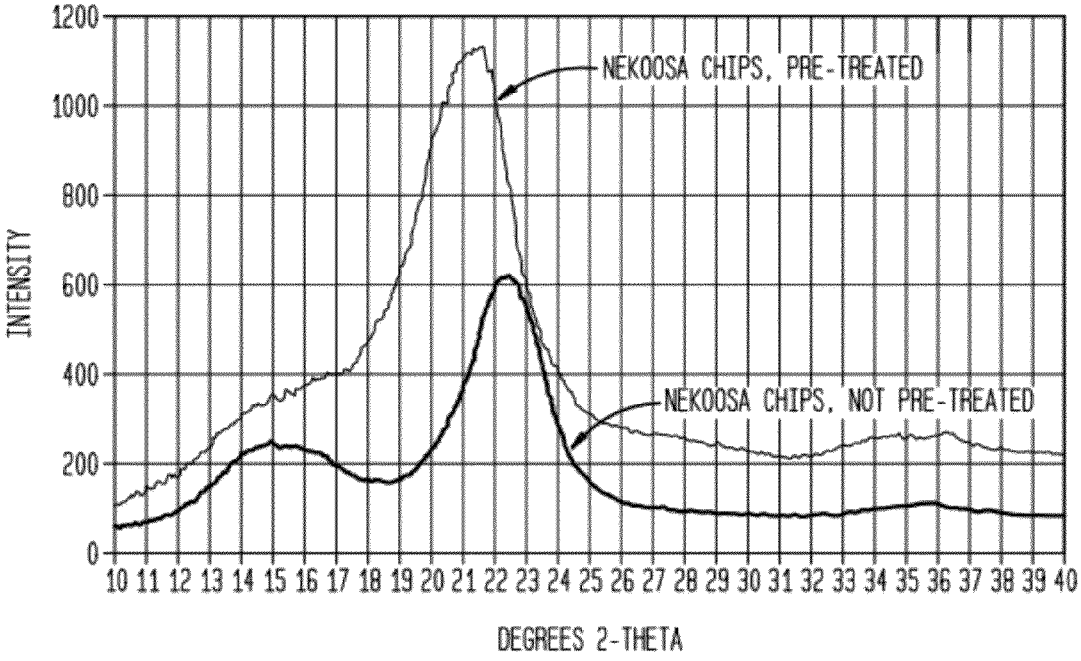
Figure 39:
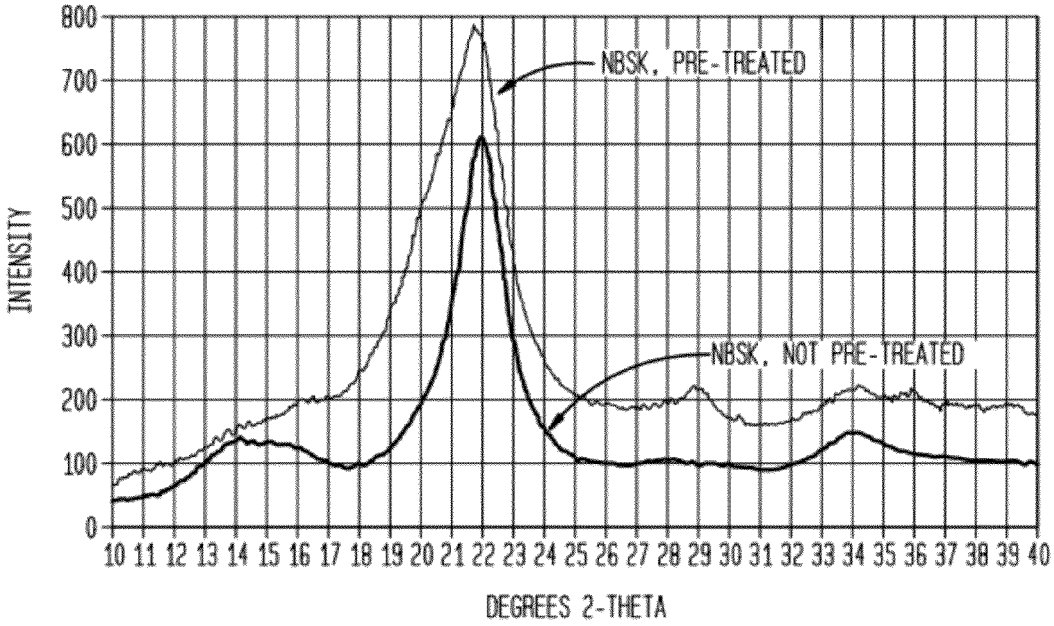
Figure 40:
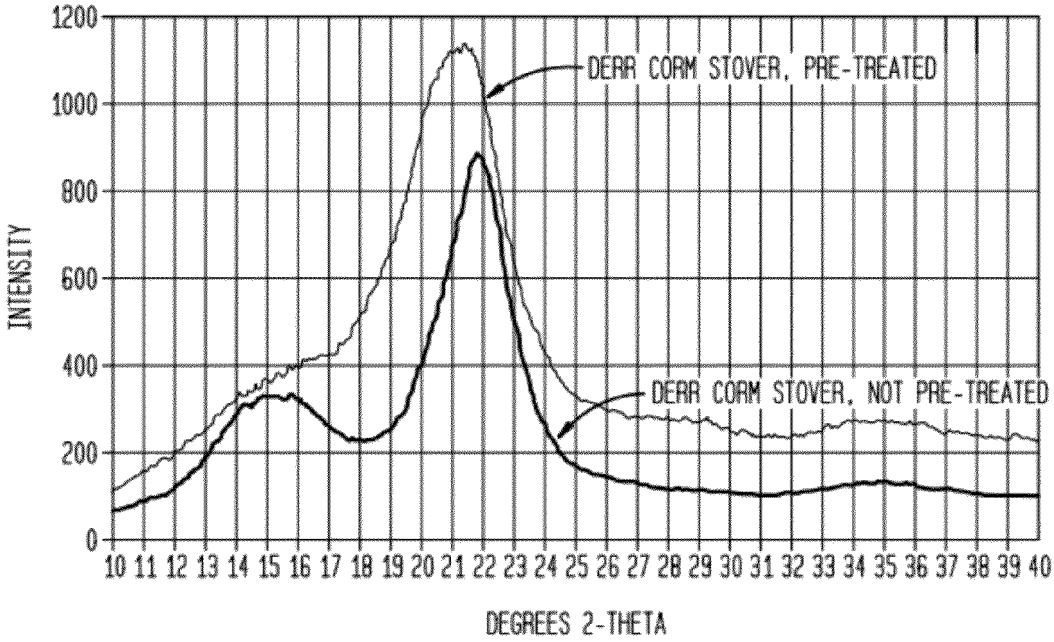
Figure 41:
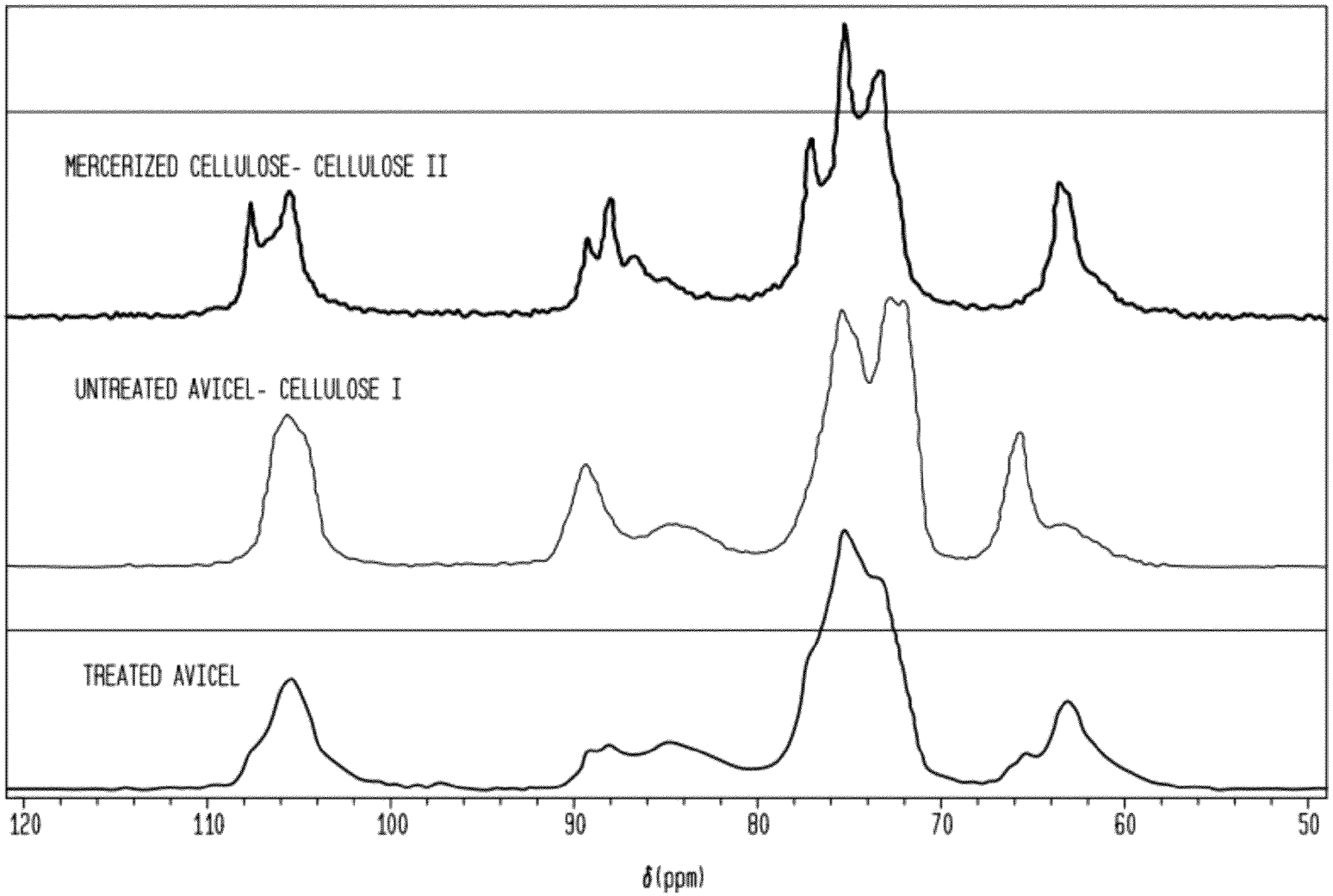
FIG. 41 compares the results of Carbon-13 NMR analysis on samples of treated, untreated and mercerized Avicel.

FIGS. 37 and 38 illustrate the broadening effect of the treatment of the present invention on the X-Ray diffraction patterns for fibers obtained from Poplar chips and mixed hardwood chips respectively. It can be observed that the changes are roughly similar to those observed with bleached hardwood Kraft fiber in FIGS. 1 and 1A with peaks being broadened and shifted toward lower values of 2Θ (Theta). FIGS. 39 and 40 are similar to FIGS. 37 and 38 but for Northern Bleached Softwood Kraft and soda-pulped corn stover, respectively.

TABLE 5

| Cellulose source | Most Prominent Raman Peaks ($cm^{-1}$) | | | | | | | | | | | | |
|---|---|---|---|---|---|---|---|---|---|---|---|---|---|
| Southern Pine | 353.7 | 376.4 | 421.3 | 436.9 | 461.5 | 494.7 | | 578.8 | 900.4 | | | 1091.7 | 1112.8 |
| HWK | 353.3 | 378.5 | 421 | 435.9 | 457.7 | 494.4 | 518.5 | 578.1 | 899.6 | 969 | 997.2 | 1089.7 | 1123.2 |
| NBSK | 350 | 381.1 | 420 | 435.6 | 453.7 | 490 | 518 | 573 | 894.5 | | | 1091.5 | 1117.4 |
| Avicel | 356 | 384.5 | 422.5 | | 460.4 | 493.7 | 522.1 | 581.5 | 899.5 | | | 1094.1 | 1120.2 |
| treated stover | | 381.3 | | 444.1 | | 495.7 | | | 902.9 | | | 1098.5 | 1117 |

| Cellulose source | Most Prominent Raman Peaks ($cm^{-1}$) | | | | | | | | |
|---|---|---|---|---|---|---|---|---|---|
| Southern Pine | 1266.6 | | 1338.9 | 1375.1 | 1417.3 | 1459.6 | | | |
| HWK | 1264.5 | 1315.9 | 1341.6 | 1377.6 | 1418.7 | 1462.4 | | | 1652.6 |
| NBSK | 1265.2 | | 1330 | 1374.1 | 1459.7 | | | | |
| Avicel | 1267.4 | | 1338.6 | 1376.6 | 1419.3 | 1462 | | | |
| treated stover | 1268.2 | | | | | | 1590.5 | 1609 | 1633.6 |

TABLE 5A

| | Widths of Critical Bands at Half Height ($cm^{-1}$) | | | | | |
|---|---|---|---|---|---|---|
| | Band | | | | | |
| | 250/400 | 400/600 | 1100 | 200/600 | 1200/1500 | 3000/3800 |
| Avicel Tr. | 51.52 | 103.05 | 48.95 | 162.89 | 162.89 | 299.92 |
| Avicel Merc. | 46.37 | 95.32 | 46.37 | 134.44 | 165.47 | 235.28 |
| Avicel UnTr. | 23.19 | 95.32 | 46.37 | 121.52 | 80.15 | 240.45 |
| NSWK Tr. | 49.62 | 126.49 | 54.56 | 179.52 | 78.88 | 304.63 |
| NSWK UnTr. | 16.37 | 38.08 | 49.10 | 87.04 | 68 | 236.64 |
| HWK Tr. | 59.94 | 75.74 | 62.24 | 203.06 | 172.22 | 272.46 |
| HWK UnTr. | 26.4 | 43.30 | 48.71 | 143.94 | 118.24 | 215.91 |
| So. Pine Tr. | 62.51 | 121.63 | 49.65 | 198.32 | 112.93 | 264.43 |
| So. Pine Un Tr. | 21.13 | 40.14 | 44.14 | 96.41 | 85.39 | 250.66 |

TABLE 5B

Peak Differentiation
Comparison of Doublets in Treated Cellulose Peaks in Untreated Cellulose

| | | Cellulose Source | | | | | | | |
|---|---|---|---|---|---|---|---|---|---|
| | | Avicel | | So Pine | | NSWK | | HWK | |
| | | Wavenumber (cm−1) | | | | | | | |
| | | 300-400 | 400-500 | 300-400 | 400-500 | 300-400 | 400-500 | 300-400 | 400-500 |
| Untr. | peak to peak | | 1.2039 | | 1.1730 | | 1.2994 | 1.2538 | 1.11 |
| merc | ratio | | 1.0661 | | | | | | |
| csi | | 1.1225 | 1.063 | 1.007 | | 1.083 | 1.096 | 1.241 | 1.00 |
| Untr. | Peak to | | 1.53669 | | 1.3780 | | 1.496 | 2.288 | 1.362 |
| merc | valley ratio | | 1.5271 | | | | | | |
| csi | | 1.175 | 1.1891 | 1.226 | | 1.3018 | 1.159 | 1.057 | 1.087 |

A variety of embodiments are considered extremely useful as summarized hereinbelow:

A wet-laid cellulosic tissue product comprising conventional cellulosic fibers and at least about 5% of laterally expanded cellulose fibers, said fibers exhibiting a broadened X-Ray diffraction peak for the most prominent reflection having a width at half-height, $(W_{1/2h})_A$, of at least about 3.0° 2Θ, said laterally expanded cellulose fibers exhibiting broad overlapping maxima in their Raman spectrum between 285 and 500 $cm^{-1}$, the height of the two tallest of said maxima in said spectrum between 285 and 500 $cm^{-1}$ being between 35 and 50% of the height of the peak near 1098 $cm^{-1}$.

A wet-laid cellulosic tissue product comprising conventional cellulosic fibers and at least about 15% of laterally expanded cellulose fibers, said fibers exhibiting a broadened X-Ray diffraction peak for the most prominent reflection having a width at half-height, $(W_{1/2h})_A$, of at least about 3.0° 2Θ.

A wet-laid cellulosic tissue product of any preceding embodiment comprising at least about 10% of laterally expanded cellulose fibers, said fibers exhibiting a broadened X-Ray diffraction peak for the most prominent reflection having a width at half-height, $(W_{1/2h})_A$, of from at least about 3.5° to about 7° 2Θ.

A wet-laid cellulosic tissue product of any preceding embodiment comprising at least about 20% of laterally expanded cellulose fibers, said fibers exhibiting a broadened X-Ray diffraction peak at 2Θ=20.6° for the most prominent reflection having a width at half-height, $(W_{1/2h})_A$, of at least about 3.5° to about 7° 2Θ.

A wet-laid cellulosic tissue product comprising conventional cellulosic fibers and at least about 5% of laterally expanded cellulose fibers, said fibers accepting a blue stain when treated with Graff C-stain, said stain exhibiting less red than the stains exhibited with bleached hardwood kraft fibers and bleached softwood kraft fibers.

A wet-laid cellulosic tissue product as described in any previous embodiment, comprising conventional cellulosic fibers and at least about 15% of laterally expanded cellulose fibers, said fibers accepting a blue stain when treated with Graff C-stain and exhibiting broad overlapping maxima in their Raman spectrum between 285 and 500 $cm^{-1}$, the height of the two tallest of said maxima in said spectrum between 285 and 500 $cm^{-1}$ being between 35 and 50% of the height of the peak near 1098 $cm^{-1}$.

A wet-laid cellulosic tissue product of any preceding embodiment comprising conventional cellulosic fibers and at least about 10% of laterally expanded cellulose fibers, said fibers accepting a deep blue stain when treated with Graff C-stain.

A wet-laid cellulosic tissue product as described in any previous embodiment, comprising conventional cellulosic fibers and at least about 20% of laterally expanded cellulose fibers, said fibers accepting a deep blue stain when treated with Graff C-stain.

A wet-laid cellulosic tissue product comprising conventional cellulosic fibers and at least about 5% of laterally expanded cellulose fibers, said fibers exhibiting an X-Ray diffraction peak at 2Θ=20.6° for the most prominent reflection and exhibiting broad overlapping maxima in their Raman spectrum between 285 and 500 $cm^{-1}$, the height of the two tallest of said maxima in said spectrum between 285 and 500 $cm^{-1}$ being between 35 and 50% of the height of the peak near 1098 $cm^{-1}$.

A wet-laid cellulosic tissue product as described in any previous embodiment, comprising conventional cellulosic fibers and at least about 15% of laterally expanded cellulose fibers, said fibers exhibiting a broadened X-Ray diffraction peak for the most prominent reflection having a width at half-height, $(W_{1/2h})_A$, of at least about 3.0° 2Θ.

A wet-laid cellulosic tissue product as described in any previous embodiment, comprising conventional cellulosic fibers and at least about 20% of laterally expanded cellulose fibers, said fibers exhibiting a broadened X-Ray diffraction peak for the most prominent reflection having a width at half-height, $(W_{1/2h})_A$, of at least about 3.0°.

A wet-laid cellulosic tissue product as described in any previous embodiment, comprising conventional cellulosic fibers and at least about 25% of laterally expanded cellulose fibers, said fibers exhibiting a broadened X-Ray diffraction peak for the most prominent reflection having a width at half-height, $(W_{1/2h})_A$, of at least about 3.5°.

A wet-laid cellulosic tissue product comprising conventional cellulosic fibers and at least about 5% of laterally expanded cellulose fibers, the Raman Spectrum of said fibers two broad peaks, one centered near 367 $cm^{-1}$ and another lower peak centered near 441 $cm^{-1}$, along with a peak near 898 $cm^{-1}$ which relative to the tallest peak in the spectrum is shorter than the corresponding peak in Cellulose I but taller than the corresponding peak in Cellulose II.

A wet-laid cellulosic tissue product comprising conventional cellulosic fibers and at least about 5% of laterally expanded cellulose fibers, said laterally expanded cellulose fibers exhibiting peaks in their Raman spectrum near 355 $cm^{-1}$, 380 $cm^{-1}$, 424 $cm^{-1}$, 898 $cm^{-1}$, 1098 $cm^{-1}$, and 1372 $cm^{-1}$, accompanied by apiculi at 489 $cm^{-1}$, 578 $cm^{-1}$, 1263 $cm^{-1}$, and 1461 $cm^{-1}$;

the peak near 380 being less than 85% of the corresponding peak for cellulose I and displaced to a lower Raman shift than the corresponding peak for Cellulose I;

the peak near 355 being less than 50% of the height of the peak near 1098 $cm^{-1}$;

the peak near 424 being less than 45% of the height of the peak near 1098 $cm^{-1}$.

A wet-laid cellulosic tissue product of any preceding embodiment, comprising conventional cellulosic fibers and at least about 5% of laterally expanded cellulose fibers exhibiting the X-ray diffraction pattern set forth in FIG. 1 for decrystallized ("LEC") cellulose.

Figure 2:
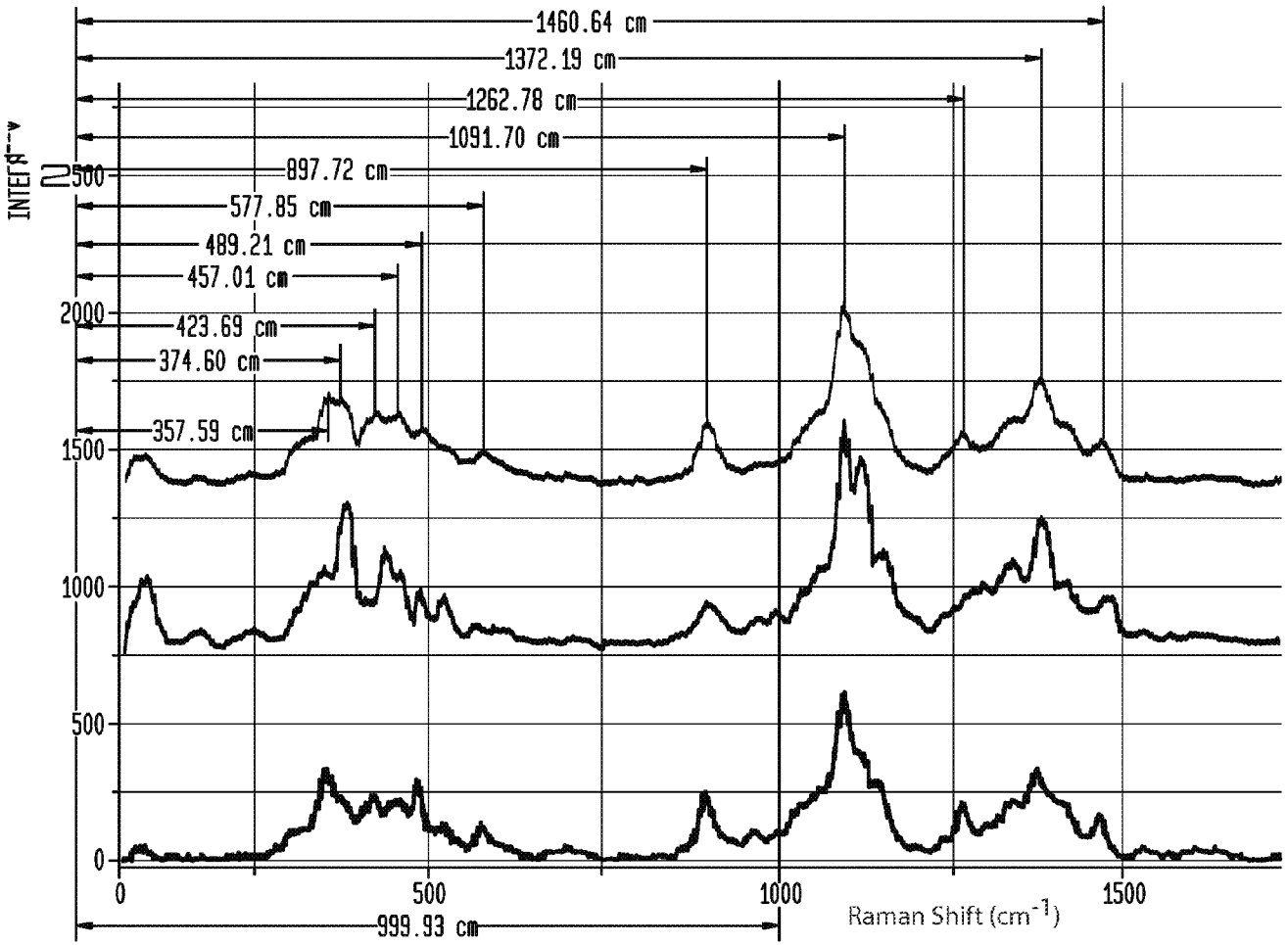
FIG. 2 compares the Raman spectra of cellulose I, cellulose II and laterally expanded cellulose of the present invention with the wave numbers corresponding to the most significant peaks being indicated for laterally expanded cellulose.

A wet-laid cellulosic tissue product of any preceding embodiment exhibiting the Raman spectrum set forth in FIG. 2 for decrystallized ("LEC") cellulose.

A wet-laid tissue product of any preceding embodiment wherein the cellulose in the LEC fibers comprises crystalline chains of cellulose molecules, the transverse spacing between the crystalline chains exceeding that found in crystals of cellulose I, while the crystalline chains retain the spatial relationship of the chain molecules relative to each other as found in the source cellulose from which the LEC fibers were derived.

A wet-laid cellulosic tissue product comprising conventional cellulosic fibers and at least about 5% of laterally expanded cellulose fibers, said laterally expanded cellulose fibers exhibiting doublets centered near 367 $cm^{-1}$ and 441 $cm^{-1}$ in their Raman spectrum.

A wet-laid cellulosic tissue product comprising conventional cellulosic fibers and at least about 5% of laterally expanded cellulose fibers, said laterally expanded cellulose fibers exhibiting apiculi in their Raman spectrum near: 489 $cm^{-1}$ and 578 $cm^{-1}$ as well as doublets centered near 367 $cm^{-1}$ and 441 $cm^{-1}$, the doublet near 367 $cm^{-1}$ extending from 355 $cm^{-1}$ to 380 $cm^{-1}$; and the doublet near 441 $cm^{-1}$ extending from 423 $cm^{-1}$ to 458 $cm^{-1}$.

A wet-laid cellulosic tissue product comprising conventional cellulosic fibers and at least about 5% of laterally expanded cellulose fibers, said laterally expanded cellulose fibers exhibiting peaks in their Raman spectrum near: 489 $cm^{-1}$ and 578 $cm^{-1}$ as well as doublets centered near 367 $cm^{-1}$ and 441 $cm^{-1}$, the doublet near 367 $cm^{-1}$ extending from 355 $cm^{-1}$ to 380 $cm^{-1}$ and comprising two overlapping smaller peaks of approximately equal intensity, one at 355 $cm^{-1}$ and the other at 380 $cm^{-1}$; and the doublet near 441 $cm^{-1}$ extending from 424 $cm^{-1}$ to 457 $cm^{-1}$.

A wet-laid cellulosic tissue product comprising conventional cellulosic fibers and at least about 5% of laterally expanded cellulose fibers, said laterally expanded cellulose fibers exhibiting apiculi in their Raman spectrum near: 489 $cm^{-1}$ and 578 $cm^{-1}$ as well as doublets centered near 370 $cm^{-1}$ and 445 $cm^{-1}$, the doublet near 367 $cm^{-1}$ extending from 355 $cm^{-1}$ to 380 $cm^{-1}$; and the doublet near 441 $cm^{-1}$ extending from 424 $cm^{-1}$ to 457 $cm^{-1}$ and comprising two overlapping smaller peaks of approximately equal intensity, one at 424 $cm^{-1}$ and the other at 457 $cm^{-1}$.

A wet-laid cellulosic tissue product comprising conventional cellulosic fibers and at least about 5% of laterally expanded cellulose fibers, said laterally expanded cellulose fibers exhibiting peaks in their Raman spectrum near: 489 $cm^{-1}$ and 578 $cm^{-1}$ as well as overlapping peaks centered near 367 $cm^{-1}$ and 441 $cm^{-1}$, the overlapping peaks near 367 $cm^{-1}$ extending from 355 $cm^{-1}$ to 380 $cm^{-1}$ and comprising two overlapping smaller peaks, one at 355 $cm^{-1}$ and the other at 380 $cm^{-1}$; and the overlapping peaks near 441 $cm^{-1}$ extending from 424 $cm^{-1}$ to 457 $cm^{-1}$ and comprising two overlapping smaller peaks, one at 424 $cm^{-1}$ and the other at 457 $cm^{-1}$.

A wet-laid cellulosic tissue product comprising conventional cellulosic fibers and at least about 5% of laterally expanded cellulose fibers, said laterally expanded cellulose fibers exhibiting apiculi in their Raman spectrum near: 489 $cm^{-1}$ and 578 $cm^{-1}$ as well as doublets centered near 367 $cm^{-1}$ and 441 $cm^{-1}$, the doublet near 367 $cm^{-1}$ extending from 355 $cm^{-1}$ to 380 $cm^{-1}$ and comprising two overlapping smaller peaks, one at 355 $cm^{-1}$ and the other at 380 $cm^{-1}$ and exceeding the spectrum near 441 by at least 15% in intensity; and the doublet near 441 $cm^{-1}$ extending from 424 $cm^{-1}$ to 457 $cm^{-1}$ and comprising two overlapping smaller peaks, one at 424 $cm^{-1}$ and the other at 457 $cm^{-1}$.

A wet-laid cellulosic tissue product comprising conventional cellulosic fibers and at least about 5% of laterally expanded cellulose fibers, said laterally expanded cellulose fibers exhibiting doublets centered near 367 $cm^{-1}$ and 441 $cm^{-1}$ in their Raman spectrum, the maximum of said spectrum in said region being less than 50% of the maximum near 1098 $cm^{-1}$.

A wet-laid cellulosic tissue product comprising conventional cellulosic fibers and at least about 5% of laterally expanded cellulose fibers, said laterally expanded cellulose fibers exhibiting at least two broad overlapping maxima in their Raman spectrum between 285 and 500 $cm^{-1}$, the height of the two tallest of said maxima in said spectrum between 285 and 500 $cm^{-1}$ being between 35 and 50% of the height of the peak near 1098 $cm^{-1}$.

A wet-laid cellulosic tissue product as described in any previous embodiment, comprising conventional cellulosic fibers and fibers exhibiting the X-ray diffraction pattern set forth in FIG. 1 for decrystallized ("LEC") cellulose.

A wet-laid cellulosic tissue product of any preceding embodiment comprising conventional cellulosic fibers and fibers exhibiting the Raman spectrum set forth in FIG. 2 for decrystallized ("LEC") cellulose.

A wet-laid tissue product of any preceding embodiment wherein the cellulose in the LEC fibers comprises crystalline chains of cellulose molecules, the transverse spacing between the crystalline chains exceeding that found in crystals of cellulose I, while the crystalline chains retain the spatial relationship of the chain molecules relative to each other as found in the source cellulose from which the LEC fibers were derived.

A method of preparing a cellulosic tissue product comprising the steps of: forming laterally expanded cellulose fibers from lignocellulosic materials; blending said laterally expanded cellulosic fibers with conventional papermaking fibers; and forming a wet laid web therefrom; said laterally expanded cellulosic fibers exhibiting the X-ray diffraction pattern set forth in FIG. 1 for decrystallized ("LEC") cellulose.

A method of preparing a cellulosic tissue product comprising the steps of: forming laterally expanded cellulose fibers from lignocellulosic materials; blending said laterally expanded cellulosic fibers with conventional papermaking fibers; and forming a wet laid web therefrom; said laterally expanded cellulosic fibers exhibiting the Raman spectrum substantially the same as that set forth in FIG. 2 for decrystallized ("LEC") cellulose.

A fibrous cellulosic product comprising conventional cellulosic fibers and nanoporous cellulose fibers, said fibers exhibiting a broadened X-Ray diffraction peak for the most prominent reflection having a width at half-height, $(W_{1/2h})_A$, of at least about 3.0° 2Θ, the Raman spectrum of said nanoporous cellulose fibers in the region between 285 and 500 $cm^{-1}$ exhibiting increased overlap and lowered maxima as compared to cellulose I and cellulose II.

A fibrous cellulosic product as described in any previous embodiment, comprising conventional cellulosic fibers and nanoporous cellulose fibers, said fibers exhibiting a broadened X-Ray diffraction peak for the most prominent reflection having a width at half-height, $(W_{1/2h})_A$, of at least about 3.25° 2Θ.

A fibrous cellulosic product of any preceding embodiment comprising conventional cellulosic fibers and nanoporous cellulose fibers, said fibers exhibiting a broadened X-Ray diffraction peak for the most prominent reflection having a width at half-height, $(W_{1/2h})_A$, of from at least about 3.5° to about 7° 2Θ.

A fibrous cellulosic product as described in any previous embodiment, comprising conventional cellulosic fibers and nanoporous cellulose fibers, said fibers exhibiting a broadened X-Ray diffraction peak at 2Θ=20.6° for the most prominent reflection having a width at half-height, $(W_{1/2h})_A$, of at least about 3.0° to about 7° 2Θ.

A fibrous cellulosic product comprising conventional cellulosic fibers and nanoporous cellulose fibers, said fibers:

accepting a blue stain when treated with Graff C-stain, said stain exhibiting less red than the stains exhibited with bleached hardwood kraft fibers and bleached softwood kraft fibers;

and exhibiting broad overlapping maxima in their Raman spectrum between 285 and 500 $cm^{-1}$, said broad overlapping maxima defining at least one doublet between 300 $cm^{-1}$ and 500 $cm^{-1}$.

A fibrous cellulosic product as described in any previous embodiment, comprising a useful article comprising conventional cellulosic fibers and nanoporous cellulose fibers.

A fibrous cellulosic product as described in any previous embodiment, comprising an assemblage of conventional cellulosic fibers and nanoporous cellulose fibers.

A fibrous cellulosic product comprising conventional cellulosic fibers and nanoporous cellulose fibers, said fibers exhibiting an X-Ray diffraction peak at 2Θ=20.6° for the most prominent reflection and exhibiting broad overlapping maxima in their Raman spectrum between 285 and 500 $cm^{-1}$, the width of the tallest of said maxima in said spectrum between 285 and 400 $cm^{-1}$ being at least about 30 $cm^{-1}$, preferably at least about 35, 40 or 45 $cm^{-1}$, and the width of the tallest of said maxima in said spectrum between 400 and 500 $cm^{-1}$ being at least about 55 $cm^{-1}$, preferably at least about 60, 65, 70 or 90 $cm^{-1}$.

A fibrous cellulosic product as described in any previous embodiment, comprising conventional cellulosic fibers and nanoporous cellulose fibers, said fibers exhibiting a broadened X-Ray diffraction peak for the most prominent reflection having a width at half-height, $(W_{1/2h})_A$, of at least about 3.0° 2Θ.

A fibrous cellulosic product as described in any previous embodiment, comprising conventional cellulosic fibers and nanoporous cellulose fibers, said fibers exhibiting a broadened X-Ray diffraction peak for the most prominent reflection having a width at half-height, $(W_{1/2h})_A$, of at least about 3.0°.

A fibrous cellulosic product as described in any previous embodiment, comprising conventional cellulosic fibers and nanoporous cellulose fibers, said fibers exhibiting a broadened X-Ray diffraction peak for the most prominent reflection having a width at half-height, $(W_{1/2h})_A$, of at least about 3.5°.

A fibrous cellulosic product comprising conventional cellulosic fibers and nanoporous cellulose fibers, the Raman Spectrum of said fibers exhibiting two broad peaks, one centered near 367 $cm^{-1}$ and another lower peak centered near 441 $cm^{-1}$, the peak centered near 367 $cm^{-1}$ having a width at half height of at least about 30 $cm^{-1}$, the peak centered near 441 $cm^{-1}$ having a width at half height of at least about 55 $cm^{-1}$.

A fibrous cellulosic product comprising conventional cellulosic fibers and nanoporous cellulose fibers, said nanoporous cellulose fiber exhibiting a peak in its Raman spectrum between: 355 and 360 $cm^{-1}$, the height of the peak between 355 and 360 $cm^{-1}$ being at least 34% of the height of the peak between 1094 and 1098 $cm^{-1}$.

A fibrous cellulosic product comprising conventional cellulosic fibers and nanoporous cellulose fibers, said nanoporous cellulose fiber exhibiting a peak in its Raman spectrum between: 416 and 423 $cm^{-1}$, the height of the peak between 416 and 423 $cm^{-1}$ being at least 20% of the height of the peak between 1094 and 1098 $cm^{-1}$.

A fibrous cellulosic product comprising conventional cellulosic fibers and nanoporous cellulose fibers, said nanoporous cellulose fiber exhibiting a peak in its Raman spectrum between: 487-493 $cm^{-1}$, the height of the peak between 487 and 493 $cm^{-1}$ being at least 25% of the height of the peak between 1094 and 1098 $cm^{-1}$.

A fibrous cellulosic product comprising conventional cellulosic fibers and nanoporous cellulose fibers, said nanoporous cellulose fiber exhibiting a peak in its Raman spectrum between: 895 and 901 $cm^{-1}$, the height of the peak between 895 and 901 $cm^{-1}$ being at least 25% of the height of the peak between 1094 and 1098 $cm^{-1}$.

A fibrous cellulosic product comprising conventional cellulosic fibers and nanoporous cellulose fibers, said nanoporous cellulose fiber exhibiting a peak in its Raman spectrum between: 1260 and 1267 $cm^{-1}$, the height of the peak between 1260 and 1267 $cm^{-1}$ being at least 10% of the height of the peak between 1094 and 1098 $cm^{-1}$.

A fibrous cellulosic product comprising conventional cellulosic fibers and nanoporous cellulose fibers, said nanoporous cellulose fiber exhibiting peaks in its Raman spectrum between:

about 355 and 360 $cm^{-1}$,
about 416 and 424 $cm^{-1}$,
about 487 and 493 $cm^{-1}$,
about 895 and 901 $cm^{-1}$,
about 1094 and 1098 $cm^{-1}$, and
about 1260 and 1267 $cm^{-1}$;

the height of the peak between about 355 and 360 $cm^{-1}$ being at least 34% of the height of the peak between 1094 and 1098 $cm^{-1}$;

the height of the peak between about 416 and 424 $cm^{-1}$ being at least 20% of the height of the peak between 1094 and 1098 $cm^{-1}$;

the height of the peak between about 487 and 493 $cm^{-1}$ being at least 25% of the height of the peak between 1094 and 1098 $cm^{-1}$;

the height of the peak between about 895 and 901 $cm^{-1}$ being at least 25% of the height of the peak between 1094 and 1098 $cm^{-1}$; and the height of the peak between about 1260 and 1267 $cm^{-1}$ being at least 10% of the height of the peak between 1094 and 1098 $cm^{-1}$.

A fibrous cellulosic product comprising conventional cellulosic fibers and nanoporous cellulose fiber, said nanoporous cellulose fiber exhibiting at least a first and a second peak in its Raman spectrum, said first peak falling into a band between: about 348 and 360 $cm^{-1}$, about 416 and 424 $cm^{-1}$, about 487 and 493 $cm^{-1}$, about 895 and 901 $cm^{-1}$, about 1094 and 1098 $cm^{-1}$, or about 1260 and 1267 $cm^{-1}$; said second peak falling into one of said bands other than the band into which said first peak falls; wherein the height of said first peak relative to the height of the peak between 1094 and 1098 $cm^{-1}$ is:

at least 34%—in the case in which said first peak falls into the band between about 348 and 360 $cm^{-1}$;

at least 20% of—in the case in which said first peak falls into the band between about 416 and 424 $cm^{-1}$;

at least 25%—in the case in which said first peak falls into the band between about 487 and 493 $cm^{-1}$;

at least 25%—in the case in which said first peak falls into the band between about 895 and 901 $cm^{-1}$; or at least 10%—in the case in which said first peak falls into the band between about 1260 and 1267 $cm^{-1}$;

while the height of said second peak relative to the height of the peak between about 1094 and 1098 $cm^{-1}$ is:

at least 34%—in the case in which said second peak falls into the band between about 348 and 360 $cm^{-1}$;

at least 20% of—in the case in which said second peak falls into the band between about 416 and 424 $cm^{-1}$;

at least 25%—in the case in which said second peak falls into the band between about 487 and 493 $cm^{-1}$;

at least 25%—in the case in which said second peak falls into the band between about 895 and 901 $cm^{-1}$; or at least 10%—in the case in which said second peak falls into the band between about 1260 and 1267 $cm^{-1}$.

A fibrous cellulosic product comprising conventional cellulosic fibers and nanoporous cellulose fiber, said nanoporous cellulose fiber exhibiting a multiplicity of peaks falling into defined bands in its Raman spectrum including at least one peak falling between 1094 $cm^{-1}$ and 1098 $cm^{-1}$, the height of each said peak relative to the height of said peak falling between 1094 $cm^{-1}$ and 1098 $cm^{-1}$ exceeding the minimum relative peak height for that band as set forth in the following table:

| | Defined Band $cm^{-1}$ | | | | |
|---|---|---|---|---|---|
| | 348-360 | 416-423 | 487-493 | 895-901 | 1260-1267 |
| Minimum Relative Peak Height | 34% | 20% | 25% | 25% | 10% |

at least three peaks, other than said one peak between falling 1094 $cm^{-1}$ and 1098 $cm^{-1}$; both falling into one of said defined bands and exceeding the Minimum Relative Peak Height specified for that defined band.

A fibrous cellulosic product as described in any previous embodiment, wherein at least four of the peaks in the Raman spectrum of said cellulosic tissue product both fall into one of said defined bands and exceed the minimum relative peak height for the band into which it falls.

A fibrous cellulosic product as described in any previous embodiment, wherein at least five of the peaks in the Raman spectrum of said cellulosic tissue product both fall into one of said defined bands and exceed the minimum relative peak height for the band into which it falls.

A fibrous cellulosic product, comprising conventional cellulosic fibers and at least about 5% of nanoporous cellulose fibers, said nanoporous cellulose fibers exhibiting a doublet between 350 $cm^{-1}$ and 385 $cm^{-1}$ in their Raman spectrum.

A fibrous cellulosic product, comprising conventional cellulosic fibers and at least about 5% of nanoporous cellulose fibers, said nanoporous cellulose fibers exhibiting a doublet between 417 $cm^{-1}$ and 445 $cm^{-1}$ in their Raman spectrum.

A fibrous cellulosic product, comprising conventional cellulosic fibers and nanoporous cellulose fibers, said nanoporous cellulose fibers exhibiting at least two doublets, one centered between 350 $cm^{-1}$ and 385 $cm^{-1}$ and the other between 417 $cm^{-1}$ and 445 $cm^{-1}$.

A fibrous cellulosic product, comprising conventional cellulosic fibers and nanoporous cellulose fibers, said nanoporous cellulose fibers exhibiting doublets in their Raman spectrum between 350 $cm^{-1}$ and 385 $cm^{-1}$ as well as between 417 $cm^{-1}$ and 445 $cm^{-1}$.

A fibrous cellulosic product, comprising conventional cellulosic fibers and nanoporous cellulose fibers, said nanoporous cellulose fibers exhibiting at least two broad overlapping maxima in their Raman spectrum between 285 and 500 $cm^{-1}$, the height of the two tallest of said maxima in said spectrum between 285 and 500 $cm^{-1}$ being between 35 and 55% of the height of the peak near 1098 $cm^{-1}$.

A fibrous cellulosic product, comprising conventional cellulosic fibers and nanoporous cellulose fibers prepared from wood pulp fibers, the Raman Spectrum of said nanoporous fibers exhibiting three broad peaks, one being a series of overlapping peaks between about 250 $cm^{-1}$ and about 400 $cm^{-1}$; another being a series of overlapping peaks between about 400 $cm^{-1}$ and about 600 $cm^{-1}$ and the third being a peak centered near 1098 $cm^{-1}$, at least two of said peaks being at least 10% broader at half height than the corresponding peak in the pulp from which it was prepared.

The fibrous cellulosic product as described in any previous embodiment, wherein at least two of said peaks are at least 15% broader at half height than the corresponding peak in the pulp from which it was prepared.

The fibrous cellulosic product as described in any previous embodiment, wherein at least two of said peaks are at least 20% broader at half height than the corresponding peak in the pulp from which it was prepared.

The fibrous cellulosic product as described in any previous embodiment, wherein at least one of said peaks is at least 100% broader at half height than the corresponding peak in the pulp from which it was prepared.

A fibrous cellulosic product, comprising conventional cellulosic fibers and nanoporous cellulose fibers prepared from cellulosic fibers, the Raman Spectrum of said nanoporous fibers exhibiting two broad peaks, one being a series of overlapping peaks between about 250 $cm^{-1}$ to about 400 $cm^{-1}$; and the other being a series of overlapping peaks between about 400 $cm^{-1}$ to about 600 $cm^{-1}$, each said peak being at least 10% broader at half height than the corresponding peak in the cellulosic fiber from which it was prepared.

The fibrous cellulosic product as described in any previous embodiment, wherein each said peak is at least 15% broader at half height than the corresponding peak in the cellulosic fiber from which it was prepared.

The fibrous cellulosic product as described in any previous embodiment, wherein each said peak is at least 20% broader at half height than the corresponding peak in the cellulosic fiber from which it was prepared.

The fibrous cellulosic product as described in any previous embodiment, wherein at least one of said peaks is at least 100% broader at half height than the corresponding peak in the pulp from which it was prepared.

A fibrous cellulosic product, comprising conventional cellulosic fibers and nanoporous cellulose fibers prepared from wood pulp fibers, the Raman Spectrum of said nanoporous fibers exhibiting three broad peaks, one being a series of overlapping peaks between about 250 $cm^{-1}$ and about 400 $cm^{-1}$ exhibiting a width at half height of at least about 30 $cm^{-1}$; another being a series of overlapping peaks between about 400 $cm^{-1}$ and about 600 $cm^{-1}$ exhibiting a width at half height of at least about 55 $cm^{-1}$ and the third being a peak centered near 1098 $cm^{-1}$ exhibiting a width at half height of at least about 46 $cm^{-1}$.

A fibrous cellulosic product as described in any previous embodiment, wherein the series of overlapping peaks between about 250 $cm^{-1}$ and about 400 $cm^{-1}$ exhibits a width at half height of at least about 35 $cm^{-1}$; and the series of overlapping peaks between about 400 $cm^{-1}$ and about 600 $cm^{-1}$ exhibits a width at half height of at least about 55 $cm^{-1}$.

A fibrous cellulosic product as described in any previous embodiment, wherein the series of overlapping peaks between about 250 $cm^{-1}$ and about 400 $cm^{-1}$ exhibits a width at half height of at least about 40 $cm^{-1}$; the series of overlapping peaks between about 400 $cm^{-1}$ and about 600 $cm^{-1}$ exhibiting a width at half height of at least about 60 $cm^{-1}$ and the peak centered near 1098 $cm^{-1}$ exhibiting a width at half height of at least about 50 $cm^{-1}$.

A fibrous cellulosic product as described in any previous embodiment, wherein the series of overlapping peaks between about 400 $cm^{-1}$ and about 600 $cm^{-1}$ exhibits a width at half height of at least about 70 $cm^{-1}$.

A fibrous cellulosic product, comprising conventional cellulosic fibers and nanoporous cellulose fibers prepared from cellulosic fibers, the Raman Spectrum of said nanoporous fibers exhibiting two broad peaks, one being a series of overlapping peaks between about 250 $cm^{-1}$ and about 400 $cm^{-1}$ exhibiting a width at half height of at least about 30 $cm^{-1}$; and the other being a series of overlapping peaks between about 400 $cm^{-1}$ and about 600 $cm^{-1}$ exhibiting a width at half height of at least about 55 $cm^{-1}$.

A fibrous cellulosic product as described in any previous embodiment, wherein the series of overlapping peaks between about 250 $cm^{-1}$ and about 400 $cm^{-1}$ exhibits a width at half height of at least about 35 $cm^{-1}$.

A fibrous cellulosic product as described in any previous embodiment, wherein the series of overlapping peaks between about 400 $cm^{-1}$ and about 600 $cm^{-1}$ exhibits a width at half height of at least about 60 $cm^{-1}$.

A fibrous cellulosic product as described in any previous embodiment, wherein the series of overlapping peaks between about 400 $cm^{-1}$ and about 600 $cm^{-1}$ exhibits a width at half height of at least about 90 $cm^{-1}$.

A fibrous cellulosic product as described in any previous embodiment, wherein the series of overlapping peaks between about 250 $cm^{-1}$ and about 400 $cm^{-1}$ exhibits a width at half height of at least about 40 $cm^{-1}$.

A fibrous cellulosic product as described in any previous embodiment, wherein the series of overlapping peaks between about 400 $cm^{-1}$ and about 600 $cm^{-1}$ exhibits a width at half height of at least about 60 $cm^{-1}$.

A fibrous cellulosic product as described in any previous embodiment, wherein the series of overlapping peaks between about 400 $cm^{-1}$ and about 600 $cm^{-1}$ exhibits a width at half height of at least about 90 $cm^{-1}$.

A fibrous cellulosic product as described in any previous embodiment, wherein the series of overlapping peaks between about 250 $cm^{-1}$ and about 400 $cm^{-1}$ exhibits a width at half height of at least about 45 $cm^{-1}$.

A fibrous cellulosic product as described in any previous embodiment, wherein the series of overlapping peaks between about 400 $cm^{-1}$ and about 600 $cm^{-1}$ exhibits a width at half height of at least about 60 $cm^{-1}$.

A fibrous cellulosic product as described in any previous embodiment, wherein the series of overlapping peaks between about 400 $cm^{-1}$ and about 600 $cm^{-1}$ exhibits a width at half height of at least about 90 $cm^{-1}$.

A fibrous cellulosic product as described in any previous embodiment, wherein the series of overlapping peaks between about 250 $cm^{-1}$ and about 400 $cm^{-1}$ exhibits a width at half height of at least about 50 $cm^{-1}$.

A fibrous cellulosic product as described in any previous embodiment, wherein the series of overlapping peaks between about 400 $cm^{-1}$ and about 600 $cm^{-1}$ exhibits a width at half height of at least about 60 $cm^{-1}$.

A fibrous cellulosic product as described in any previous embodiment, wherein the series of overlapping peaks between about 400 $cm^{-1}$ and about 600 $cm^{-1}$ exhibits a width at half height of at least about 90 $cm^{-1}$.

A fibrous cellulosic product as described in any previous embodiment, wherein the series of overlapping peaks between about 250 $cm^{-1}$ and about 400 $cm^{-1}$ exhibits a width at half height of at least about 45 $cm^{-1}$; and the series of overlapping peaks between about 400 $cm^{-1}$ and about 600 $cm^{-1}$ exhibits a width at half height of at least about 75 $cm^{-1}$.

A fibrous cellulosic product comprising conventional cellulosic fibers and cellulosic fiber having a Raman Spectrum exhibiting peaks near 380, 496, 897, 1098, 1590 and 1609 $cm^{-1}$ and exhibiting:

a broad band of overlapping peaks in the neighborhood of 400 to 500 $cm^{-1}$ with a width measured at half height of at least about 150 $cm^{-1}$ and a maximum height of at least about 60% of the height of the peak near 1098 $cm^{-1}$;

a band of overlapping peaks near 1600 $cm^{-1}$ with a width measured at half height of at least about 40 $cm^{-1}$ and a maximum height of at least about the height of the peak near 1098 $cm^{-1}$; and a band of peaks near 1100 $cm^{-1}$ having a width at half height of at least about 35 $cm^{-1}$.

A fibrous cellulosic product comprising conventional cellulosic fibers and cellulosic fiber having a Raman Spectrum exhibiting peaks near 380, 496, 897, 1098, 1590 and 1609 $cm^{-1}$, with:

the height of the peak near 381 $cm^{-1}$ being at least 60% of the height of the peak near 1098 $cm^{-1}$, the height of the peak near 496 $cm^{-1}$ being at least about 50% of the height of the peak near 1098 $cm^{-1}$;

the height of the peak near 903 $cm^{-1}$ being at least about 35% of the height of the peak near 1098 $cm^{-1}$;

the height of the peak near 1590 $cm^{-1}$ being at least about 95% of the height of the peak near 1098 $cm^{-1}$; and the height of the peak near 1609 $cm^{-1}$ being at least about the height of the peak near 1098 $cm^{-1}$.

A fibrous cellulosic product comprising conventional cellulosic fibers and cellulosic fiber having a Raman Spectrum exhibiting peaks near 458, 1098, and 1600 $cm^{-1}$, with:

the height of the peak near 458 $cm^{-1}$ being at least 60% of the height of the peak near 1098 $cm^{-1}$, and the height of the peak near 1600 $cm^{-1}$ being at least about 110% of the height of the peak near 1098 $cm^{-1}$.

A fibrous cellulosic product comprising conventional cellulosic fibers and cellulosic fiber having a Raman Spectrum exhibiting peaks near 380, 496, 897, 1098, 1590 and 1609 $cm^{-1}$ and exhibiting:

a broad band of overlapping peaks in the neighborhood of 400 to 500 $cm^{-1}$ with a width measured at half height of at least about 150 $cm^{-1}$ and a maximum height of at least about 65% of the height of the peak near 1098 $cm^{-1}$;

a band of overlapping peaks near 1600 $cm^{-1}$ with a width measured at half height of at least about 40 $cm^{-1}$ and a maximum height of at least about 115% of the height of the peak near 1098 $cm^{-1}$; and a band of peaks near 1098 $cm^{-1}$ having a width at half height of at least about 40 $cm^{-1}$.

An assemblage of cellulosic fibers comprising laterally expanded cellulose exhibiting a peak in its Raman spectrum near 2888 $cm^{-1}$ and another peak near 3400 $cm^{-1}$, the descent from the peak near 2888 $cm^{-1}$ being smooth and without inflection points and only one local maximum being presented between 3200 $cm^{-1}$ and 3600 $cm^{-1}$.

While the invention has been described in detail with numerous examples and embodiments, modifications within the spirit and scope of the invention will be readily apparent to those of ordinary skill in the art. In view of the foregoing discussion, relevant knowledge in the art and references discussed above in connection with the Background and Detailed Description, the disclosures of which are all incorporated herein by reference, further description is deemed unnecessary.

What is claimed is:

1. A fibrous cellulosic product, comprising conventional cellulosic fibers and laterally expanded cellulose fibers, exhibiting a broadened X-Ray diffraction peak for the most prominent reflection having a width at half-height, $(W_{1/2h})_A$, of at least about 3.0° 2θ, said laterally expanded cellulose fibers exhibiting at least two broad overlapping maxima in their Raman spectrum between 285 and 500 $cm^{-1}$ the height of the two tallest of said maxima in said spectrum between 285 and 500 $cm^{-1}$ being between 35 and 50% of the height of a peak near 1098 $cm^{-1}$; said at least two maxima between 285 and 500 $cm^{-1}$ being at least 10% broader at half height than the corresponding maxima in the pulp from which said laterally expanded cellulose fibers were prepared.

2. The fibrous cellulosic product of claim 1, comprising laterally expanded cellulose fibers, said fibers exhibiting a broadened X-Ray diffraction peak for the most prominent reflection having a width at half-height, $(W_{1/2h})_A$, of at least about 3.25° 2θ.

3. The fibrous cellulosic product of claim 1, comprising laterally expanded cellulose fibers, said fibers exhibiting a broadened X-Ray diffraction peak for the most prominent reflection having a width at half-height, $(W_{1/2h})_A$, of from at least about 3.5° to about 7° 2θ.

4. The fibrous cellulosic product of claim 1, comprising laterally expanded cellulose fibers, said fibers exhibiting a broadened X-Ray diffraction peak at 2 θ=20.6° for the most prominent reflection having a width at half-height, $(W_{1/2h})_A$, of at least about 3.5° to about 7° 2θ.

5. The fibrous cellulosic product of claim 1, wherein said at least two broad overlapping maxima in the Raman spectrum of said laterally expanded cellulose fibers are at least 10% broader at half height than the corresponding maxima in the pulp from which said laterally expanded cellulose fibers were prepared.

6. The fibrous cellulosic product of claim 5, wherein at least one of said at least two broad overlapping maxima in the Raman spectrum of said laterally expanded cellulose fibers is at least 100% broader at half height than the corresponding maxima in the pulp from which said laterally expanded cellulose fibers were prepared.

7. The fibrous cellulosic product of claim 1, wherein said at least two broad overlapping maxima in the Raman spectrum of said laterally expanded cellulose fibers are at least 15% broader at half height than the corresponding maxima in the pulp from which said laterally expanded cellulose fibers were prepared.

8. The fibrous cellulosic product of claim 7, wherein at least one of said at least two broad overlapping maxima in the Raman spectrum of said laterally expanded cellulose fibers is at least 100% broader at half height than the corresponding maxima in the pulp from which said laterally expanded cellulose fibers were prepared.

9. The fibrous cellulosic product of claim 1, wherein said at least two broad overlapping maxima in the Raman spectrum of said laterally expanded cellulose fibers are at least 20% broader at half height than the corresponding maxima in the pulp from which said laterally expanded cellulose fibers were prepared.

10. The fibrous cellulosic product of claim 9, wherein at least one of said at least two broad overlapping maxima in the Raman spectrum of said laterally expanded cellulose fibers is at least 100% broader at half height than the corresponding maximum in the pulp from which said laterally expanded cellulose fibers were prepared.

11. A fibrous cellulosic product comprising conventional cellulosic fibers and laterally expanded cellulose fibers, said fibers accepting a blue stain when treated with Graff C-stain, said stain exhibiting less red than the stains exhibited with bleached hardwood kraft fibers and bleached softwood kraft fibers.

12. The fibrous cellulosic product of claim 11, comprising laterally expanded cellulose fibers, said fibers accepting a blue stain when treated with Graff C-stain and exhibiting at least two broad overlapping maxima in their Raman spectrum between 285 and 500 $cm^{-1}$, the height of the two tallest of said maxima in said spectrum between 285 and 500 $cm^{-1}$ being between 35 and 50% of the height of the peak near 1098 $cm^{-1}$, said at least two maxima between 285 and 500 $cm^{-1}$ being at least 10% broader at half height than the corresponding maxima in the pulp from which said laterally expanded cellulose fibers were prepared.

13. The fibrous cellulosic product of claim 12, comprising conventional cellulosic fibers and laterally expanded cellulose fibers, said laterally expanded cellulose fibers accepting a deep blue stain when treated with Graff C-stain.

14. The fibrous cellulosic product of claim 11, comprising laterally expanded cellulose fibers, said laterally expanded cellulose fibers accepting a deep blue stain when treated with Graff C-stain.

15. The fibrous cellulosic product of claim 12, wherein said at least two broad overlapping maxima in the Raman spectrum of said laterally expanded cellulose fibers are at least 15% broader at half height than the corresponding maxima in the pulp from which said laterally expanded cellulose fibers were prepared.

16. The fibrous cellulosic product of claim 15, wherein at least one of said at least two broad overlapping maxima in the Raman spectrum of said laterally expanded cellulose fibers is at least 100% broader at half height than the corresponding maxima in the pulp from which said laterally expanded cellulose fibers were prepared.

17. The fibrous cellulosic product of claim 12, wherein said at least two broad overlapping maxima in the Raman spectrum of said laterally expanded cellulose fibers are at least 20% broader at half height than the corresponding maxima in the pulp from which said laterally expanded cellulose fibers were prepared.

18. The fibrous cellulosic product of claim 17, wherein at least one of said at least two broad overlapping maxima in the Raman spectrum of said laterally expanded cellulose fibers is at least 100% broader at half height than the corresponding maximum in the pulp from which said laterally expanded cellulose fibers were prepared.

19. A fibrous cellulosic product, comprising conventional cellulosic fibers and laterally expanded cellulose fibers, said fibers exhibiting an X-Ray diffraction peak at 2θ=20.6° for the most prominent reflection and exhibiting at least two broad overlapping maxima in their Raman spectrum between 285 and 500 $cm^{-1}$, the height of the two tallest of said maxima in said spectrum between 285 and 500 $cm^{-1}$ being between 35 and 50% of the height of a peak near 1098 $cm^{-1}$, said at least two maxima between 285 and 500 $cm^{-1}$ being at least 10% broader at half height than the corresponding maxima in the pulp from which said laterally expanded cellulose fibers were prepared.

20. The fibrous cellulosic product of claim 19, comprising laterally expanded cellulose fibers, said laterally expanded cellulose fibers exhibiting a broadened X-Ray diffraction peak for the most prominent reflection having a width at half-height, $(W_{1/2h})_A$, of at least about 3.0° 2θ.

21. The fibrous cellulosic product of claim 20, comprising laterally expanded cellulose fibers, said laterally expanded cellulose fibers exhibiting a broadened X-Ray diffraction peak for the most prominent reflection having a width at half-height, $(W_{1/2h})_A$, of at least about 3.25° 2θ.

22. The cellulosic product of claim 19, comprising laterally expanded cellulose fibers, said laterally expanded cellulose fibers exhibiting a broadened X-Ray diffraction peak for the most prominent reflection having a width at half-height, $(W_{1/2h})_A$, of at least about 3.5° 2θ.

23. A fibrous cellulosic product, comprising conventional cellulosic fibers and laterally expanded cellulose fibers, the Raman Spectrum of said laterally expanded cellulose fibers exhibiting two broad peaks, one centered near 367 $cm^{-1}$ and another lower peak centered near 441 $cm^{-1}$, along with a peak near 897 $cm^{-1}$ which relative to the tallest peak in the spectrum is shorter than the corresponding peak in Cellulose II but taller than the corresponding peak in Cellulose I as delineated in FIG. 2 hereof, said peak centered near 367 $cm^{-1}$ as well as said peak centered near 441 $cm^{-1}$ being at least 10% broader at half height than the corresponding peak in the pulp from which said laterally expanded cellulose fibers were prepared.

24. The fibrous cellulosic product of claim 23, exhibiting the X-ray diffraction pattern set forth in FIG. 1 for decrystallized ("LEC") cellulose.

25. The fibrous cellulosic product of claim 23, exhibiting the Raman spectrum set forth in FIG. 2 for decrystallized ("LEC") cellulose.

26. The fibrous cellulosic product of claim 23, wherein the cellulose in the LEC fibers comprises at least partially disordered crystalline chains of cellulose molecules, the transverse spacing between the at least partially disordered crystalline chains exceeding that found in crystals of Cellulose I derived from the source of that fibrous cellulosic product, while the crystalline chains retain the spatial relationship of the chain molecules relative to each other as found in the source cellulose from which the LEC fibers were derived.

27. A fibrous cellulosic product, comprising conventional cellulosic fibers and laterally expanded cellulose fibers, said laterally expanded cellulose fibers exhibiting peaks in their Raman spectrum near: 489 $cm^{-1}$ and 578 $cm^{-1}$ as well as overlapping peaks centered near 367 $cm^{-1}$ and 441 $cm^{-1}$, the overlapping peaks near 367 $cm^{-1}$ extending from 355 $cm^{-1}$ to 380 $cm^{-1}$ and comprising two overlapping smaller peaks, one at 355 $cm^{-1}$ and the other at 380 $cm^{-1}$; and the overlapping peaks near 441 $cm^{-1}$ extending from 424 $cm^{-1}$ to 457 $cm^{-1}$ and comprising two overlapping smaller peaks, one at 424 $cm^{-1}$ and the other at 457 $cm^{-1}$.

28. A fibrous cellulosic product, comprising conventional cellulosic fibers and laterally expanded cellulose fibers, said laterally expanded cellulose fibers exhibiting apiculi in their Raman spectrum near: 489 $cm^{-1}$ and 578 $cm^{-1}$ as well as doublets centered near 367 $cm^{-1}$ and 441 $cm^{-1}$, the doublet near 367 $cm^{-1}$ extending from 355 $cm^{-1}$ to 380 $cm^{-1}$ and comprising two overlapping smaller peaks, one at 355 $cm^{-1}$ and the other at 380 $cm^{-1}$ and exceeding the spectrum near 441 $cm^{-1}$ by at least 15% in intensity; and the doublet near 441 $cm^{-1}$ extending from 424 $cm^{-1}$ to 457 $cm^{-1}$ and comprising two overlapping smaller peaks.

29. A fibrous cellulosic product, comprising conventional cellulosic fibers and laterally expanded cellulose fibers, said laterally expanded cellulose fibers exhibiting doublets centered near 367 $cm^{-1}$ and 441 $cm^{-1}$ in their Raman spectrum, the maximum of said doublets in said region being less than 50% of the maximum near 1098 $cm^{-1}$.

30. A fibrous cellulosic product, comprising conventional cellulosic fibers and laterally expanded cellulose fibers, said laterally expanded cellulose fibers exhibiting at least two broad overlapping maxima in their Raman spectrum between 285 and 500 $cm^{-1}$, the height of the two tallest of said maxima in said spectrum between 285 and 500 $cm^{-1}$ being between 35 and 50% of the height of a peak near 1098 $cm^{-1}$, said at least two maxima between 285 and 500 $cm^{-1}$ being at least 10% broader at half height than the corresponding maxima in the pulp from which said laterally expanded cellulose fibers were prepared.

31. The fibrous cellulosic product of claim 30, the laterally expanded cellulosic fibers exhibiting the X-ray diffraction pattern set forth in FIG. 1 for nanoporous cellulose.

32. The fibrous cellulosic product of claim 30, the laterally expanded cellulosic fibers exhibiting the Raman spectrum set forth in FIG. 2 for nanoporous cellulose.

33. The fibrous cellulosic product of claim 30, wherein the cellulose in the LEC fibers comprises at least partially disordered crystalline chains of cellulose molecules, the transverse spacing between the at least partially disordered crystalline chains exceeding that found in crystals of cellulose I derived from the source of that fibrous cellulosic product, while the crystalline chains retain the spatial relationship of the chain molecules relative to each other as found in the source cellulose from which the LEC fibers were derived.

34. A method of preparing a cellulosic tissue product comprising the steps of: forming laterally expanded cellulose fibers from lignocellulosic materials; blending said laterally expanded cellulosic fibers with conventional papermaking fibers; and forming a wet laid web therefrom; said laterally expanded cellulosic fibers exhibiting the X-ray diffraction pattern set forth in FIG. 1 for decrystallized ("LEC") cellulose.

35. A method of preparing a cellulosic tissue product comprising the steps of:

forming laterally expanded cellulose fibers from lignocellulosic materials;

blending said laterally expanded cellulosic fibers with conventional papermaking fibers; and forming a wet laid web therefrom;

said laterally expanded cellulosic fibers exhibiting the Raman spectrum substantially the same as that set forth in FIG. 2 for nanoporous cellulose.

* * * * *